US009561661B2

(12) United States Patent
Nukui

(10) Patent No.: US 9,561,661 B2
(45) Date of Patent: Feb. 7, 2017

(54) LIQUID CARTRIDGE

(71) Applicant: BROTHER KOGYO KABUSHIKI KAISHA, Nagoya-shi, Aichi-ken (JP)

(72) Inventor: Kosuke Nukui, Nagoya (JP)

(73) Assignee: BROTHER KOGYO KABUSHIKI KAISHA, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/010,286

(22) Filed: Jan. 29, 2016

(65) Prior Publication Data

US 2016/0279956 A1 Sep. 29, 2016

(30) Foreign Application Priority Data

Mar. 27, 2015 (JP) ..... 2015-066107

(51) Int. Cl.
*B41J 2/14* (2006.01)
*B41J 2/175* (2006.01)

(52) U.S. Cl.
CPC ..... *B41J 2/17523* (2013.01)

(58) Field of Classification Search
CPC ..... B41J 2/175; B41J 2/17513; B41J 2/17553; B41J 2/1752; B41J 2/17523
See application file for complete search history.

(56) References Cited

U.S. PATENT DOCUMENTS 8,979,253 B2 * 3/2015 Yamada ..... B41J 2/185 347/85
9,033,477 B2 * 5/2015 Nishida ..... B41J 2/175 347/85

FOREIGN PATENT DOCUMENTS

JP 9-277560 A 10/1997
JP 2011-140128 A 7/2011

* cited by examiner

*Primary Examiner* — Lamson Nguyen
(74) *Attorney, Agent, or Firm* — Merchant & Goul P.C.

(57) ABSTRACT

A liquid cartridge includes a liquid chamber with a liquid outlet configured to supply the liquid from an interior of the chamber to an exterior of the liquid chamber. A body is positioned in the chamber and is movable between a first position wherein movement of the body is restricted, and a second position wherein the body is movable along a movement path between the first and second positions. The body has a plurality of sides. A detector is positioned in the chamber and is movable in response to movement of the body between the first and second positions. The body defines a plurality openings that extend into the body through at least two sides of the body. A plurality of resist surfaces are formed by the plurality of openings, and the resist surfaces are configured to resist movement of the body between the first and second positions.

23 Claims, 28 Drawing Sheets

LIQUID CARTRIDGE

CROSS-REFERENCE TO RELATED APPLICATION

This application claims priority from Japanese Patent Application Nos. 2015-066107, filed on Mar. 27, 2015 which is incorporated herein by reference in its entirety.

TECHNICAL FIELD

Aspects described herein relate to a liquid cartridge storing liquid whose viscosity is changeable over time.

BACKGROUND

A known inkjet recording apparatus records an image on a recording medium by ejecting ink stored in an ink tank from nozzles. In such an inkjet recording apparatus, a change in viscosity of ink stored in the ink tank may cause clogging in the nozzles and/or deterioration of image recording quality.

In order to avoid an occurrence of such problems, the inkjet recording apparatus calculates the viscosity of ink stored in the ink tank and performs an appropriate preliminary discharge in accordance with the result of the ink viscosity calculation. More specifically, the inkjet recording apparatus calculates the ink viscosity based on an amount of ink remaining in the ink tank and a time elapsed from placement of the ink tank in the inkjet recording apparatus.

SUMMARY

In accordance with aspects of the present disclosure, an example liquid cartridge includes a liquid chamber with a liquid outlet configured to supply the liquid from an interior of the chamber to an exterior of the liquid chamber. A body is positioned in the chamber and is movable between a first position wherein movement of the body is restricted, and a second position wherein the body is movable along a movement path between the first and second positions. The body has a plurality of sides. A detector is positioned in the chamber and is movable in response to movement of the body between the first and second positions. A plurality openings are defined in the body and extend into the body through at least two sides of the body. A plurality of resist surfaces are formed by the plurality of openings, and the resist surfaces are configured to resist movement of the body between the first and second positions.

DESCRIPTION OF THE DRAWINGS

Aspects of the disclosure are illustrated by way of example and not by limitation in the accompanying figures in which like reference characters indicate similar elements.

DETAILED DESCRIPTION

Figure 1:
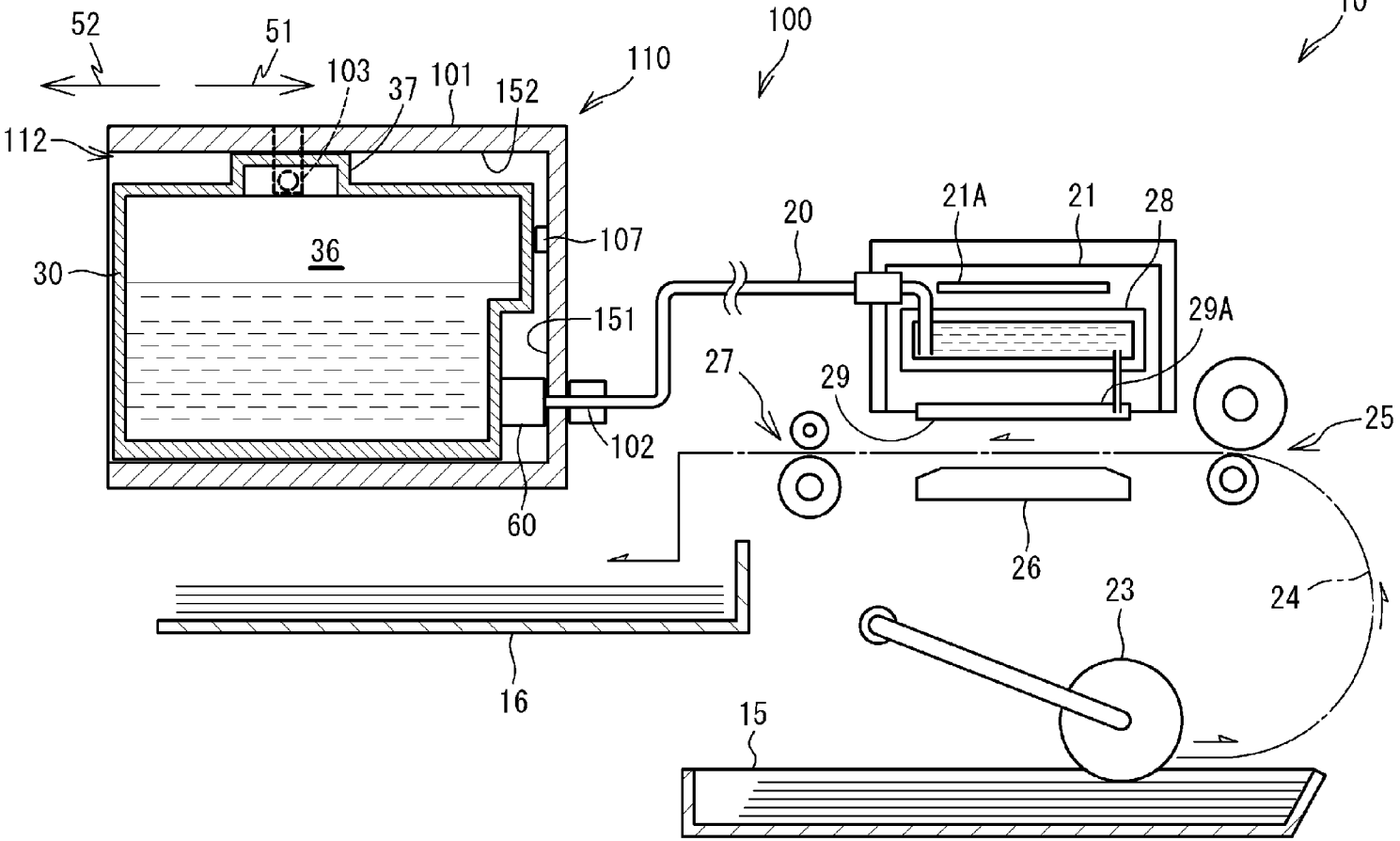
FIG. 1 is a schematic cross-sectional view depicting an internal configuration of a printer including a cartridge holder in an illustrative embodiment according to one or more aspects of the disclosure.

Hereinafter, various illustrative embodiments will be described in detail with reference to the accompanying drawings, wherein like reference numerals represent like parts and assemblies throughout the several views. Reference to various embodiments does not limit the scope of the claims attached hereto. Additionally, any example set forth in the specification are not intended to be limiting and merely set forth some of the many possible embodiments for the appended claims. Throughout the specification, a threshold range might not necessarily have upper and lower limits that are both specified but may need to have at least one specified limit (e.g., a specified upper limit or a specified lower limit). For example, when the threshold range has a specified upper limit, the threshold range may include all values that are smaller than or equal to the upper limit. Similar to this, when the threshold range has a specified lower limit, the threshold range may include all values that are greater than or equal to the lower limit. In the description below, a direction that an ink cartridge 30 is inserted into a cartridge holder 110 may be defined as an insertion direction 51. A direction that is opposite to the insertion direction 51 and that an ink cartridge 30 is removed from the cartridge holder 110 may be defined as a removal direction 52. In the illustrative embodiments, the insertion direction 51 and the removal direction 52 both may be the horizontal direction but might not be limited thereto. In a state where an ink cartridge 30 is completely placed in the cartridge holder 110, e.g., in a state where the ink cartridge 30 is in a use position, the gravity direction may be defined as a downward direction 53 and a direction opposite to the gravity direction may be defined as an upward direction 54. Directions orthogonal to the insertion direction 51 and the downward direction 53 may be defined as a rightward direction 55 and a leftward direction 56 when viewed in the removal direction 52. Unless otherwise defined, it is assumed that an ink cartridge 30 is in the use position.

The degree of the change in ink viscosity of ink contained in an ink cartridge may differ greatly depending on, for example, an ink type and/or the temperature of an environment where an ink tank is stocked. Known inkjet recording apparatuses might not be capable of calculating the viscosity of ink stored in an ink tank that has been left and not been attached to the inkjet recording apparatus. Accordingly, some embodiments of the disclosure provide for a liquid cartridge that may enable direct estimation of viscosity of liquid stored in a storage chamber thereof.

[Overview of Printer 10]

As depicted in FIG. 1, a printer 10 is configured to record an image onto a recording sheet by selectively ejecting ink droplets onto the recording sheet using an inkjet recording system. The printer 10 (as an example of a liquid consuming apparatus) includes a recording head 21 (as an example of a liquid consuming unit), an ink supply unit 100, and an ink tube 20. The ink tube 20 connects between the recording head 21 and the ink supply unit 100. The ink supply unit 100 includes a cartridge holder 110 (as an example of a holder). The cartridge holder 110 is configured to accommodate one or more ink cartridges 30 (as an example of a liquid cartridge). The cartridge holder 110 has an opening 112 at one end. An ink cartridge 30 is inserted into the cartridge holder 110 in the insertion direction 51 through the opening 112 or is removed from the cartridge holder 110 in the removal direction 52 through the opening 112.

An ink cartridge 30 stores ink (as an example of liquid) to be used in the printer 10. In a state where the ink cartridge 30 is completely placed in the cartridge holder 110, the ink cartridge 30 and the recording head 21 are connected with each other via the ink tube 20. The recording head 21 includes a sub tank 28. The sub tank 28 is configured to temporarily store therein ink supplied from the ink cartridge 30 through the ink tube 20. The recording head 21 ejects ink, which is supplied from the sub tank 28, from nozzles 29 selectively. For example, the recording head 21 further includes a head control board 21A. The head control board 21A applies drive voltage selectively to piezoelectric elements 29A provided for the respective nozzles 29, whereby ink is ejected from appropriate nozzles 29 selectively.

In the printer 10, a feed roller 23 feeds one or more recording sheets one by one from a feed tray 15 into a conveying path 24. A conveyor roller pair 25 further conveys the recording sheet onto a platen 26. The recording head 21 selectively ejects ink onto the recording sheet that is passing over the platen 26, thereby recording an image onto the recording sheet. A discharge roller pair 27 then discharges the recording sheet, which has passed over the platen 26, onto a discharge tray 16 disposed at a downstream end of the conveying path 24.

[Ink Supply Unit 100]

As depicted in FIG. 1, the ink supply unit 100 is included in the printer 10. The ink supply unit 100 is configured to supply ink to the recording head 21 of the printer 10. The ink supply unit 100 includes the cartridge holder 110 for accommodating one or more ink cartridges 30. The cartridge holder 110 includes a casing 101, an ink needle 102, a sensor 103 (as an example of a sensor), and a cartridge sensor 107.

In FIG. 1, an ink cartridge 30 is completely placed in the cartridge holder 110. That is, the ink cartridge 30 is in the use position. The cartridge holder 110 is capable of accommodating a plurality of, for example, four, ink cartridges 30 of respective colors of ink, e.g., cyan, magenta, yellow, and black. Therefore, in the illustrative embodiment, the cartridge holder 110 includes four each of the ink needle 102, the sensor 103, and the cartridge sensor 107, for the ink cartridges 30 of the respective four colors. In the description below, plural same components have the same or similar configuration and function in the same or similar manner to each other. Therefore, one of the plural same components will be described in detail, and a description for the others will be omitted. When a single ink cartridge 30 is inserted into, removed from, or placed in the cartridge holder 110, one or more other ink cartridges 30 may or might not be placed in the cartridge holder 110.

[Ink Needles 102]

As depicted in FIG. 1, the casing 101 has the opening 112 at one end. The casing 101 has an inner back surface 151 at an opposite end to the opening 112 thereof. An ink needle 102 protrudes in the removal direction 52 from the inner back surface 151 of the casing 101. The ink needle 102 is disposed at a particular position at the inner back surface 151 of the casing 101 such that the ink needle 102 is capable of pointing to an ink outlet 60 (as an example of a liquid outlet) of a corresponding ink cartridge 30 placed in the cartridge holder 110. The ink needle 102 may be a resin hollow tube having a liquid channel inside thereof. The ink needle 102 has a hole at or near its distal end. An ink tube 20 is connected with a proximal end of the ink needle 102. Ink stored in an ink chamber 36 (as an example of a liquid storage chamber) of an ink cartridge 30 is allowed to flow into the ink tube 20 through the ink needle 102 disposed in the ink outlet 60 by insertion. That is, ink stored in the ink chamber 36 is supplied to the recording head 21 from the ink cartridge 30 placed in the cartridge holder 110, through the ink outlet 60. All of the ink needles 102 provided for the ink cartridges 30 of the respective colors have the same or similar configuration and function in the same or similar manner to each other.

The printer 10 further includes a cover (not depicted) that is configured to selectively cover and expose the opening 112 of the cartridge holder 110. The cover is supported by one of the casing 101 and a housing (not depicted) of the printer 10 such that the cover is capable of being opened and closed relative to the cartridge holder 110. When the cover is opened, the opening 112 is exposed to the outside of the printer 10. In this state, a user is allowed to insert or remove one or more ink cartridges 30 into or from the cartridge holder 110 through the opening 112. When the cover is closed, the opening 112 is covered by the cover and thus is not exposed to the outside of the printer 10. In this state, the user is not allowed to insert or remove any ink cartridge 30 into or from the cartridge holder 110.

Throughout the description, an ink cartridge 30 placed in the cartridge holder 110 refers to as an ink cartridge 30, at least a portion of which is located in the cartridge holder 110 (more specifically, in the casing 101). Therefore, an ink cartridge 30 placed in the cartridge holder 110 includes an ink cartridge 30 that is being inserted into the cartridge holder 110.

A state where an ink cartridge 30 is completely placed in the cartridge holder 110 refers to a state where an ink cartridge 30 is at least able to supply ink to the recording head 21 therefrom. For example, the completely placed state includes a state where an ink cartridge 30 is in a particular state that enables the printer 10 to perform image recording, e.g., a state where an ink cartridge 30 is retained so as not to move relative to the cartridge holder 110 or a state where an ink cartridge 30 is located inside the cartridge holder 110 with the cover of the cartridge holder 110 closed. When an ink cartridge 30 is completely placed in the cartridge holder 110, the ink cartridge 30 is in the use position.

[Sensors 103]

As depicted in FIG. 1, the casing 101 has an inner top surface 152 that extends from an upper end of the inner back surface 151 toward the opening 112. A sensor 103 protrudes downward from the inner top surface 152 of the casing 101. The sensor 103 includes a light emitting portion and a light receiving portion. The light emitting portion is spaced from the light receiving portion in one of the rightward direction 55 and the leftward direction 56. In a state where an ink cartridge 30 is completely placed in the cartridge holder 110, a raised portion 37 of the ink cartridge 30 is located between the light emitting portion and the light receiving portion. In other words, the light emitting portion and the light receiving portion are disposed on opposite sides of the raised portion 37 of the ink cartridge 30 that is completely placed in the cartridge holder 110. In the illustrative embodiment, an optical path that light emitted from the light emitting portion travels may coincide with a right-left direction 5556.

The sensor 103 is configured to output different detection signals according to whether light outputted from the light emitting portion has been received or not by the light receiving portion. For example, when the light receiving portion has not received light emitted from the light emitting portion (e.g., when intensity of received light is lower than a predetermined intensity), the sensor 103 outputs a low-level signal (e.g., a signal having a level lower than a threshold level). When the light receiving portion has received light outputted from the light emitting portion (e.g., when the intensity of received light is higher than or equal to the predetermined intensity), the sensor 103 outputs a high-level signal (e.g., a signal having a level higher than or equal to the threshold level). In the illustrative embodiment, the light emitting portion emits light (e.g., visible light or infrared light) that is capable of passing through walls of the raised portion 37 (e.g., a frame 31) of the ink cartridge 30 but is not capable of passing through ink stored in the ink cartridge 30. All of the sensors 103 provided for the ink cartridges 30 of the respective colors have the same or similar configuration and function in the same or similar manner to each other.

[Cartridge Sensors 107]

As depicted in FIG. 1, a cartridge sensor 107 is disposed above a corresponding ink needle 102 and at the inner back surface 151 of the casing 101. The cartridge sensor 107 is disposed at a cartridge placement detecting position in a route for inserting an ink cartridge 30 within the cartridge holder 110. The cartridge sensor 107 is configured to output different detection signals to a controller 130 (refer to FIG. 4) according to whether an ink cartridge 30 is present or absent at the cartridge placement detecting position. In the illustrative embodiment, the cartridge sensor 107 is disposed at a particular position such that an ink cartridge 30 is located at the cartridge placement detecting position when the ink cartridge 30 is completely placed in the cartridge holder 110.

For example, when the cartridge sensor 107 is not pressed by a front end 58 of a cartridge cover 33 of an ink cartridge 30 placed in the cartridge holder 110, the cartridge sensor 107 outputs a low-level signal. When the cartridge sensor 107 has been pressed by the front end 58 of the cartridge cover 33, the cartridge sensor 107 outputs a high-level signal. In the illustrative embodiment, the cartridge sensor 107 may be a mechanical sensor that is configured to output different detection signals according to whether the cartridge sensor 107 has been pressed by the front end 58 of the cartridge cover 33. Nevertheless, in other embodiments, an optical sensor may be used as a cartridge sensor 107. All of the cartridge sensors 107 provided for the ink cartridges 30 of the respective colors have the same or similar configuration and function in the same or similar manner to each other.

[Ink Cartridges 30]

Figure 2:
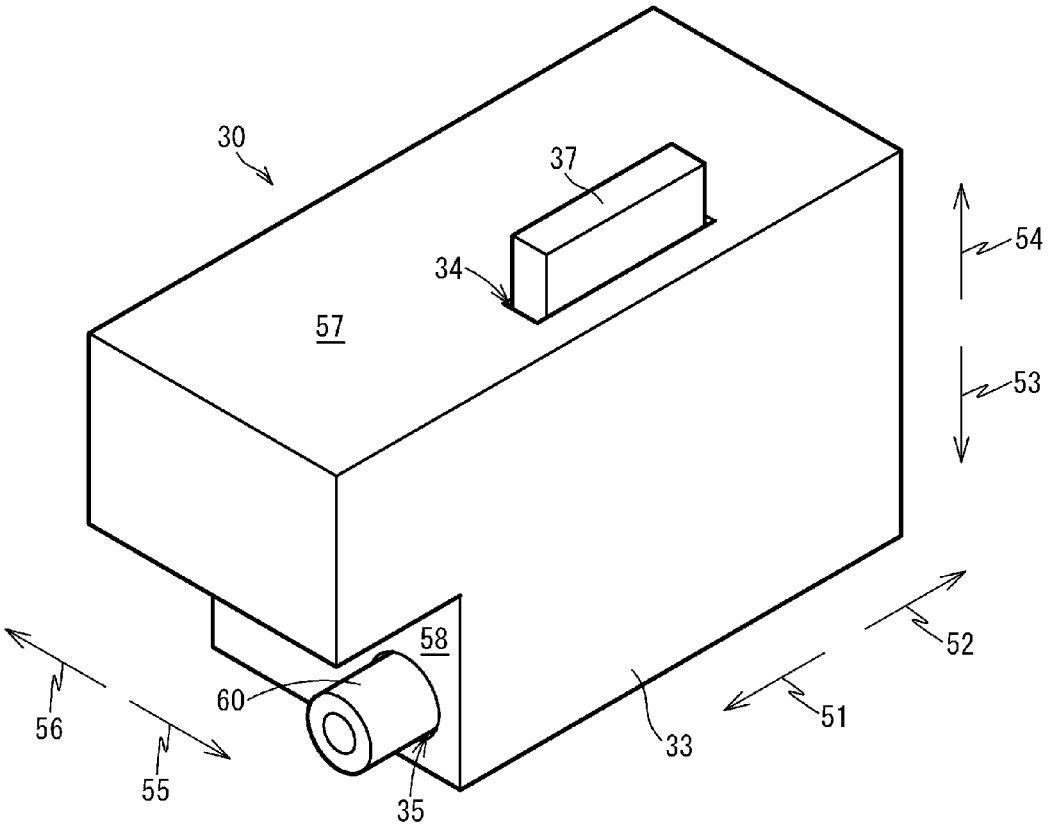
FIG. 2 is a schematic external perspective view depicting an ink cartridge in the illustrative embodiment according to one or more aspects of the disclosure.
Figure 3:
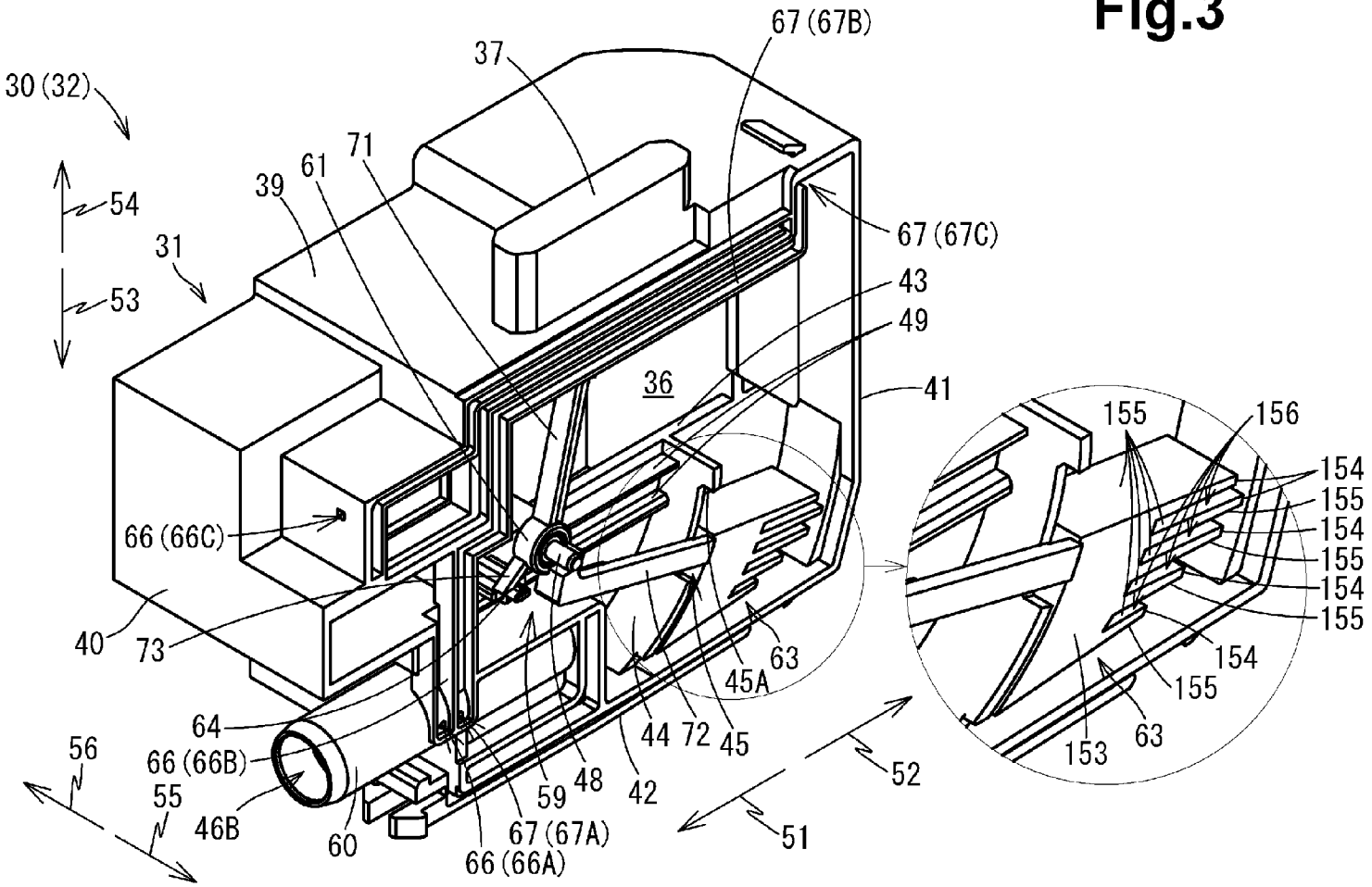
FIG. 3 is a perspective view depicting an ink tank of the ink cartridge in the illustrative embodiment according to one or more aspects of the disclosure.

All ink cartridges 30 to be placed in the cartridge holder 110 have the same or similar configuration and function in the same or similar manner to each other. Therefore, one of the ink cartridge 30 will be described in detail. As depicted in FIGS. 2 and 3, an ink cartridge 30 includes an ink tank 32 and a cartridge cover 33 that covers the ink tank 32. The cartridge cover 33 consists of two members that are engageable with each other and sandwich the ink tank 32 therebetween to cover the ink tank 32. As depicted in FIG. 2, the cartridge cover 33 has two openings 34 and 35. The opening 34 is defined in a top end 57 of the cartridge cover 33. The ink tank 32 includes a raised portion 37. The raised portion 37 of the ink tank 32 protrudes to the outside of the cartridge cover 33 through the opening 34. The opening 35 is defined in a front end 58 of the cartridge cover 33. The ink tank 32 further includes an ink outlet 60. The ink outlet 60 of the ink tank 32 protrudes to the outside of the cartridge cover 33 through the opening 35.

In the illustrative embodiment, the cartridge cover 33 allows the raised portion 37 and the ink outlet 60 of the ink tank 32 to protrude to the outside of the cartridge cover 33 through the opening 34 and the opening 35, respectively. Nevertheless, in other embodiments, for example, the cartridge cover 33 may also expose another portion of the ink tank 32 to the outside of the cartridge cover 33 as well as the raised portion 37 and the ink outlet 60.

As depicted in FIG. 3, the ink tank 32 includes an ink chamber 36, the ink outlet 60, and a frame 31. The ink tank 32 may be made of transparent or translucent resin. The ink tank 32 is configured to supply ink to the outside thereof from the ink chamber 36 through the ink outlet 60. The ink cartridge 30 is inserted into the cartridge holder 110 along the insertion direction 51 or removed from the cartridge holder 110 along the removal direction 52 while retained in a standing posture as depicted in FIG. 2, e.g., while oriented such that a surface facing downward is regarded as the bottom of the ink cartridge 30 and a surface facing upward is regarded as the top of the ink cartridge 30.

As depicted in FIG. 3, the frame 31 may have a substantially rectangular parallelepiped external shape. The frame 31 may be relatively narrow in the right-left direction 5556, that is, the frame 31 has a greater dimension both in an up-down direction 54, 53 and in an insertion-removal direction 51 than a dimension in the right-left direction 5556. The frame 31 includes a front wall 40, a rear wall 41, an upper wall 39, a lower wall 42, a first inner wall 43, and a second inner wall 44. The front wall 40 and the rear wall 41 at least partially overlap each other when viewed in the insertion direction 51 or in the removal direction 52. The upper wall 39 and the lower wall 42 at least partially overlap each other when viewed in the downward direction 53 or in the upward direction 54. The first inner wall 43 stands at a substantially middle portion of the lower wall 42 in the right-left direction 5556, extending toward the upper wall 39. The second inner wall 44 protrudes from the first inner wall 43 in the rightward direction 55. The wall facing forward (e.g., the direction toward which the ink cartridge 30 is inserted) at the time of inserting the ink cartridge 30 into the cartridge holder 110 may function as the front wall 40 and the wall facing backward (e.g., the direction toward which the ink cartridge 30 is removed) at the time of inserting the ink cartridge 30 into the cartridge holder 110 may function as the rear wall 41.

The upper wall 39 connects between an upper end of the front wall 40 and an upper end of the rear wall 41. The lower wall 42 connects between a lower end of the front wall 40 and a lower end of the rear wall 41. The raised portion 37 protrudes in the upward direction 54 from the upper wall 39. At least the upper wall 39 including the raised portion 37 allows light emitted from the light emitting portion of the sensor 103 to pass therethrough.

The frame 31 has open ends in the right-left direction 5556. The right and left open ends of the frame 31 are sealed by respective films (not depicted). The film for sealing the right open end of the frame 31 has a shape that corresponds to an outline of the frame 31 when viewed in the rightward direction 55. The film for sealing the left open end of the frame 31 has a shape that corresponds to an outline of the frame 31 when viewed in the leftward direction 56. The films constitute right and left walls, respectively, of the ink chamber 36. The films are adhered to right and left ends, respectively, of the upper wall 39, the front wall 40, the rear wall 41, and the lower wall 42 by heat to close the right and left open ends of the ink chamber 36 tightly. Therefore, the ink chamber 36 is defined by the upper wall 39, the front wall 40, the rear wall 41, the lower wall 42, and the films and thus is capable of storing ink therein.

The ink tank 32 further includes a projection 48 inside the frame 31. The projection 48 extends from the first inner wall 43 in the rightward direction 55. A detector 59 is disposed inside the ink chamber 36. The projection 48 supports the detector 59.

[Ink Chamber 36]

As depicted in FIG. 3, the ink chamber 36 is defined between the front wall 40 and the rear wall 41. The ink chamber 36 stores ink therein. Until the ink cartridge 30 is placed in the cartridge holder 110, the ink chamber 36 of the ink cartridge 30 is maintained at a negative pressure. The ink chamber 36 becomes exposed to the outside air through a first air communication passage 66 and a second air communication passage 67 by placement of the ink cartridge 30 in the cartridge holder 110. Ink stored in the ink chamber 36 is allowed to flow to the outside of the ink cartridge 30 through the ink outlet 60 also by placement of the ink cartridge 30 in the cartridge holder 110. The raised portion 37 has an interior space inside thereof and the interior space constitutes a portion of the ink chamber 36.

[Ink Outlet 60]

Figure 5A:
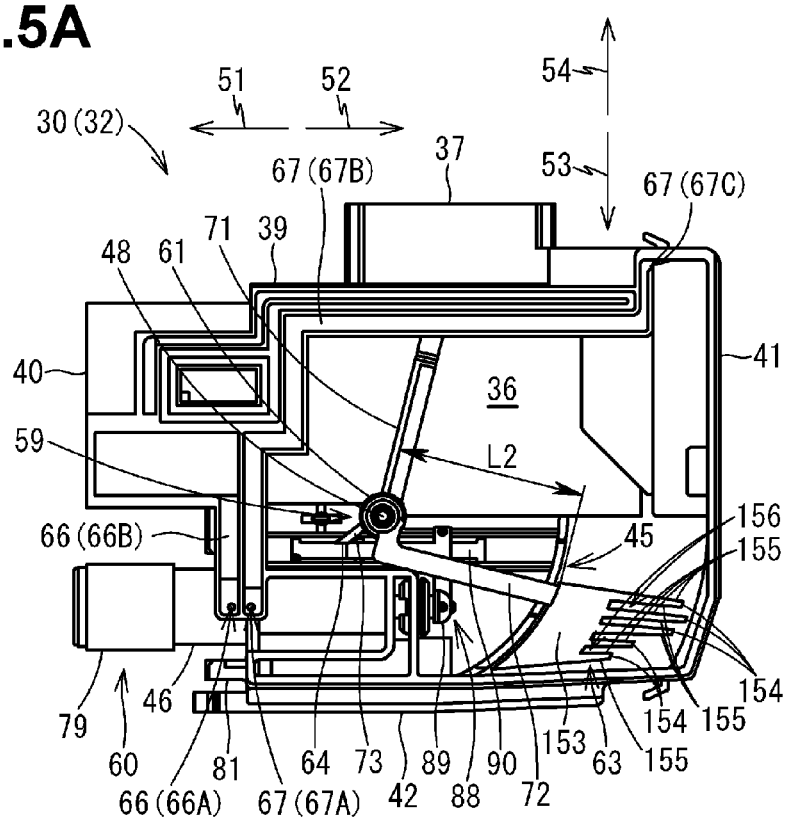
FIG. 5A is a right side view depicting the ink tank in the illustrative embodiment according to one or more aspects of the disclosure, wherein a restriction member is located at a restrict position and a detector is located at a released position.
Figure 5B:
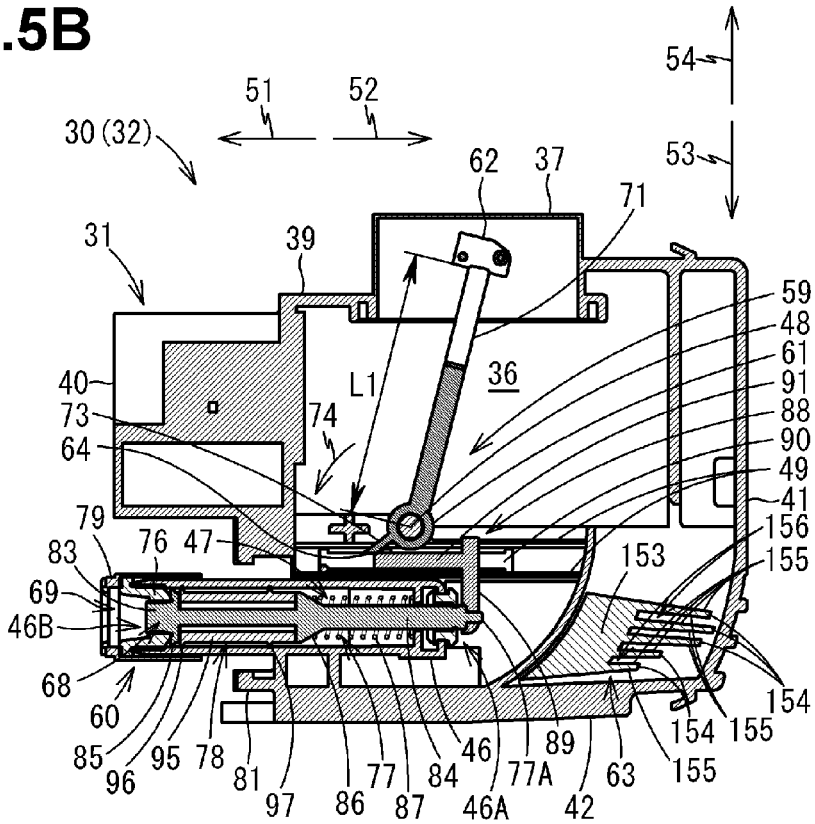
FIG. 5B is a vertical cross-sectional view depicting the ink tank in the illustrative embodiment according to one or more aspects of the disclosure, wherein the restriction member is located at the restrict position and the detector is located at the restricted position.

As depicted in FIGS. 5A and 5B, the ink outlet 60 is disposed at a lower end portion of the front wall 40. The ink outlet 60 includes a cylindrical wall 46, a sealer 76, and a cap 79. The cylindrical wall 46 may have a tubular shape having a valve chamber 47 therein. The sealer 76 and the cap 79 are attached on the cylindrical wall 46.

The cylindrical wall 46 extends between the inside of the ink chamber 36 and the outside of the ink chamber 36. The cylindrical wall 46 has an opening 46A and an opening 46B at opposite ends in an insertion-removal direction 5152. More specifically, the cylindrical wall 46 has the opening 46A at one end that faces the direction toward which the ink cartridge 30 is removed (e.g., at one end that is located inside the ink chamber 36). The cylindrical wall 46 has the opening 46B at the other end that faces the direction the ink cartridge 30 is inserted (e.g., at the other end that is located outside the ink chamber 36 (e.g., an exposed end)). With this configuration, the ink chamber 36 is in communication with the outside of the ink cartridge 30 through the valve chamber 47. Thus, the ink outlet 60 allows ink stored in the ink chamber 36 to flow to the outside of the ink cartridge 30. The exposed end, e.g., a distal end, of the cylindrical wall 46 is attached with the sealer 76 and the cap 79.

As depicted in FIGS. 3 and 5A, the valve chamber 47 is connected with the first air communication passage 66 and the second air communication passage 67. The first air communication passage 66 allows air to flow therethrough between the valve chamber 47 and the outside of the ink cartridge 30. That is, the first air communication passage 66 allows the valve chamber 47 to be exposed to the outside air. The first air communication passage 66 has a hole 66A, a groove 66B, and a hole 66C. The hole 66A provides communication between the inside and the outside of the cylindrical wall 46. The groove 66B has one end that is in communication with the hole 66A. The hole 66C provides communication between the other end of the groove 66B and the outside of the ink cartridge 30.

The second air communication passage 67 allows air to flow therethrough between the valve chamber 47 and the ink chamber 36. The second air communication passage 67 has a hole 67A, a groove 67B, and a hole 67C. The hole 67A provides communication between the inside and the outside of the cylindrical wall 46. The groove 67B has one end that is communication with the hole 67A. The hole 67C provides communication between the other end of the groove 67B and the ink chamber 36. The hole 67A is spaced from the hole 66A in the removal direction 52. The hole 67C is defined at a particular position that is higher than a level of ink stored in an ink chamber 36 of a not-yet-used ink cartridge 30. For example, the hole 67C is defined at a position that is higher than a level of the maximum amount of ink that the ink chamber 36 is capable of storing. The first air communication passage 66 and the second air communication passage 67 are liquid tightly sealed by the film constituting the right wall of the ink cartridge 30.

As depicted in FIG. 5B, the sealer 76 has a substantially circular cylindrical shape. The sealer 76 has an outside diameter that is substantially the same as an outside diameter of the cylindrical wall 46. The sealer 76 is liquid tightly attached on the exposed end of the cylindrical wall 46. The sealer 76 has a through hole 68 at a substantially middle portion thereof. The through hole 68 penetrates the sealer 76 in the insertion direction 51. The through hole 68 provides communication between the inside and the outside of the valve chamber 47. The through hole 68 has a diameter that is slightly smaller than an outside diameter of the ink needle 102. The sealer 76 may be made of elastic material, for example, rubber.

The cap 79 is fitted over the exposed end of the cylindrical wall 46. The cap 79 and the cylindrical wall 46 sandwiches the sealer 76 therebetween. The cap 79 has a through hole 69 at a substantially middle portion thereof. The through hole 69 penetrates the cap 79 in a thickness direction of the cap 79. The through hole 69 has a diameter that is greater than a diameter of the through hole 68. The cap 79 includes an engagement portion (not depicted) protruding in the removal direction 52. The engagement portion of the cap 79 is in engagement with an engagement portion 81 of the front wall 40. The cap 79 retains the sealer 76 at the exposed end of the cylindrical wall 46.

[Valve 77, Sealing Member 78, and Coil Spring 87]

Figure 8A:
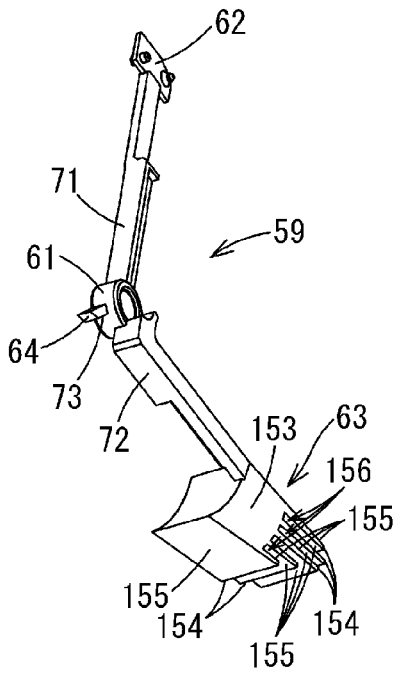
FIG. 8A is a perspective view depicting the detector in the illustrative embodiment according to one or more aspects of the disclosure.
Figure 8B:
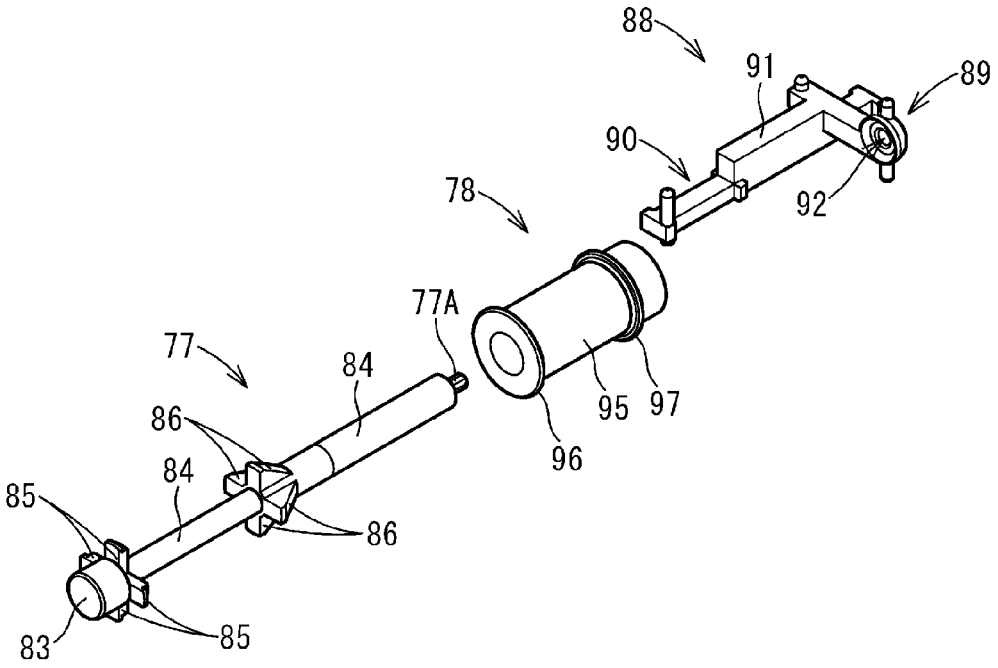
FIG. 8B is a perspective view depicting a valve, a sealing member, and the restriction member in the illustrative embodiment according to one or more aspects of the disclosure.

As depicted in FIGS. 5A, 5B, and 8B, the cylindrical wall 46 of the ink outlet 60 accommodates therein a valve 77 (as an example of a movable member), a sealing member 78, and a coil spring 87 (as an example of an urging member). The valve 77, the sealing member 78, and the coil spring 87 are configured to switch a state of the ink outlet 60 selectively between a state where the ink outlet 60 allows ink to flow therethrough to the outside of the ink cartridge 30 from the ink chamber 36 and a state where the ink outlet 60 prevents ink from flowing therethrough to the outside of the ink cartridge 30 from the ink chamber 36. The valve 77, the sealing member 78, and the coil spring 87 are further configured to switch the state of the ink outlet 60 selectively between a state where the ink outlet 60 allows air communication therethrough between the ink chamber 36 and the outside of the ink cartridge 30 and a state where the ink outlet 60 prevents air communication therethrough between the ink chamber 36 and the outside of the ink cartridge 30.

The valve 77 includes a circular plug 83, a rod 84, a plurality of first protrusions 85, and a plurality of second protrusions 86. The rod 84 extends from the plug 83 in the removal direction 52. The first protrusions 85 and the second protrusions 86 protrude from the rod 84 in respective directions with respect to a diameter direction of the rod 84. The valve 77 is disposed within the valve chamber 47 while the plug 83 is oriented toward the exposed end of the cylindrical wall 46. In this state, the valve 77 is movable selectively in the insertion direction 51 or in the removal direction 52. A distal end of the rod 84 that is opposite to the end connected with the plug 83 protrudes to the ink chamber 36 beyond the valve chamber 47. That is, the valve 77 extends between the ink outlet 60 and the ink chamber 36. Nevertheless, in other embodiments, for example, the rod 84 might not necessarily protrude to the ink chamber 36 beyond the valve chamber 47. In this case, the valve 77 may be disposed within the ink outlet 60.

The valve 77 has an outside diameter that is smaller than the inside diameter of the cylindrical wall 46. Thus, the valve 77 is capable of moving selectively in the insertion direction 51 and in the removal direction 52. For example, the valve 77 is capable of moving between a first position (e.g., a position of the valve 77 depicted in FIG. 5B) and a second position (e.g., a position of the valve 77 depicted in FIG. 6B). The second position is closer to the rear wall 41 than the first position.

The plug 83 has an outside diameter that is slightly larger than the diameter of the through hole 68 of the sealer 76. With this configuration, as depicted in FIG. 5B, when the valve 77 is located at the first position, the plug 83 is tightly fitted in the through hole 68 of the sealer 76, thereby liquid tightly sealing the through hole 68. Thus, the opening 46B of the cylindrical wall 46 is closed. As depicted in FIG. 6B, when the valve 77 is located at the second position, the plug 83 is located separate from the sealer 76. Therefore, the opening 46B of the cylindrical wall 46 is opened.

The rod 84 has an outside diameter that is smaller than the outside diameter of the plug 83.

The plurality of first protrusions 85 includes four first protrusions 85 that are spaced apart from each other in a circumferential direction of the rod 84. The plurality of second protrusions 86 includes four second protrusions 86 that are spaced apart from each other in the circumferential direction of the rod 84. The plurality of first protrusions 85 is spaced from the plurality of second protrusions 86 in the insertion direction 51 and is disposed adjacent to the plug 83 in the removal direction 52.

The sealing member 78 may be made of an elastic material, for example, rubber. As depicted in FIGS. 5B and 8B, the sealing member 78 includes a circular cylindrical portion 95, a first sealing portion 96, and a second sealing portion 97. The first sealing portion 96 and the second sealing portion 97 may be flanged portions that protrude from respective portions of an outer surface of the cylindrical portion 95 in a diameter direction of the cylindrical portion 95.

The cylindrical portion 95 is disposed between the plurality of first protrusions 85 and the plurality of second protrusions 86 while having the rod 84 of the valve 77 inserted therethrough. The cylindrical portion 95 has an inside diameter that is larger than the outside diameter of the rod 84. Therefore, in a state where the rod 84 penetrates the cylindrical portion 95, clearance is left between the cylindrical portion 95 and the rod 84. An empty space inside the cylindrical portion 95 is exposed through a gap between each adjacent two of the first protrusions 85 and a gap between each adjacent two of the second protrusions 86. With this configuration, the empty space inside the cylindrical portion 95 provides communication therethrough between a space of the valve chamber 47 leading to the opening 46A and another space of the valve chamber 47 leading to the opening 46B.

The cylindrical portion 95 includes one end that is in contact with the plurality of first protrusions 85 and the other end that is in contact with the plurality of second protrusions 86. With this configuration, the sealing member 78 is capable of moving together with the valve 77 within the valve chamber 47 selectively in the insertion direction 51 and in the removal direction 52.

The first sealing portion 96 is spaced from the second sealing portion 97 in the insertion direction 51.

The first sealing portion 96 and the second sealing portion 97 hermetically and closely contact the inner surface of the cylindrical wall 46. In a state where the sealing member 78 is not disposed in the valve chamber 47, an outside diameter of each of the first sealing portion 96 and the second sealing portion 97 is slightly larger than the inside diameter of the cylindrical wall 46. Therefore, in a state where the sealing member 78 is disposed in the valve chamber 47, the first sealing portion 96 and the second sealing portion 97 are in hermetical contact with the inner surface of the cylindrical wall 46 while being elastically deformed in a direction such that the first sealing portion 96 and the second sealing portion 97 decrease their outside diameter. As the valve 77 moves in the insertion-removal direction 5152, the first sealing portion 96 and the second sealing portion 97 slide relative to the inner surface of the cylindrical wall 46.

The coil spring 87 is disposed between the opening 46A and the plurality of second protrusions 86. The coil spring 87 urges the valve 77 in the insertion direction 51. For example, the coil spring 87 urges the valve 77 toward the first position from the second position. Thus, in the valve chamber 47, the valve 77 is retained while being in contact with the sealer 76 (refer to FIG. 5B). In other embodiments, for example, another urging member, e.g., a leaf spring, may be used instead of the coil spring 87. Nevertheless, an urging member such as the coil spring 87 might not necessarily be provided.

[Detector 59]

As depicted in FIGS. 3, 5A, and 5B, the detector 59 is disposed inside the ink chamber 36. The detector 59 is rotatably supported by the frame 31. The detector 59 includes an axial portion 61 that has an axis on which the detector 59 rotates. The axial portion 61 has an circular cylindrical shape. In other embodiments, for example, the axial portion 61 may have a different shape. The axial portion 61 of the detector 59 is engaged with the projection 48 of the frame 31 by insertion. Therefore, the detector 59 is rotatably supported by the frame 31.

As depicted in FIGS. 3, 5A, 5B, and 8A, the ink cartridge 30 includes the detector 59 and a float 63. In the illustrative embodiment, the float 63 constitutes a portion of the detector 59. The detector 59 includes the axial portion 61, a first arm 71, a second arm 72, a third arm 73, a detection portion 62, the float 63, and a restriction portion 64.

The axial portion 61 is spaced from the second inner wall 44 in the insertion direction 51. The first arm 71 extends from the axial portion 61 in one direction with respect to the diameter direction of the axial portion 61. The second arm 72 extends from the axial portion 61 in another direction with respect to the diameter direction of the axial portion 61 so as to extend in a different direction from the direction that the first arm 71 extends. The second arm 72 extends in the removal direction 52 from the axial portion 61 beyond the second inner wall 44 through a recess 45 of the second inner wall 22. The recess 45 is recessed in the leftward direction 56 relative to a right end of the second inner wall 44. The third arm 73 extends from the axial portion 61 in other direction with respect to the diameter direction of the axial portion 61 so as to extend in a different direction from the directions that the first arm 71 and the second arm 72 extend respectively. The third arm 73 is shorter in length than the second arm 72.

The detection portion 62 is disposed at a distal end of the first arm 71 and is supported by the first arm 71. The detection portion 62 has a plate-like shape. The detection portion 62 may be made of material that blocks light outputted from the light emitting portion. The detection portion 62 is supported by the first arm 71 while being spaced from the axis of the detector 59 by a distance L1 (refer to FIG. 5B). In other embodiments, for example, the detection portion 62 may be disposed at another portion of the first arm 71. In one example, the detection portion 62 may be disposed at a middle portion of the first arm 71 between the distal end and a proximal end of the first arm 71.

More specifically, when light outputted from the light emitting portion reaches one of a right surface and a left surface of the detection portion 62, the intensity of light that comes from the other of the right surface and the left surface of the detection portion 62 and reaches the light receiving portion may be less than a predetermined intensity, e.g., zero. For example, the detection portion 62 may completely block light from traveling in the rightward direction 55 or in the leftward direction 56 therefrom, may absorb light partially, may deflect light to change the optical path of light, or may reflect the light completely. In one example, the detection portion 62 may be made of resin containing pigment. In another example, the detection portion 62 may be transparent or translucent and have a prism-like shape for changing the optical path of light. In other example, the detection portion 62 may have a reflecting film, e.g., an aluminum film, on its surface.

The float 63 is disposed at a distal end of the second arm 72 and is supported by the second arm 72. The float 63 may be made of material having a lower specific gravity than ink stored in the ink chamber 36. The float 63 is supported by the second arm 72 while being spaced apart from the axis of the detector 59 by a distance L2 that is shorter than the distance L1 (refer to FIG. 5A). In other embodiments, for example, the float 63 may be disposed at another portion of the second arm 72. In one example, the float 63 may be disposed at a middle portion of the second arm 72 between the distal end and a proximal end of the second arm 72.

The restriction portion 64 is disposed at a distal end of the third arm 73. The restriction portion 64 constitutes a portion of the third arm 73 and includes the distal end of the third arm 73. The restriction portion 64 has a flat surface at the distal end of the third arm 73. The restriction portion 64 is configured to contact and separate from a restriction member 88. In other embodiments, for example, the restriction portion 64 and the third arm 73 may be separate parts. In this case, the restriction portion 64 may be supported by the third arm 73.

The detector 59 is disposed inside the ink chamber 36 while the first arm 71 extends substantially in the upward direction 54, the second arm 72 extends substantially in the removal direction 52, and the third arm 73 extends substantially in the insertion direction 51.

The detector 59 is movable (e.g., rotatable) between a released position (e.g., a position of the detector 59 depicted in FIGS. 7A and 7B) and a released position (e.g., a position of the detector 59 depicted in FIGS. 5A and 5B). The restricted position is a different position from the released position. In a state where the ink cartridge 30 is completely placed in the cartridge holder 110, when the detector 59 is located at the released position, the detection portion 62 is located between the light emitting portion and the light receiving portion of the sensor 103 (refer to FIG. 1). Therefore, light outputted from the light emitting portion is blocked by the detection portion 62, thereby not reaching the light receiving portion. Thus, when the detector 59 is located at the released position, the detection portion 62 is detected by the sensor 103 from the outside of the ink cartridge 30. In the state where the ink cartridge 30 is completely placed in the cartridge holder 110, when the detector 59 is located at a position other than the released position, the detection portion 62 is not located between the light emitting portion and the light receiving portion of the sensor 103. Therefore, light outputted from the light emitting portion reaches the light receiving portion.

[Restriction Member 88]

As depicted in FIGS. 5A and 5B, the restriction member 88 is disposed inside the ink chamber 36. The restriction member 88 is supported by the frame 31 so as to be movable selectively in the insertion direction 51 and in the removal direction 52. As depicted in FIGS. 3, 5A, and 5B, the frame 31 of the ink tank 32 includes guide members 49 at the first inner wall 43. The guide members 49 are spaced from the projection 48 of the first inner wall 43 in the removal direction 52. The guide members 49 are disposed in an area above a portion of the valve 77 disposed inside the ink chamber 36 and below the projection 48. The guide members 49 are spaced apart from each other in the up-down direction 54, 53. The guide members 49 extend in the insertion-removal direction 5152. The restriction member 88 is disposed between the guide members 49 in the up-down direction 54, 53. Thus, the restriction member 88 is supported by the frame 31 so as to be movable selectively in the insertion direction 51 and in the removal direction 52.

As depicted in FIGS. 5A, 5B, and 8, the restriction member 88 includes a first portion 89 and a second portion 90. The second portion 90 includes a projecting portion 91 at a middle portion thereof in the insertion-removal direction 5152. The projecting portion 91 protrudes in the rightward direction 55 therefrom. The projecting portion 91 of the second portion 90 protrudes in the rightward direction 55 relative to the guide members 49. The portion of the second portion 90 other than the projecting portion 91 is disposed between the guide members 49 in the up-down direction 54, 53 and does not protrude in the rightward direction 55 relative to the guide members 49.

The first portion 89 extends in the downward direction 53 from the projecting portion 91 of the second portion 90. The first portion 89 has a through hole 92 defined in its distal end portion. The through hole 92 penetrates the first portion 89 in the insertion-removal direction 5152. The valve 77 includes an engagement projection 77A at the other end that is opposite to the end including the plug 83. The engagement projection 77A of the valve 77 is disposed in the through hole 92 by insertion. The through hole 92 has a diameter that is slightly smaller than a diameter of the engagement projection 77A. Therefore, the engagement projection 77A and the through hole 92 are in engagement with each other, whereby the first portion 89 of the restriction member 88 is engagement with the valve 77. With this configuration, as the valve 77 moves in one of the insertion direction 51 and the removal direction 52, the restriction member 88 moves in the same direction (e.g., selectively in the insertion direction 51 and in the removal direction 52) together with the valve 77.

Figure 6A:
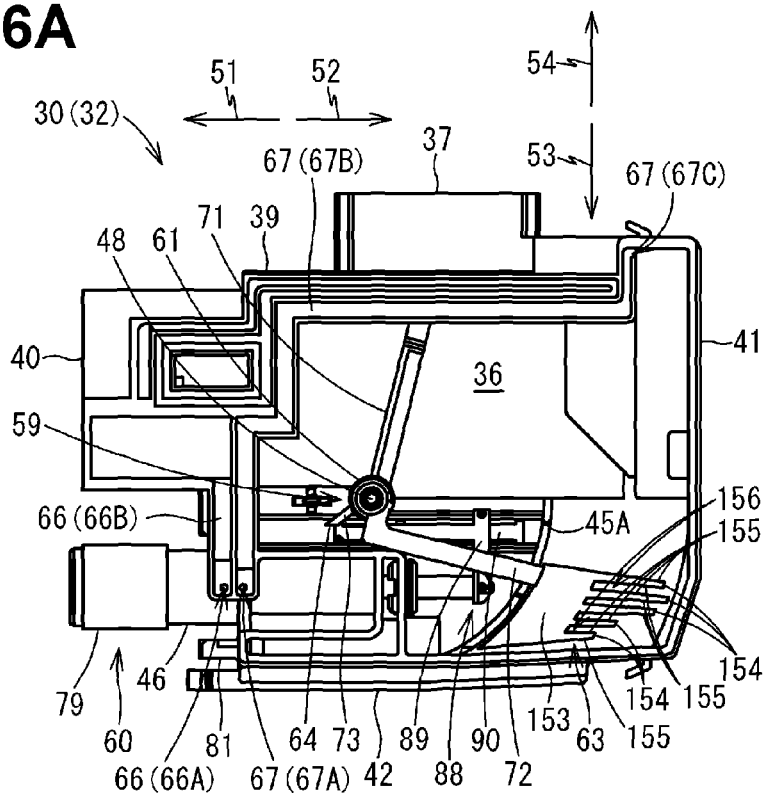
FIG. 6A is a right side view depicting the ink tank in the illustrative embodiment according to one or more aspects of the disclosure, wherein the restriction member is located at a release position and the detector is located at the restricted position.
Figure 6B:
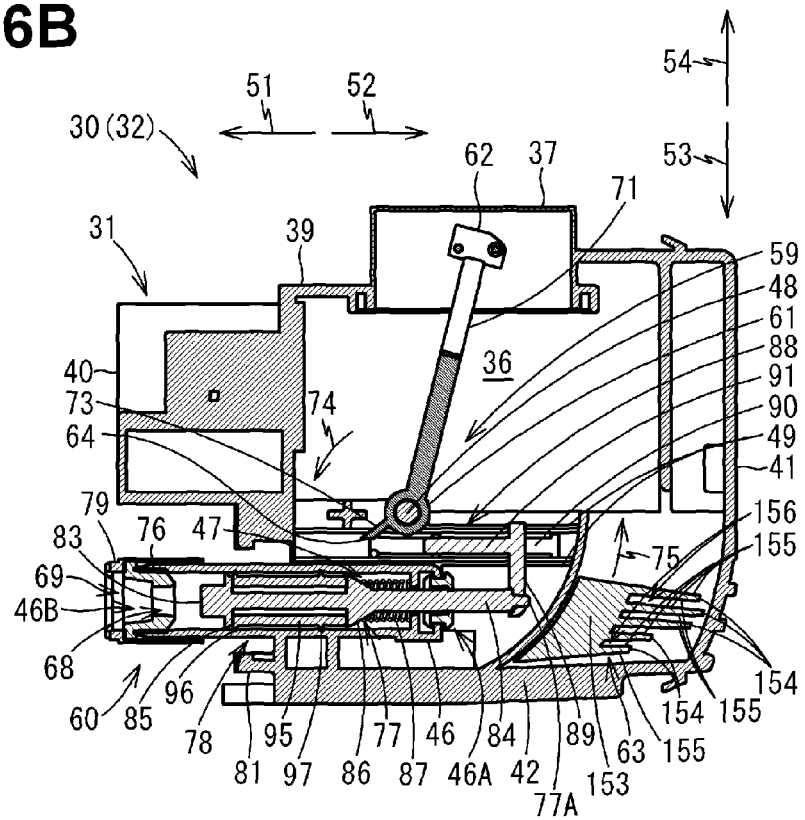
FIG. 6B is a vertical cross-sectional view depicting the ink tank in the illustrative embodiment according to one or more aspects of the disclosure, wherein the restriction member is located at the release position and the detector is located at the restricted position.

The restriction member 88 is movable between a restrict position (e.g., a position of the restriction member 88 depicted in FIGS. 5A and 5B) and a release position (e.g., a position of the restriction member 88 depicted in FIGS. 6A and 6B). The release position is closer to the rear wall 41 than the restrict position. When the valve 77 is located at the first position, the restriction member 88 is located at the restrict position. When the valve 77 is located at the second position, the restriction member 88 is located at the release position. As the valve 77 moves from the first position to the second position, the restriction member 88 moves from the restrict position to the release position. As the valve 77 moves from the second position to the first position, the restriction member 88 moves from the release position to the restrict position.

When the restriction member 88 is located at the restrict position, an upwardly-facing surface of the projecting portion 91 of the second portion 90 of the restriction member 88 is in contact with the restriction portion 64 from below of the restriction portion 64 and exerts an upward force to the restriction portion 64. Thus, the detector 59 is restricted from rotating in a direction of an arrow 74 (refer to FIG. 5B) due to application of the upward urging force by the restriction member 88. That is, the detector 59 is restricted from rotating toward the released position from the restricted position. In the illustrative embodiment, for example, the movement (e.g., rotation) of the detector 59 from the restricted position is restricted while the detector 59 is permitted to move only within backlash or play. The restriction member 88 might not necessarily restrict the movement (e.g., rotation) of the detector 59 in a direction opposite to the direction that the detector 59 moves toward the released position from the restricted position (e.g., in a clockwise direction of FIG. 5B).

When the restriction member 88 is located at the release position, the projecting portion 91 of the second portion 90 of the restriction member 88 is located separate from the restriction portion 64 of the detector 59 in the removal direction 52. Therefore, the detector 59 is permitted to rotate in the direction of the arrow 74. That is, the detector 59 is permitted to rotate from the restricted position to the released position.

[Float 63]

As depicted in FIGS. 3, 8A, 22A, and 22B, the float 63 includes a body 153 and a plurality of fins 154. The body 153 is connected with the distal end of the second arm 72. The plurality of fins 154 extends toward the rear wall 41 from the body 153. The fins 154 each include one end (e.g., a proximal end) connected with the body 153 and the other end that constitutes a distal end. In the illustrative embodiment, the plurality of fins 154 includes five fins 154. Nevertheless, the number of fins 154 is not limited to the specific example. The float 63 further has recesses 156 defined by the fins 154.

The fins 154 each extend in a direction intersecting a direction of an arrow 75 (refer to FIG. 6B), which may be one of a rotating direction of the detector 59 or one of a rotating direction of the float 63. The rotating direction includes the direction of the arrow 75 and its opposite direction. In the illustrative embodiment, in a state where the detector 59 is located at the restricted position, each of the fins 154 extends in the removal direction 52.

The fins 154 are spaced apart from each other in the rotating direction of the detector 59. Each of the fins 154 has surfaces 155 (each of which is an example of a resist surface) on opposite sides thereof. The surfaces 155 of each of the fins 154 extend in a direction intersecting the rotating direction of the detector 59 and are spaced from each other in the rotating direction of the detector 59. That is, the detector 59 has a plurality of surfaces 155. Each of the surfaces 155 faces either one of the direction that the arrow 75 points and its opposite direction. The surfaces 155 facing the direction that the arrow 75 points cause resistance to rotation of the detector 59 from the restricted position to the released position.

The fins 154 extend parallel to each other. The surfaces 155 may be flat surfaces that extend parallel to each other. The fins 154 have respective different lengths in an extending direction of the plurality of fins 154. In the illustrative embodiment, a foremost fin of the plurality of fins 154 in the direction of the arrow 75 with respect to the rotating direction of the float 63 has a surface 155 extending contiguous from the top of the body 153. A fin 154 next to the foremost fin 154 (e.g., a second foremost fin 154) in the direction of the arrow 75 with respect to the rotating direction of the float 63 has a longest length in the extending direction among the plurality of fins 154. A rearmost fin 154 of the plurality of fins 154 in the direction of the arrow 75 with respect to the rotating direction of the float 63 has a shortest length in the extending direction among the plurality of fins 154. All of the fins 154 have the same dimension in the right-left direction 5556 orthogonal to the extending direction. Therefore, areas (or sizes) of the surfaces 155 of the fins 154 are different from each other.

In other embodiments, for example, the fins 154 might not necessarily extend parallel to each other. The surfaces 155 might not also necessarily extend parallel to each other, nor might not be flat surfaces. All of the fins 154 may have the same length in the extending direction. The fins 154 may have respective different lengths in the right-left direction 5556. The areas (or sizes) of all of the surfaces 155 may be equal to each other.

The facing surfaces 155 of each adjacent two of the plurality of fins 154 define a recess 156 (as an example of a communication opening) therebetween. The recess 156 is open in a plurality of directions relative to the ink chamber 36. The recess 156 is in communication with the ink chamber 156 through the open ends of the recess 156. In the illustrative embodiment, the recess 156 is open at one end that faces the direction toward which the ink cartridge 30 is removed, and right and left ends that are opposite to each other. In other words, the recess 156 is open at the one end that faces the direction opposite to the axis of the detector 59, and right and left ends that are opposite to each other. A size of each recess 156 depends on the length of each of the fins 54 and a distance between adjacent fins 154. It is preferable that each recess 156 may have a dimension in the rotating direction (e.g., the distance between adjacent fins 154) that is shorter than a dimension in the removal-insertion direction 5152 (e.g., the length of a fin 154).

The body 153 also defines the other end of each of the recesses 156 that faces the direction toward which the ink cartridge 30 is inserted. In other words, the body 153 defines the other end of each of the recesses 156 that faces toward the axis of the detector 59. Thus, the other end of each of the recesses 156 that faces the direction toward which the ink cartridge 30 is inserted is closed.

[Controller 130]

Figure 4:
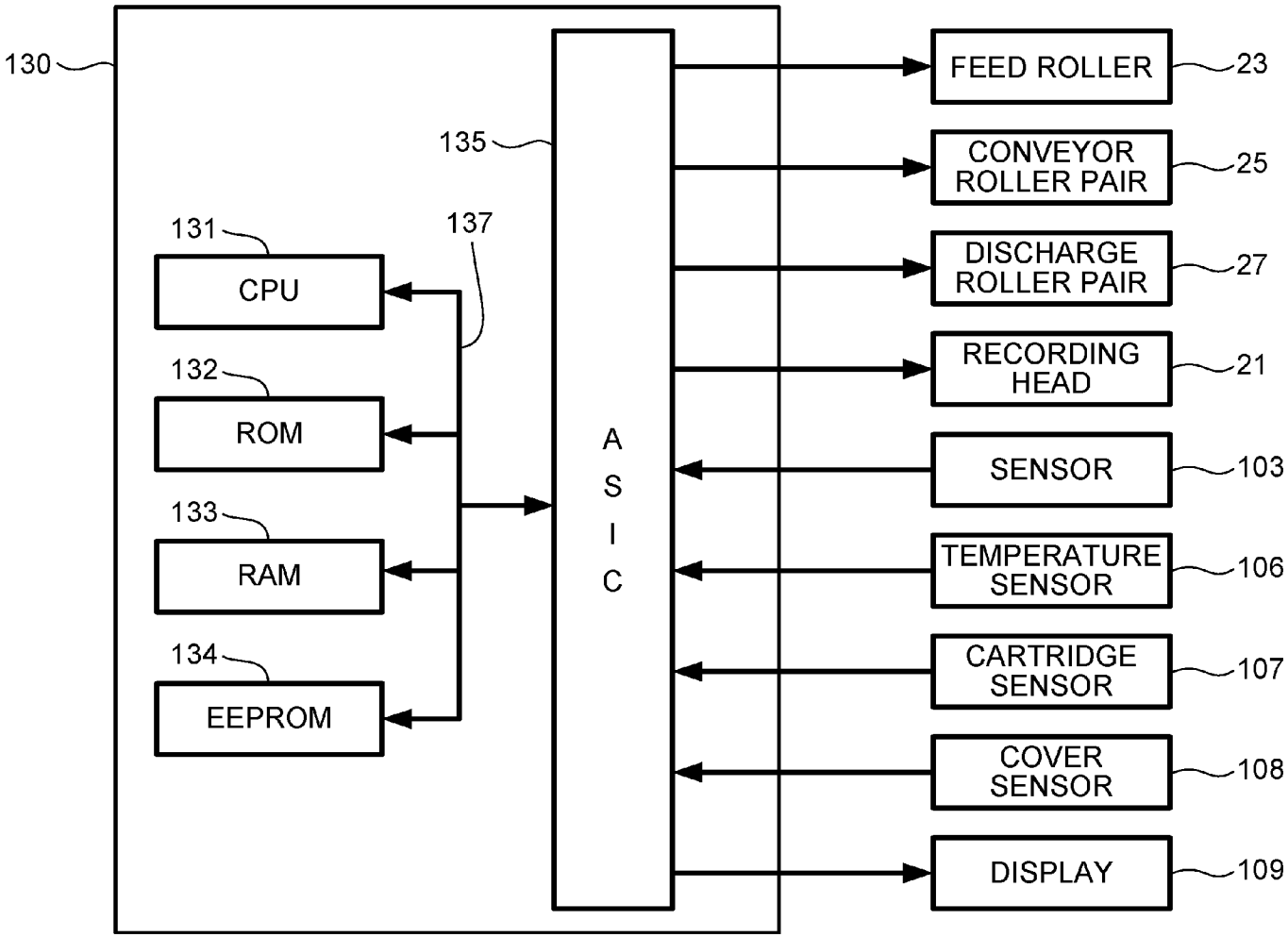
FIG. 4 is a functional block diagram of the printer in the illustrative embodiment according to one or more aspects of the disclosure.

The printer 10 includes a controller 130. As depicted in FIG. 4, the controller 130 includes a central processing unit ("CPU") 131, a read-only memory ("ROM") 132, a random-access memory ("RAM") 133, an electrically erasable programmable ROM ("EEPROM") 134, and an application-specific integrated circuit ("ASIC") 135, which are connected with each other via an internal bus 137. The ROM 132 stores various programs to be used by the CPU 131 for controlling various operations or processing. The RAM 133 is used as a storage area for temporarily storing data and/or signals to be used by the CPU 131 during execution of the programs by the CPU 131 or a workspace for processing data. The EEPROM 134 stores settings and flags that need to be maintained after the power of the printer 10 is turned off. The CPU 131, the ROM 132, the RAM 133, the EEPROM 134, and the ASIC 135 may be all included in a single chip or may be included in a plurality of chips separately.

The controller 130 drives a motor (not depicted) to rotate the feed roller 23, the conveyor roller pair 25, and the discharge roller pair 27. The controller 130 controls the recording head 21 to cause the nozzles 29 to eject ink therefrom. For example, the controller 130 outputs a control signal to the head control board 21A. The control signal indicates a level of a drive voltage to be applied to the piezoelectric elements 29A. The head control board 21A applies a drive voltage specified by the control signal obtained from the controller 130 to the piezoelectric elements 29A provided for the respective nozzles 29, thereby causing the nozzles 29 to eject ink therefrom. The controller 130 controls a display 109 to display information of the printer 10 and one or more ink cartridges 30, and various messages thereon.

The controller 130 receives various signals: a detection signal outputted from the sensor 103, a detection signal outputted from the cartridge sensor 107, a signal outputted from a temperature sensor 106, and a signal outputted from a cover sensor 108. The temperature sensor 106 is configured to output a signal in accordance with the temperature. A measuring point where the temperature sensor 106 measures the temperature is not limited to a particular point. For example, the temperature sensor 106 may measure the temperature at any point inside the cartridge holder 110 or at any point of the exterior of the printer 10. The cover sensor 108 is configured to output different signals according to whether the cover closes or exposes the opening 112 of the cartridge holder 110.

[Placement/Removal of Ink Cartridge 30 to/from Cartridge Holder 110]

Hereinafter, a description will be provided on how the valve 77, the restriction member 88, and the detector 59 behave in a process of placing the ink cartridge 30 to the cartridge holder 110. In the description below, it is assumed that an amount of ink remaining in the ink chamber 36 is more than the amount of ink remaining in the ink chamber 36 in a near-empty state.

In a state where the ink cartridge 30 is not placed in the cartridge holder 110, the valve 77 is located at the first position due to the urging force of the coil spring 87 as depicted in FIGS. 5A and 5B.

When the valve 77 is located at the first position, the valve 77 is in contact with the sealer 76 by the urging force of the coil spring 87. In this state, the plug 83 is in tight contact with the edge of the through hole 68 of the sealer 76. Thus, the through hole 68 is closed, whereby ink is not allowed to flow to the outside of the ink cartridge 30 from the ink chamber 36.

When the valve 77 is located at the first position, the hole 66A is located between the first sealing portion 96 and the second sealing portion 97. Therefore, the second sealing portion 97 blocks the communication between the first air communication passage 66 and the second air communication passage 67. Thus, the ink chamber 36 is maintained at a negative pressure.

When the valve 77 is located at the first position, the restriction member 88 is located at the restrict position. When the restriction member 88 is located at the restrict position, the detector 59 is located at the restricted position. Due to buoyant force of the float 63, a force that tends to rotate the detector 59 in the direction of the arrow 74 acts on the detector 59. Thus, a force that tends to move the restriction portion 64 in the downward direction 53 acts on the restriction portion 64. In this state, the projecting portion 91 of the restriction member 88 is in contact with the restriction portion 64 of the detector 59 from below the restriction portion 64. Thus, when the restriction member 88 is located at the restrict position, the restriction member 88 applies, to the restriction portion 64, an external force that acts in a direction opposite to the direction of the arrow 74, which may be the rotating direction of the detector 59 toward the released position. In other words, when the restriction member 88 is located at the release position, the restriction portion 64 is located within a movable range of the restriction member 88. When the restriction member 88 is located at the restrict position, the restriction member 88 is positioned on a moving route of the restriction portion 64. Therefore, the restriction portion 64 is not permitted to move into the inside of the movable range of the restriction member 88. Accordingly, the detector 59 is restricted from rotating from the restricted position.

In the illustrative embodiment, the restriction member 88 comes into contact with the restriction portion 64 from below to restrict the detector 59 from moving to the released position. Nevertheless, in other embodiments, for example, the projecting portion 91 of the restriction member 88 may come into contact with the restriction portion 64 by moving in the removal direction 52, to restrict the detector 59 from rotating from the restricted position.

When the detector 59 is located at the restricted position, the float 63 is located near the lower wall 42. That is, the float 63 is submerged in ink stored in the ink chamber 36.

When the detector 59 is located at the restricted position, the detection portion 62 is not located between the light emitting portion and the light receiving portion of the sensor 103. Therefore, light outputted from the light emitting portion is allowed to reach the light receiving portion. Thus, when the detector 59 is located at the restricted position, the sensor 103 outputs a high-level signal to the controller 130.

While the ink cartridge 30 is not placed at a particular position in the cartridge holder 110, a corresponding cartridge sensor 107 is free from pressure of the front end 58 of the cartridge cover 33 of the ink cartridge 30. Therefore, the cartridge sensor 107 outputs a low-level signal to the controller 130.

In this state, the cover of the cartridge holder 110 is opened and then the ink cartridge 30 is inserted into the cartridge holder 110. That is, the ink cartridge 30 is placed at the particular portion in the cartridge holder 110. In other words, the ink cartridge 30 becomes in the use position.

When the ink cartridge 30 reaches a vicinity of the inner back surface 151 of the cartridge holder 110 by its movement in the insertion direction 51, the front end 58 of the cartridge cover 33 of the ink cartridge 30 presses the corresponding cartridge sensor 107 facing thereto. In response to this, the cartridge sensor 107 outputs a high-level signal to the controller 130. Thus, counting for measuring a moving time of the detector 59 is started.

When the ink cartridge 30 reaches a vicinity of the inner back surface 151 of the cartridge holder 110 by its movement in the insertion direction 51, the plug 83 of the valve 77 comes into contact with a corresponding ink needle 102. In this state, as the ink cartridge 30 further moves in the insertion direction 51, the valve 77 is pressed by a reaction force from the ink needle 102. Thus, the valve 77 moves in the removal direction 52 from the first position to the second position against the urging force of the coil spring 87.

As depicted in FIGS. 6A and 6B, when the valve 77 is located at the second position, the valve 77 is located separate from the sealer 76 and thus the through hole 68 is opened. Therefore, ink is allowed to flow from the ink chamber 36 to the outside of the ink cartridge 30.

When the valve 77 is located at the second position, both of the holes 66A and 67A are located between the first sealing portion 96 and the second sealing portion 97. Thus, the first air communication passage 66 and the second air communication passage 67 are in communication with each other. Accordingly, the ink chamber 36 comes into communication with the outside air, whereby the inside pressure of the ink chamber 36 changes from a negative pressure to the atmospheric pressure.

As the valve 77 moves in the removal direction 52 from the first position to the second position, the restriction member 88 moves in the removal direction 52 together with the valve 77. For example, the restriction member 88 moves from the restrict position to the release position, whereby the projecting portion 91 of the restriction member 88 separates from the restriction portion 64 of the detector 59. Thus, the detector 59 becomes free to rotate from the restricted position.

As the detector 59 becomes free to rotate, the detector 59 rotates in the direction of the arrow 75 (e.g., a direction that the float 63, which has been kept submerged in ink, comes up by its buoyant force). That is, the detector 59 rotates from the restricted position to the released position by the float 63 that moves upward in response to the movement of the restriction member 88 to the release position while the ink cartridge 30 is in the use position (e.g., while the ink cartridge 30 is completely placed in the cartridge holder 110).

When the detector 59 is located at the released position, the restriction portion 64 is located within the movable range of the restriction member 88.

The float 63 keeps moving in the direction of the arrow 75 until the second arm 72 comes into contact with a surface 45A (refer to FIGS. 3 and 6A) that defines a portion of the recess 45 of the second inner wall 44. At the time the second arm 72 comes into contact with the surface 45A, the detector 59 is located at the released position as depicted in FIGS. 7A and 7B.

When the detector 59 is located at the released position, the detection portion 62 is located between the light emitting portion and the light receiving portion of the sensor 103, thereby blocking light outputted from the light emitting portion from reaching the light receiving portion. Thus, when the detector 59 is located at the released position, the sensor 103 outputs a low-level signal to the controller 130. For example, the sensor 103 outputs a low-level signal (as an example of a detection signal) indicating the presence of the detector 59 at the released position. Thus, the counting for measuring the moving time of the detector 59 is ended. Through this process, the ink cartridge 30 is completely placed in the cartridge holder 110.

Hereinafter, a description will be provided on how the valve 77, the restriction member 88, and the detector 59 behave in a process of removing the ink cartridge 30 from the cartridge holder 110. In the description below, it is assumed that the amount of ink remaining in the ink chamber 36 is more than the amount of ink remaining in the ink chamber 36 in the near-empty state.

Figure 7A:
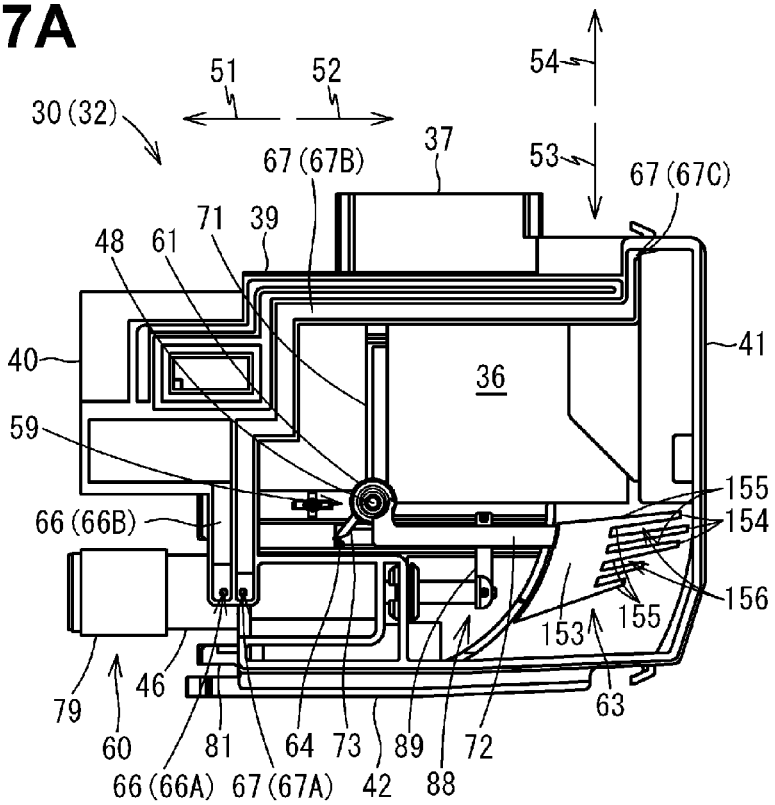
FIG. 7A is a right side view depicting the ink tank in the illustrative embodiment according to one or more aspects of the disclosure, wherein the restriction member is located at the release position and the detector is located at a released position.
Figure 7B:
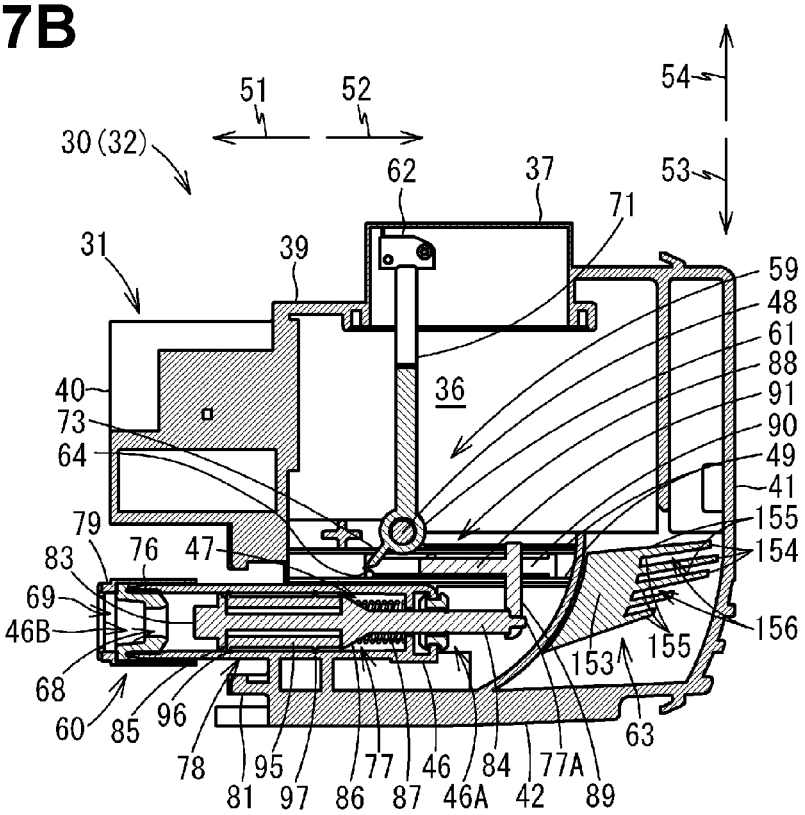
FIG. 7B is a vertical cross-sectional view depicting the ink tank in the illustrative embodiment according to one or more aspects of the disclosure, wherein the restriction member is located at the release position and the detector is located at the released position.

As depicted in FIGS. 7A and 7B, in a state where the ink cartridge 30 is completely placed in the cartridge holder 110, the valve 77 is located at the second position by the pressing force of the corresponding ink needle 102. When the valve 77 is located at the second position, the restriction member 88 is located at the release position. When the restriction member 88 is located at the release position, the detector 59 is permitted to rotate. In this state, the detector 59 is located at the released position by the buoyant force of the float 63.

As the ink cartridge 30 moves in the removal direction 52 for removing the ink cartridge 30 from the cartridge holder 110, the valve 77 separates from the ink needle 102, whereby the valve 77 moves from the second position to the first position by the urging force of the coil spring 87. As the valve 77 moves from the second position to the first position, the restriction member 88 moves together with the valve 77 from the release position to the restrict position. While the restriction member 88 moves from the release position to the restrict position, the projecting portion 91 of the restriction member 88 comes into contact with the restriction portion 64 of the detector 59 that is located at the released position within the movable range of the restriction member 88. For example, a surface that extends intersecting the surface of the restriction portion 64 that is in contact with the projecting portion 91 of the restriction member 88 at the restrict position comes into contact with the surface of the restriction member 88 facing the direction toward which the ink cartridge 30 is inserted, whereby the restriction portion 64 is pressed toward the restricted position from the released position by the projecting portion 91. Thus, the detector 59 rotates in the direction opposite to the direction of the arrow 74 (refer to FIG. 5B). For example, the detector 59 rotates from the released position to the restricted position. In other words, the restriction member 88 allows the detector 59 to rotate to the restricted position while the restriction member 88 moves from the release position to the restrict position.

Hereinafter, a description will be provided on how the valve 77, the restriction member 88, and the detector 59 behave as the amount of ink remaining in the ink chamber 36 decreases due to consumption of ink in the recording head 21 after the ink cartridge 30 is completely placed in the cartridge holder 110.

Ink stored in the ink chamber 36 decreases due to consumption of ink by ink ejection from the nozzles 29 of the recording head 21 and thus the ink level becomes lower than a portion of the float 63. In a state where the ink level is lower than the portion of the float 63, the float 63 moves downward with the ink level lowering. In accordance with the downward movement of the float 63, the detector 59 rotates in the direction reverse to the direction of the arrow 74 (refer to FIG. 5B). That is, the detector 59 rotates from the released position to the restricted position, whereby the detection portion 62 is not located between the light emitting portion and the light receiving portion of the sensor 103. Thus, light outputted from the light emitting portion is allowed to reach the light receiving portion. In response to receipt of the light, the sensor 103 outputs a high-level signal to the controller 130. Upon receipt of the high-level signal outputted from the sensor 103, the controller 130 determines that the amount of ink remaining in the ink chamber 36 becomes a predetermined amount.

[Ink Viscosity Abnormality Determination by Controller 130]

The controller 130 executes processing for determining whether an abnormality is present or absence in viscosity of ink stored in the ink chamber 36 of the ink cartridge 30. Referring to flowcharts of FIGS. 9, 10, and 11, the ink viscosity abnormality determination processing will be described.

When the controller 130 determines that the detection signal outputted from the cartridge sensor 107 has been changed from a low-level signal to a high-level signal (e.g., YES in step S11), the controller 130 starts counting to measure a moving time of the detector 59 (e.g., step S12). The controller 130 refers to the detection signal at predetermined intervals. When the controller 130 determines that the level of the detection signal referred at a particular timing is different from the level of the detection signal referred last time, the controller 130 determines that the detection signal outputted from the cartridge sensor 107 has been changed. When the controller 130 determines that the detection signal outputted from the cartridge sensor 107 has not been changed from a low-level signal to a high-level signal (e.g., NO in step S11), the controller 130 executes processing of step S20. For example, when a new ink cartridge 30 is not placed in the cartridge holder 110, the controller 130 determines that the detection signal outputted from the cartridge sensor 107 has been changed from a low-level signal to a high-level signal (e.g., NO in step S11).

Subsequent to step S12, the controller 130 determines whether the time elapsed since the measurement of the moving time was started exceeds a predetermined maximum time (e.g., step S13). When the controller 130 determines that the elapsed time already exceeds the predetermined maximum time (e.g., YES in step S13), the controller 130 executes processing of step S15. For example, when the viscosity of ink stored in the ink chamber 36 is relatively extremely high, the controller 130 determines that the elapsed time already exceeds the predetermined maximum time (e.g., YES in step S13) before the controller 130 determines that the detection signal outputted from the sensor 103 has been changed from a high-level signal to a low-level signal.

When the controller 130 determines that the elapsed time does not exceed the predetermined maximum time (e.g., NO in step S13), the controller 130 determines whether the detection signal outputted from the sensor 103 has been changed from a high-level signal to a low-level signal (e.g., step S14). When the controller 130 determines that the detection signal outputted from the sensor 103 has not been changed from a high-level signal to a low-level signal (e.g., NO in step S14), the controller 130 executes the processing of step S13 again. When the controller 130 determines that the detection signal outputted from the sensor 103 has been changed from a high-level signal to a low-level signal (e.g., YES in step S14), the controller 130 ends counting to measure the moving time of the detector 59 and determines the moving time of the detector 59 (e.g., step S15). When the controller 130 determines that the elapsed time already exceeds the predetermined maximum time (e.g., YES in step S13), the controller 130 determines the predetermined maximum time as the moving time of the detector 59.

The moving time may be a time period elapsed until the detection signal outputted from the sensor 103 becomes a low-level signal from a high-level signal from the timing at which the detection signal outputted from the cartridge sensor 107 becomes a high-level signal from a low-level signal (e.g., YES in step S11).

More strictly, the switching of the detection signal outputted from the cartridge sensor 107 from a low-level signal to a high-level signal might not occur at the same time as when the detector 59 becomes capable of rotating from the restricted position to the released position due to disengagement from the restriction member 88. Nevertheless, the switching of the detection signal outputted from the cartridge sensor 107 from a low-level signal to a high-level signal occurs close to the release of the detector 59. Therefore, the timing at which the detector 59 becomes capable of rotating from the restricted position to the released position may be considered as the timing at which the detection signal outputted from the cartridge sensor 107 is changed from a low-level signal to a high-level signal. Thus, the controller 130 counts to measure a time elapsed until the controller 130 receives a low-level signal from the sensor 103 after the controller 130 receives a high-level signal from the cartridge sensor 107, and considers the measured time as the moving time of the detector 59, i.e., the time required for the movement of the detector 59 from the restricted position to the released position.

Subsequent to step S15, the controller 130 resets an abnormal flag (e.g., the controller 130 sets the abnormal flag to "OFF") (e.g., step S16). The abnormal flag is set to "ON" when the moving time is not included within a threshold range (e.g., NO in step S18) as a result of the determination as to whether the moving time is included within the threshold range (e.g., step S18). The abnormal flag may be a value assigned on a basis of ink cartridge 30. The controller 130 stores the abnormal flag for each ink cartridge 30 in the EEPROM 134.

Subsequent to step S16, the controller 130 determines a threshold range based on the signal outputted from the temperature sensor 106 (e.g., step S17). The threshold range is used for comparison with the moving time measured in step S15 in order to estimate the viscosity of ink stored in the ink chamber 36. The controller 130 assigns a lower value to at least one of an upper limit and a lower limit of the threshold range when the temperature specified by the signal outputted from the temperature sensor 106 indicates a higher temperature. In other words, the controller 130 assigns a higher value to at least one of the upper limit and the lower limit of the threshold range when the temperature specified by the signal received from the temperature sensor 106 indicates a lower temperature.

Subsequent to step 17, the controller 130 determines whether the moving time measured in step S15 is included within the threshold range determined in step S17 (e.g., step S18). When the moving time is below the lower limit of the threshold range, it is estimated that the ink viscosity is lower than a normal ink viscosity. When the moving time is above the upper limit of the threshold range, it is estimated that the ink viscosity is higher than the normal ink viscosity. When the controller 130 determines that the moving time is out of the threshold range (e.g., NO in step S18), the controller 130 sets the abnormal flag to "ON" (e.g., step S19). When the controller 130 determines that the moving time is included within the threshold range (e.g., YES in step S18), the routine skips the processing of step S19.

The controller 130 determines whether a signal that indicates closing of the cover of the cartridge holder 11 is outputted from the cover sensor 108 (e.g., step S20). When the controller 130 determines that the cover is opened (e.g., NO in step S20), the controller 130 executes the processing of step S11 and subsequent steps again. When the controller 130 determines that the cover is closed (e.g., YES in step S20), the controller 130 determines whether a predetermined time has elapsed since the controller 130 determined, in step S20, that the cover is closed (e.g., step S21).

Figure 9:
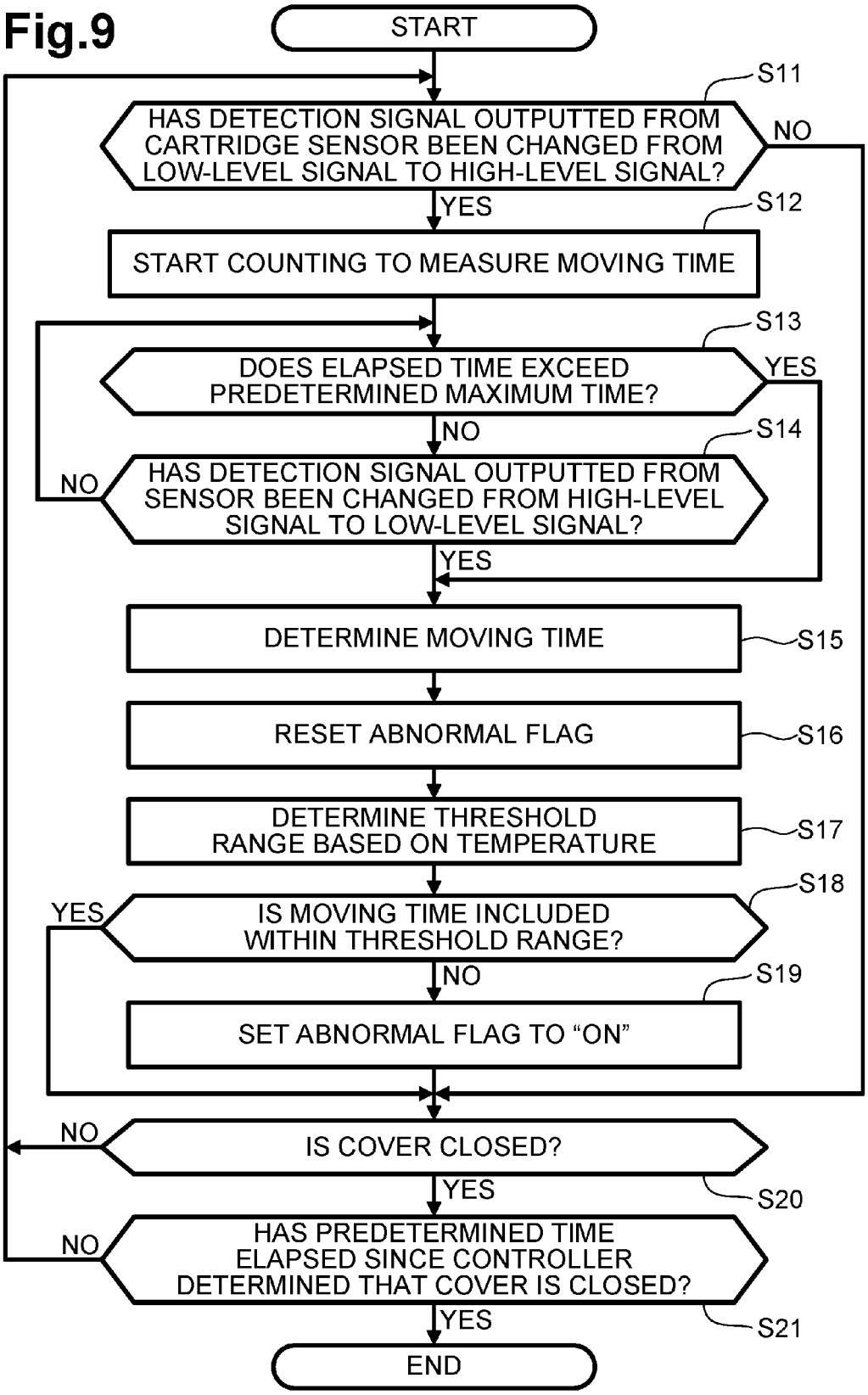
FIG. 9 is a flowchart depicting example processing executed by a controller for determining whether abnormality occurs in viscosity of ink stored in an ink chamber of the ink tank in the illustrative embodiment according to one or more aspects of the disclosure.

When the controller 130 determines that the predetermined time has already elapsed (e.g., YES in step S21), the controller 130 ends the ink viscosity abnormality determination process of FIG. 9. When the controller 130 determines that the predetermined time has not elapsed yet (e.g., NO in step S21), the controller 130 executes the processing of step S11 and subsequent steps. When the controller 130 determines that the cover is opened (e.g., NO in step S20) in the process of looping the processing of step S11 and subsequent steps, the controller 130 ends counting to measure the elapsed time at the time of determining that the cover is closed (e.g., YES in step S20).

Figure 10:
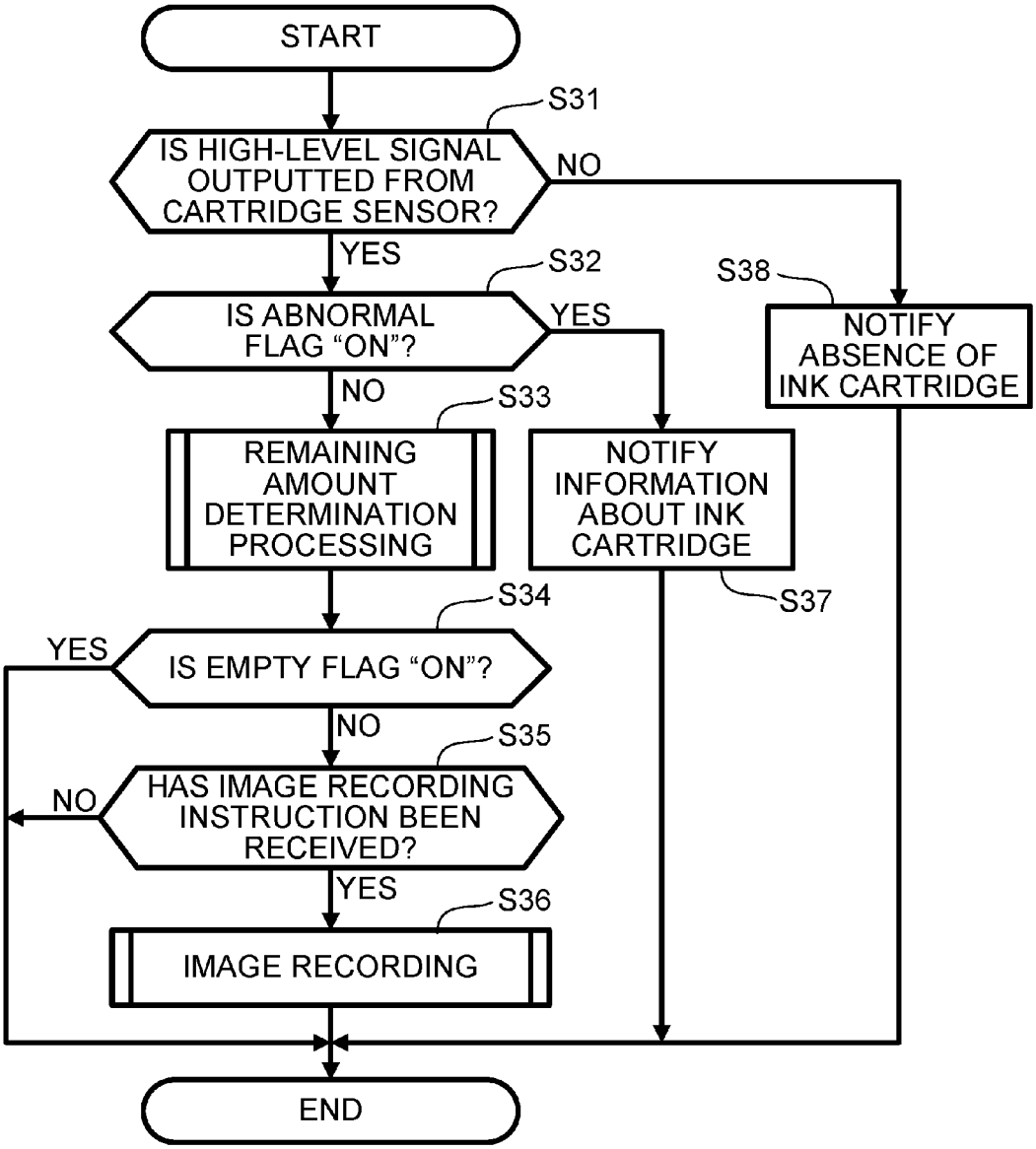
FIG. 10 is a flowchart depicting example processing executed by the controller on conditions that the determination processing in FIG. 9 has been ended and a cover of the cartridge holder is closed in the illustrative embodiment according to one or more aspects of the disclosure.

Subsequent to the ink viscosity abnormality determination processing of FIG. 9, the controller 130 repeatedly executes processing of FIG. 10 at predetermined intervals on condition that the signal that indicates closing of the cover of the cartridge holder 11 is outputted from the cover sensor 108.

The controller 130 determines whether the detection signal outputted from the cartridge sensor 107 is a high-level signal (e.g., step S31). When the controller 130 determines that the detection signal outputted from the cartridge sensor 107 is a low-level signal (e.g., NO in step S31), the controller 130 notifies the absence of an ink cartridge 30 (e.g., step S38) and ends the processing of FIG. 10. For example, the notification may be implemented by displaying a message on the display 109 of the printer 10 or outputting voice guidance from a speaker (not depicted).

When the controller 130 determines that the detection signal outputted from the cartridge sensor 107 is a high-level signal (e.g., YES in step S31), the controller 130 determines whether the abnormal flag is "ON" (e.g., step S32). When the controller 130 determines that the abnormal flag is "ON" (e.g., YES in step S32), the controller 130 notifies information about the ink cartridge 30 (e.g., step S37) and ends the processing of FIG. 10. For example, a deterioration of ink stored in the ink chamber 36 or recommendation of replacement of the ink cartridge 30 may be notified. The notification may be implemented in the same or similar manner to the notification performed in step S38.

Figure 11:
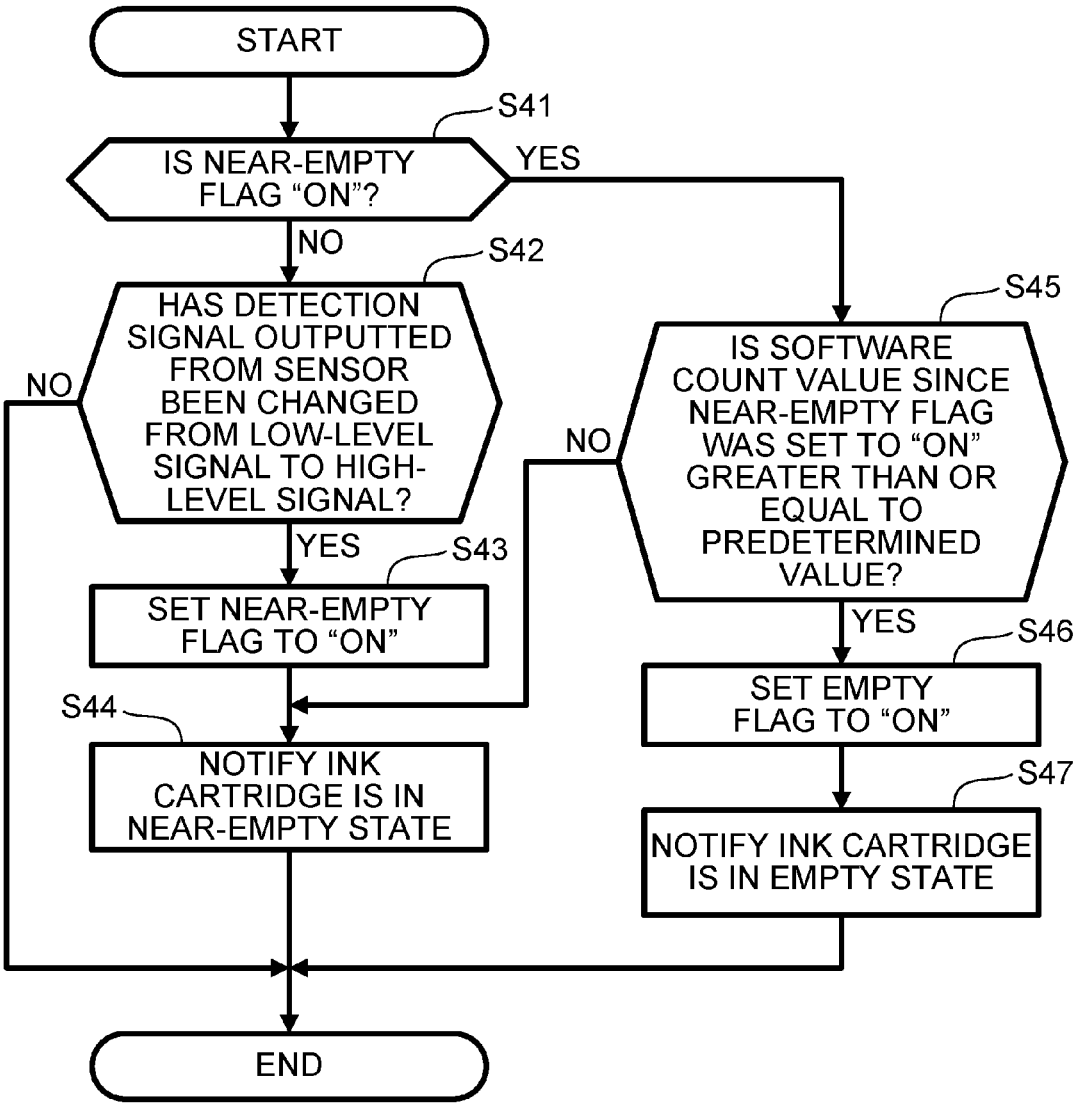
FIG. 11 is a flowchart depicting example processing executed by the controller for determining an amount of ink remaining in the ink chamber in the illustrative embodiment according to one or more aspects of the disclosure.

When the controller 130 determines that the abnormal flag is "OFF" (e.g., NO in step S32), the controller 130 executes remaining amount determination processing of FIG. 11 (e.g., step S33). Subsequent to the remaining amount determination processing, the controller 130 determines whether an empty flag is "ON" (e.g., step S34). The empty flag may be set to "ON" when the controller 130 determines that the amount of ink remaining in the ink chamber 36 is not enough to perform image recording.

When the controller 130 determines that the empty flag is "ON" (e.g., YES in step S34), the controller 130 ends the processing of FIG. 10. When the controller 130 determines that the empty flag is not "ON" (e.g., NO in step S34), the controller 130 determines whether an image recording instruction has been received (e.g., step S35). When the controller 130 determines that an image recording instruction has not been received (e.g., NO in step S35), the controller 130 ends the processing of FIG. 10. When the controller 130 determines that an image recording instruction has been received (e.g., YES in step S35), the controller 130 controls the recording head 21, the feed roller 23, the conveyor roller pair 25, the discharge roller pair 27 directly or indirectly to record an image onto a recording sheet (e.g., step S36) and then ends the processing of FIG. 10. The processing of step S36 may end upon completion of image recording for a single recording sheet or upon completion of image recording of all obtained image data.

As described above, when the controller 130 determines that the abnormal flag is "ON" (e.g., YES in step S32), the controller 130 does not execute image recording of step S36. That is, the routine skips step S36. In other words, the controller 130 does not permit the recording head 21 to eject ink therefrom.

Hereinafter, the remaining amount determination processing will be described referring to FIG. 11. The controller 130 determines whether a near-empty flag is "ON" (e.g., step S41). The near-empty flag may be set to "ON" when the controller 130 determines that the amount of ink remaining in the ink chamber 36 is relatively low although enough to perform image recording. That is, the amount of ink remaining in the ink chamber 36 when the near-empty flag is "ON" is more than the amount of ink remaining in the ink chamber 36 when the empty flag is "ON".

When the controller 130 determines that the near-empty flag is not "ON" (e.g., NO in step S41), the controller 130 determines whether the detection signal outputted from the sensor 103 has been changed from a low-level signal to a high-level signal (e.g., step S42). When the controller 130 determines that the detection signal outputted from the sensor 103 has not been changed (e.g., NO in step S42), the controller 130 ends the remaining amount determination processing and executes the processing of step S34 of FIG. 10. When the controller 130 determines that the detection signal outputted from the sensor 103 has been changed from a low-level signal to a high-level signal (e.g., YES in step S42), the controller 130 sets the near-empty flag to "ON" (e.g., step S43). Subsequently, the controller 130 notifies that the ink cartridge 30 is in a near-empty state (e.g., step S44) and ends the remaining amount determination processing of FIG. 11. Subsequent to this, the controller 130 executes the processing of step S34 of FIG. 10. The near-empty state refers to a state of the ink chamber 36 when the amount of ink remaining in the ink chamber 36 is relatively low although enough to perform image recording.

In step S41, when the controller 130 determines that the near-empty flag is "ON" (e.g., YES in step S41), the controller 130 determines whether a software count value since the near-empty flag was set to "ON" is greater than or equal to a predetermined value (e.g., step S45). The software count value may be obtained based on data provided when the controller 130 provides an ink ejection instruction to the recording head 21. More specifically, the software count value may be obtained by accumulative count of a multiplication value of the number of ink droplets that the controller 130 orders the recording head 21 ejecting therefrom and an amount of ink of each ink droplet specified by the controller 130. The predetermined value may be used for comparison with the software count value.

When the controller 130 determines that the software count value since the near-empty flag was set to "ON" is smaller than the predetermined value (e.g., NO in step S45), that is, when the controller 130 determines that the amount of ink consumed by the recording head 21 since the near-empty flag was set to "ON" is less than the predetermined value (e.g., NO in step S45), the controller 130 executes the processing of step S44.

When the controller 130 determines that the software count value since the near-empty flag was set to "ON" is greater than or equal to the predetermined value (e.g., YES in step S45), that is, when the controller 130 determines that the amount of ink consumed by the recording head 21 since the near-empty flag was set to "ON" is greater than or equal to the predetermined value (e.g., YES in step S45), the controller 130 sets the empty flag to "ON" (e.g., step S46). Subsequently, the controller 130 notifies that the ink cartridge 30 is in an empty state (e.g., step S47) and ends the remaining amount determination processing of FIG. 11. Subsequent to this, the controller 130 executes the processing of step S34 of FIG. 10. The empty state refers to a state of the ink chamber 36 when there is not enough amount of ink remaining in the ink chamber 36 for performing image recording.

In steps S44 and S47, in one example, the notification may be implemented by, for example, displaying a message on the display 109 of the printer 10 or outputting voice guidance from the speaker (not depicted).

[Effects Obtained by Illustrative Embodiment]

According to the illustrative embodiment, as the restriction member 88 moves from the restrict position to the release position, the detector 59 moves from the restricted position to the released position. The detector 59 moves through ink while receiving viscous and inertial resistance from ink, whereby the moving speed of the detector 59 depends on the ink viscosity. Therefore, the viscosity of ink stored in the ink cartridge 30 may be estimated through the measurement of the time elapsed from the timing at which the restriction member 88 reaches the release position to the timing at which the detector 59 reaches the released position. While the detector 59 moves through ink, the surfaces 155 receive resistance from ink that flows into the recesses 156. Thus, the moving time of the detector 59 elapsed until the detector 59 reaches the released position from the restricted position may become longer, thereby improving accuracy of the ink viscosity estimation.

This configuration may enable, for example, to estimate a deterioration level of ink stored in an ink cartridge 30 left not attached to the printer 10 for a while. In a case where the cartridge holder 11 is capable of accommodating various types of ink cartridges 30 having respective different viscosity, this configuration may enable to specify a type of each of the ink cartridges 30.

According to the illustrative embodiment, each of the recesses 156 is open at opposite ends. Therefore, the amount of ink flows into and out from each of the recesses 156 increases and thus the resistance to the movement of the detector 59 increases. Accordingly, the moving time of the detector 59 elapsed while the detector 59 moves from the restricted position to the released position becomes further longer, thereby further improving the accuracy of the ink viscosity estimation.

According to the illustrative embodiment, each of the recesses 156 is open at the one end that faces the direction opposite to the axis of the detector 59. That is, each of the recesses 156 is open toward a direction that ink moves due to centrifugal force caused when the detector 59 rotates. Therefore, the amount of ink flows into and out from each of the recesses 156 increases and thus the resistance to the movement of the detector 59 increases. Accordingly, the moving time of the detector 59 elapsed while the detector 59 moves from the restricted position to the released position becomes further longer, thereby further improving the accuracy of the ink viscosity estimation.

[First Variation]

In the illustrative embodiment, the detector 59 is configured to move between the released position and the restricted position by its rotation. Nevertheless, in other embodiments, for example, the detector 59 may be configured to move between the released position and the restricted position in another manner.

For example, a detector 59 moves selectively in the downward direction 53 and in the upward direction 54. Hereinafter, a first variation in which a detector 59 is capable of moving up and down will be described in detail. Common parts have the same reference numerals as those of the above-described illustrative embodiment, and the detailed description of the common parts will be omitted.

Figure 12A:
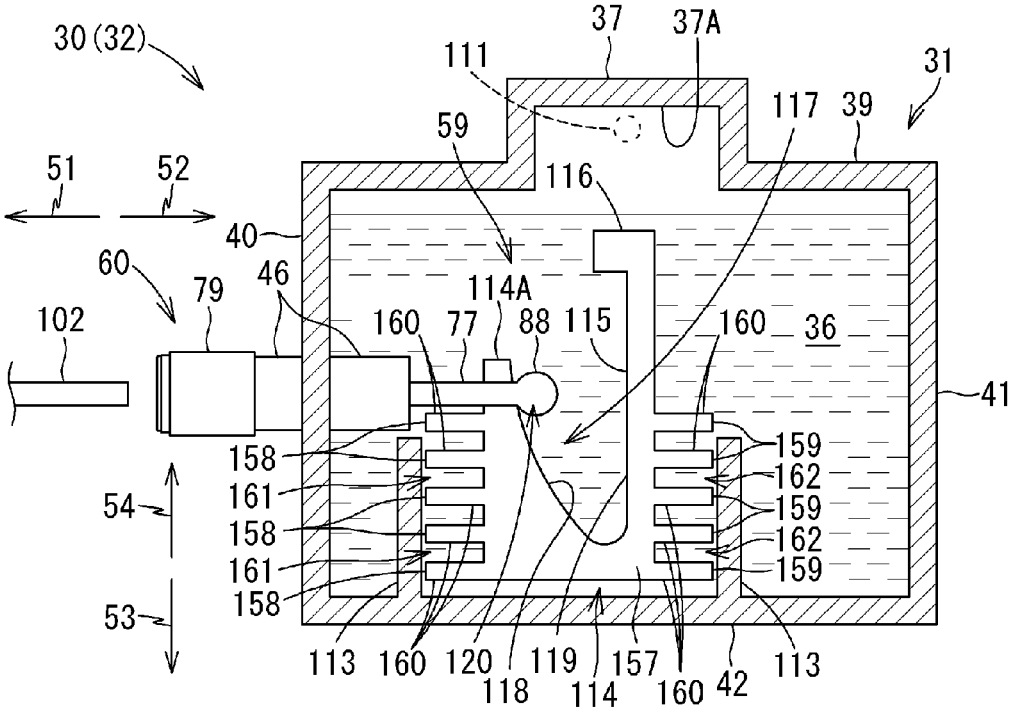
FIG. 12A is a schematic vertical cross-sectional view depicting an ink tank in a first variation of the illustrative embodiment according to one or more aspects of the disclosure, wherein a restriction member is located at a restrict position and a detector is located at a released position.
Figure 12B:
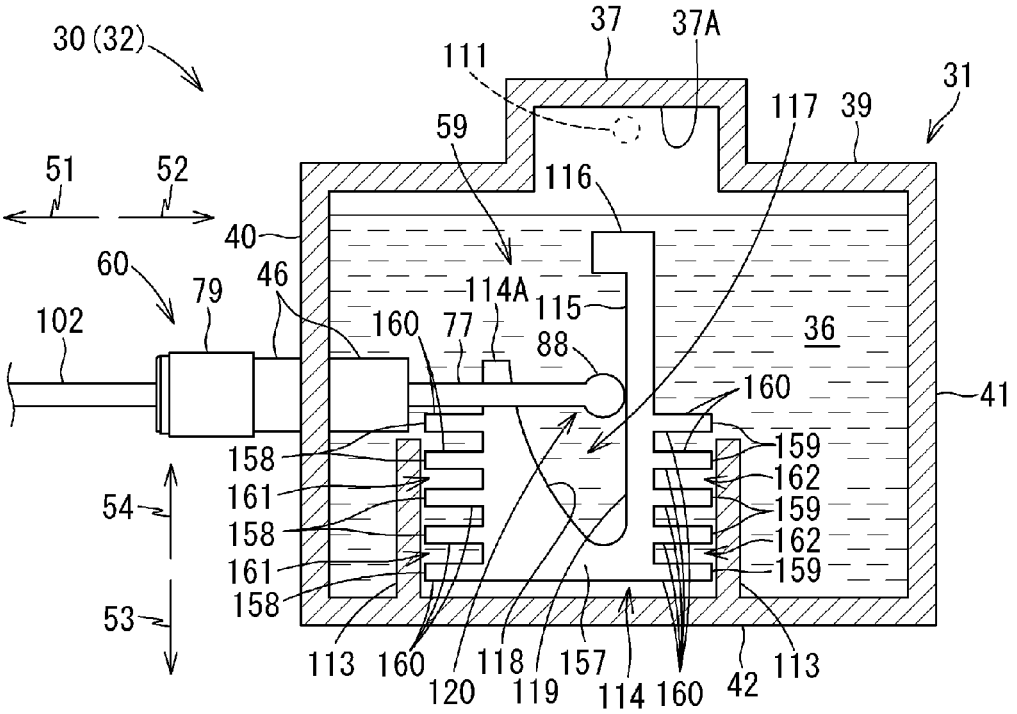
FIG. 12B is a schematic vertical cross-sectional view depicting the ink tank in the first variation of the illustrative embodiment according to one or more aspects of the disclosure, wherein the restriction member is located at a release position and the detector is located at the restricted position.

As depicted in FIGS. 12A and 12B, the detector 59 is disposed inside an ink chamber 36. The detector 59 is supported by a frame 31 so as to be movable up and down. The frame 31 of an ink tank 32 includes a guide member 113. The guide member 113 protrudes in the upward direction 54 from a lower wall 42 of the frame 31. The guide member 113 may have a rectangular hollow cylindrical shape. A float 114 of the detector 59 is disposed in an internal space of the guide member 113. While the detector 59 is movable up and down along the guide member 113, the detector 59 is permitted to move only within backlash or play in the insertion-removal direction 5152 and in the rightward-leftward direction 5556. That is, the guide member 113 allows the detector 59 to move straightly along the up-down direction 54, 53. With this configuration, the detector 59 is supported by the frame 31 so as to be movable up and down.

The detector 59 includes the float 114, an arm 115, and a detected portion 116.

The float 114 is restricted from moving in the directions other than the downward direction 53 and the upward direction 54 by the guide member 113 while being permitted to move only within backlash or play in the directions other than the downward direction 53 and the upward direction 54. The float 114 may be made of material having a lower specific gravity than ink stored in the ink chamber 36.

The float 114 has a cavity 117 that opens upward. The cavity 117 extends from side to side (e.g., between a right end and a left end) of the float 114. The cavity 117 is defined by a first surface 118 and a second surface 119. The first surface 118 is angled relative to the removal direction 52 (e.g., a direction from the front wall 40 toward the rear wall 41). The first surface 118 extends downward in the removal direction 52. The second surface 119 extends in the upward direction 54 contiguous from the first surface 118.

The float 114 includes a body 157, a plurality of fins 158, and a plurality of fins 159. The body 157 has a substantially rectangular parallelepiped shape and has the cavity 117. The plurality of fins 158 extends toward the front wall 40 from the body 157. The plurality of fins 159 extends toward the rear wall 41 from the body 157. Each of the fins 158 and 159 includes one end (e.g., a proximal end) connected with the body 157 and the other end that constitutes a distal end. In the first variation, the plurality of fins 158 includes five fins 158 and the plurality of fins 159 also includes five fins 159. Nevertheless, the number of both of the plurality of fins 158 and the plurality of fins 159 is not limited to the specific example. The float 114 further has recesses 161 defined by the fins 158 and recesses 162 defined by the fins 159.

Each of the fins 158 extends in a direction intersecting the up-down direction 54, 53, which may be a moving direction of the detector 59 (e.g., a moving direction of the float 114). Each of the fins 159 extends in another direction intersecting the up-down direction 54, 53. In the first variation, in a state where the detector 59 is located at the restricted position, each of the fins 158 extends in the insertion direction 51 and each of the fins 159 extends in the removal direction 52.

The fins 158 are spaced apart from each other in the up-down direction 54, 53. The fins 159 are spaced apart from each other in the up-down direction 54, 53. Each of the fins 158 and 159 has surfaces 160 (each of which is another example of the resist surface) on opposite sides thereof. The surfaces 160 of each of the fins 158 extend in a direction intersecting the up-down direction 54, 53 and are spaced from each other in the up-down direction 54, 53. The surfaces 160 of each of the fins 159 extend in a direction intersecting the up-down direction 54, 53 and are spaced from each other in the up-down direction 54, 53. That is, the detector 59 has a plurality of surfaces 160. Each of the surfaces 160 faces upward or downward in the up-down direction 54, 53. Therefore, the surfaces 160 cause resistance to movement of the detector 59 from the restricted position to the released position.

The fins 158 extend parallel to each other. The fins 159 extend parallel to each other. The surfaces 160 may be flat surfaces that extend parallel to each other. All of the fins 158 and 159 have the same length as each other in their extending direction. All of the fins 158 and 159 also have the same dimension in the right-left direction 5556 orthogonal to their extending direction. Therefore, areas (or sizes) of the surfaces 160 of the different fins 158 and 159 are equal to each other.

In other variations, for example, the fins 158 might not necessarily extend parallel to each other. The fins 159 might not also necessarily extend parallel to each other. The surfaces 160 might not also necessarily extend parallel to each other, nor might not be flat surfaces. The fins 158 and 159 may have respective different length in their extending direction. The fins 158 and 159 may have respective different length in the right-left direction 5556. The areas (or sizes) of all of the surfaces 160 may be different from each other.

The facing surfaces 160 of each adjacent two of the plurality of fins 158 define a recess 161 (as another example of the communication opening) therebetween. The facing surfaces 160 of each adjacent two of the plurality of fins 159 define a recess 162 (as another example of the communication opening) therebetween. Each of the recesses 161 and 162 is open in a plurality of directions relative to the ink chamber 36. Each of the recesses 161 and 162 is in communication with the ink chamber 36 through the open ends of each of the recesses 161 and 162. In the first variation, the recess 161 defined by the adjacent fins 158 is open at one end that faces the direction toward which the ink cartridge 30 is inserted, and at right and left ends that are opposite to each other. The recess 162 defined by the adjacent fins 159 is open at one end that faces the direction toward which the ink cartridge 30 is removed, and at right and left ends that are opposite to each other.

The body 157 also defines the other end of each of the recesses 161 that faces the direction toward which the ink cartridge 30 is removed, and the other end of each of the recesses 162 that faces the direction toward which the ink cartridge 30 is inserted. Thus, the other end of each of the recesses 161 that faces the direction toward which the ink cartridge 30 is removed is closed, and the other end of each of the recesses 162 that faces the direction toward which the ink cartridge 30 is inserted is closed.

The arm 115 extends from the float 114 in the upward direction 54. The detected portion 116 is disposed at a distal end of the arm 115 and is supported by the arm 115. The detected portion 116 has a plate-like shape. The detected portion 116 may be made of material that blocks light outputted from the light emitting portion. The detected portion 116 is configured to block light outputted from the light emitting portion in a similar manner to the detection portion 62 of the illustrative embodiment.

The detector 59 is movable between a released position (e.g., a position of the detector 59 depicted in FIG. 13B) and a released position (e.g., a position of the detector 59 depicted in FIG. 12A) while being guided by the guide member 113. The released position and the restricted position are spaced apart from each other in the vertical direction (e.g., the up-down direction 54, 53). The released position is higher than the restricted position. The guide member 113 allows the detector 59 to move straightly between the released position and the restricted position.

When the detector 59 is located at the released position, the detected portion 116 is located between the light emitting portion and the light receiving portion of the sensor 103. That is, the detected portion 116 is located on an optical axis 111 extending between the light emitting portion and the light receiving portion of the sensor 103. Therefore, light outputted from the light emitting portion is blocked by the detected portion 116, thereby not reaching the light receiving portion. Thus, when the detector 59 is located at the released position, the detected portion 116 is detected by the sensor 103 from the outside of the ink cartridge 30. When the detector 59 is located at a position other than the released position, the detected portion 116 is not located between the light emitting portion and the light receiving portion of the sensor 103. Therefore, light outputted from the light emitting portion reaches the light receiving portion.

As depicted in FIGS. 12A and 12B, a restriction member 88 is disposed inside the ink chamber 36. The restriction member 88 has a curved surface at a distal end thereof in the removal direction 52. The restriction member 88 is disposed at an end 120 of a rod 84 of a valve 77. The end 120 is opposite to an end including a plug 83 of the rod 84. Therefore, the restriction member 88 is configured to move together with the valve 77 selectively in the insertion direction 51 and in the removal direction 52. The valve 77 is disposed to the right of the detector 59 and the guide member 113. The restriction member 88 extends from the end 120 in the leftward direction 56. With this configuration, the restriction member 88 is located in the cavity 117 of the float 114.

Figure 13A:
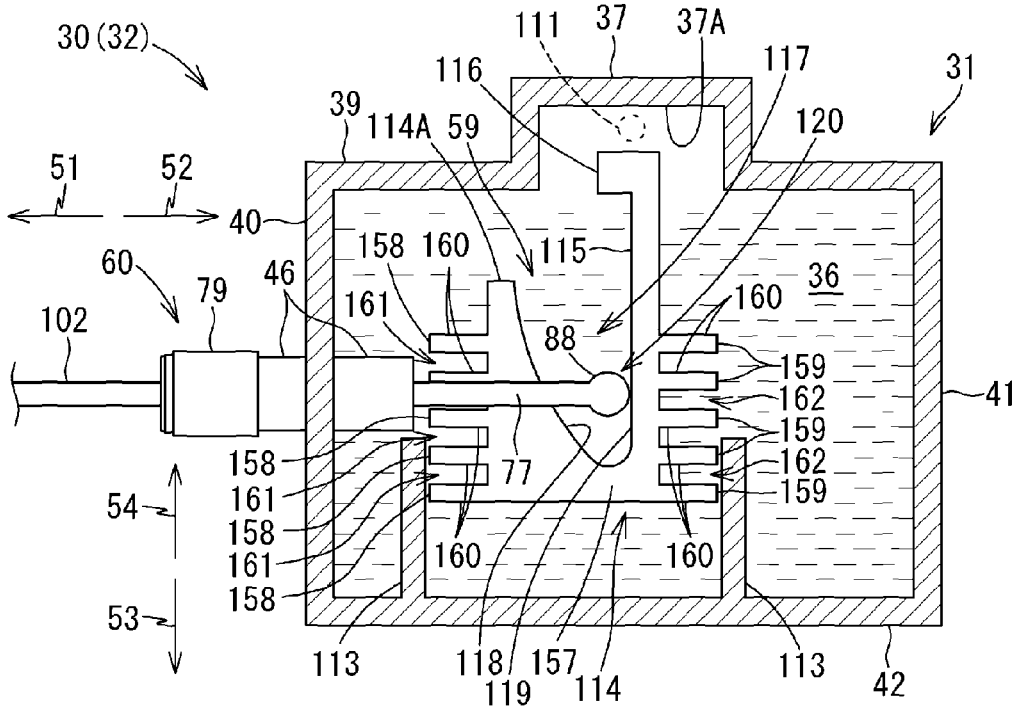
FIG. 13A is a schematic vertical cross-sectional view depicting the ink tank in the first variation of the illustrative embodiment according to one or more aspects of the disclosure, wherein the restriction member is located at the release position and the detector is located between the restricted position and a released position.
Figure 13B:
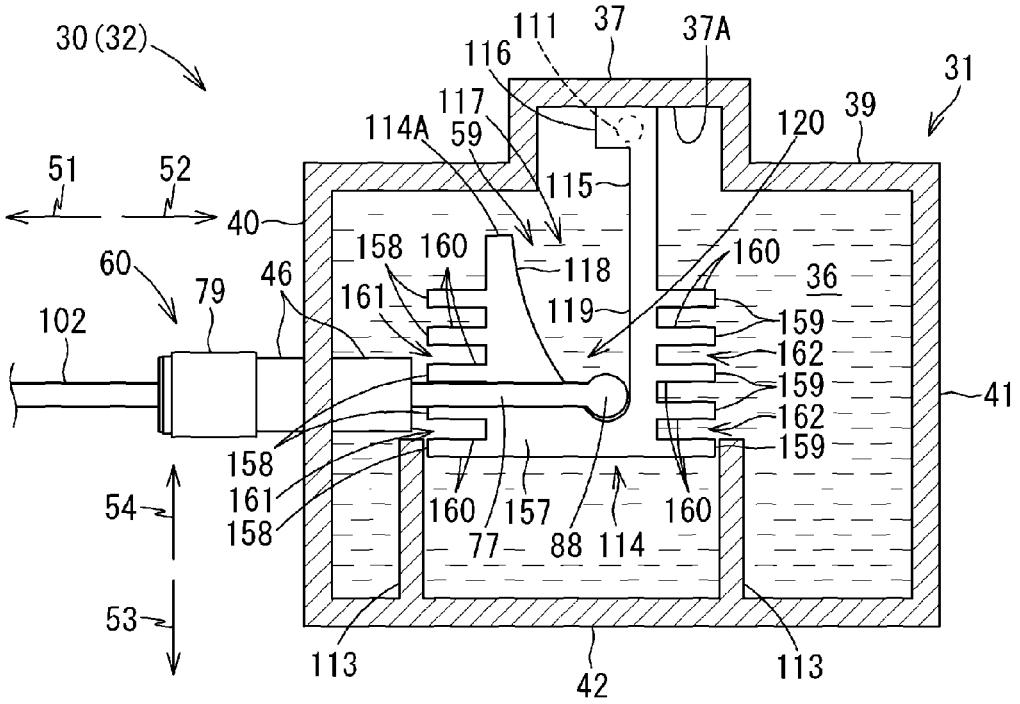
FIG. 13B is a schematic vertical cross-sectional view depicting the ink tank in the first variation of the illustrative embodiment according to one or more aspects of the disclosure, wherein the restriction member is located at the release position and the detector is located at the released position.

The restriction member 88 is movable between a restrict position (e.g., a position of the restriction member 88 depicted in FIG. 12A) and a release position (e.g., a position of the restriction member 88 depicted in FIGS. 12B, 13A, and 13B). The release position is closer to the rear wall 41 than the restrict position. When the valve 77 is located at the first position, the restriction member 88 is located at the restrict position. When the valve 77 is located at the second position, the restriction member 88 is located at the release position. As the valve 77 moves from the first position to the second position against an urging force of a coil spring 87, the restriction member 88 moves from the restrict position to the release position. As the valve 77 moves from the second position to the first position, the restriction member 88 moves from the release position to the restrict position.

When the restriction member 88 is located at the restrict position, the restriction member 88 is in contact with the first surface 118 of the float 114 of the detector 59 from above (refer to FIG. 12A). In this state, the restriction member 88 receives a force having a vector component in the removal direction 52 from the first surface 118 of the cavity 117 due to a buoyant force of the float 114. Nevertheless, since the urging force of the coil spring 87 acting in the insertion direction 51 is greater than the force of the coil spring 78 acting in the removal direction 52, the restriction member 88 is restricted from moving in the removal direction 52, whereby the detector 59 is restricted from moving in the upward direction 54. That is, the detector 59 is restricted from moving from the restricted position. In the first variation, for example, the movement of the detector 59 in the upward direction 54 from the restricted position is restricted while the detector 59 is permitted to move only within backlash or play at the restricted position. The restriction member 88 might not necessarily restrict the movement of the detector 59 in the downward direction 53 from the restricted position. In other variations, for example, when the restriction member 88 is located at the restrict position, the restriction member 88 may be in contact with an upper surface 114A of the float 114 from above, instead of being contact with the first surface 118.

When the restriction member 88 is located at the release position, the restriction member 88 is located separate from the first surface 118 (refer to FIG. 12B). In this state, a distal end portion of the restriction member 88 in the removal direction 52 is located above a deepest portion of the cavity 117 of the float 114 while being distant therefrom. Therefore, in this state, the detector 59 is permitted to move in the upward direction 54. That is, the detector 59 is permitted to move from the restricted position to the released position.

Hereinafter, a description will be provided on how the valve 77, the restriction member 88, and the detector 59 behave in a process of placing the ink cartridge 30 to the cartridge holder 110 in the first variation. In the description below, it is assumed that an amount of ink remaining in the ink chamber 36 is more than the amount of ink remaining in the ink chamber 36 in the near-empty state.

In a state where the ink cartridge 30 is not placed in the cartridge holder 110, the valve 77 of the ink cartridge 30 of the first variation is in the same or similar state to the valve 77 of the ink cartridge 30 of the illustrative embodiment.

When the valve 77 is located at the first position, the restriction member 88 is located at the restrict position. When the restriction member 88 is located at the restrict position, the detector 59 is located at the restricted position. In this state, the restriction member 88 is in contact with the first surface 118 of the float 114 of the detector 59 from above, thereby restricting the detector 59 from moving in the upward direction 54 from the restricted position.

When the detector 59 is located at the restricted position, the float 114 is located near the lower wall 42 of the frame 31. That is, the float 114 is submerged in ink stored in the ink chamber 36.

When the detector 59 is located at the restricted position, the detected portion 116 is not located on the optical axis 111 extending between the light emitting portion and the light receiving portion of the sensor 103. Therefore, light outputted from the light emitting portion is allowed to reach the light receiving portion. Thus, when the detector 59 is located at the restricted position, the sensor 103 outputs a high-level signal to the controller 130.

While the ink cartridge 30 is not placed at a particular position in the cartridge holder 110, a corresponding cartridge sensor 107 is free from pressure of the front end 58 of the cartridge cover 33 of the ink cartridge 30. Therefore, the cartridge sensor 107 outputs a low-level signal to the controller 130.

In this state, the cover of the cartridge holder 110 is opened and then the ink cartridge 30 is inserted into the cartridge holder 110. That is, the ink cartridge 30 is placed at the particular portion in the cartridge holder 110. In other words, the ink cartridge 30 becomes in the use position.

Similar to the illustrative embodiment, when the ink cartridge 30 reaches a vicinity of the inner back surface 151 of the cartridge holder 110 by its movement in the insertion direction 51, the cartridge sensor 107 outputs a high-level signal to the controller 130. Thus, counting for measuring a moving time of the detector 59 is started. In accordance with the movement of the ink cartridge 30 in the insertion direction 51, the valve 77 moves from the first position to the second position, whereby ink is permitted to flow from the ink chamber 36 to the outside of the ink cartridge 30. Further, the ink chamber 36 comes into communication with the outside air, whereby the inside pressure of the ink chamber 36 changes from a negative pressure to the atmospheric pressure.

As depicted in FIG. 12B, as the valve 77 moves in the removal direction 52 from the first position to the second position, the restriction member 88 moves from the restrict position to the release position to separate from the first surface 118 of the float 114 of the detector 59. Therefore, the detector 59 becomes free to move from the restricted position in the upward direction 54.

As the detector 59 becomes movable, the float 114, which has been kept submerged in ink, moves in the upward direction 54 by its buoyant force. That is, the detector 59 moves from the restricted position to the released position by the float 114 that moves upward in response to the movement of the restriction member 88 to the release position while the ink cartridge 30 is in the use position (e.g., while the ink cartridge 30 is completely placed in the cartridge holder 110).

The float 114 keeps moving in the upward direction 54 until the detected portion 116 comes into contact with a surface 37A that defines an internal space of a raised portion 37. FIG. 13A illustrates a state of the inside of the ink tank 32 after the float 114 starts moving in the upward direction 54 and before the detected portion 116 comes into contact with the surface 37A. At the time the detected portion 116 comes into contact with the surface 37A, the detector 59 is located at the released position (e.g., a position of the detector 59 depicted in FIG. 13B). Nevertheless, in other variations, for example, the detector 59 may be located at the released position when the detector 59 is in contact with a bottom of the cavity 117.

When the detector 59 is located at the released position, the detected portion 116 is located between the light emitting portion and the light receiving portion of the sensor 103. That is, the detected portion 116 is located on the optical axis 111 extending between the light emitting portion and the light receiving portion of the sensor 103. Therefore, light outputted from the light emitting portion is not allowed to reach the light receiving portion. Thus, when the detector 59 is located at the released position, the sensor 103 outputs a low-level signal to the controller 130, whereby the counting for measuring the moving time of the detector 59 is ended. Through this process, the ink cartridge 30 is completely placed in the cartridge holder 110.

Hereinafter, a description will be provided on how the valve 77, the restriction member 88, and the detector 59 behave in a process of removing the ink cartridge 30 from the cartridge holder 110. In the description below, it is assumed that the amount of ink remaining in the ink chamber 36 is more than the amount of ink remaining in the ink chamber 36 in the near-empty state.

As depicted in FIG. 13B, in a state where the ink cartridge 30 is completely placed in the cartridge holder 110, the valve 77 is located at the second position by the pressing force of the corresponding ink needle 102. When the valve 77 is located at the second position, the restriction member 88 is located at the release position. When the restriction member 88 is located at the release position, the detector 59 is permitted to move. In this state, the detector 59 is located at the released position by the buoyant force of the float 114.

A portion of the detector 59 may preferably be in contact with the guide member 113 also when the detector 59 is located at the released position.

As the ink cartridge 30 moves in the removal direction 52 for removing the ink cartridge 30 from the cartridge holder 110, the valve 77 separates from the ink needle 102, whereby the valve 77 moves from the second position to the first position by the urging force of the coil spring 87. As the valve 77 moves from the second position to the first position, the restriction member 88 moves together with the valve 77 from the release position to the restrict position. While the restriction member 88 moves from the release position to the restrict position, the restriction member 88 comes into contact with the first surface 118 of the float 114 of the detector 59. The restriction member 88 moves from the release position to the restrict position while being in contact with the first surface 118 from above. Thus, the float 114 is pressed in the downward direction 53 by the restriction member 88, whereby the detector 59 moves from the released position to the restricted position.

Hereinafter, a description will be provided on how the valve 77, the restriction member 88, and the detector 59 behave as the amount of ink remaining in the ink chamber 36 decreases due to consumption of ink in the recording head 21 after the ink cartridge 30 is completely placed in the cartridge holder 110.

Figure 14:
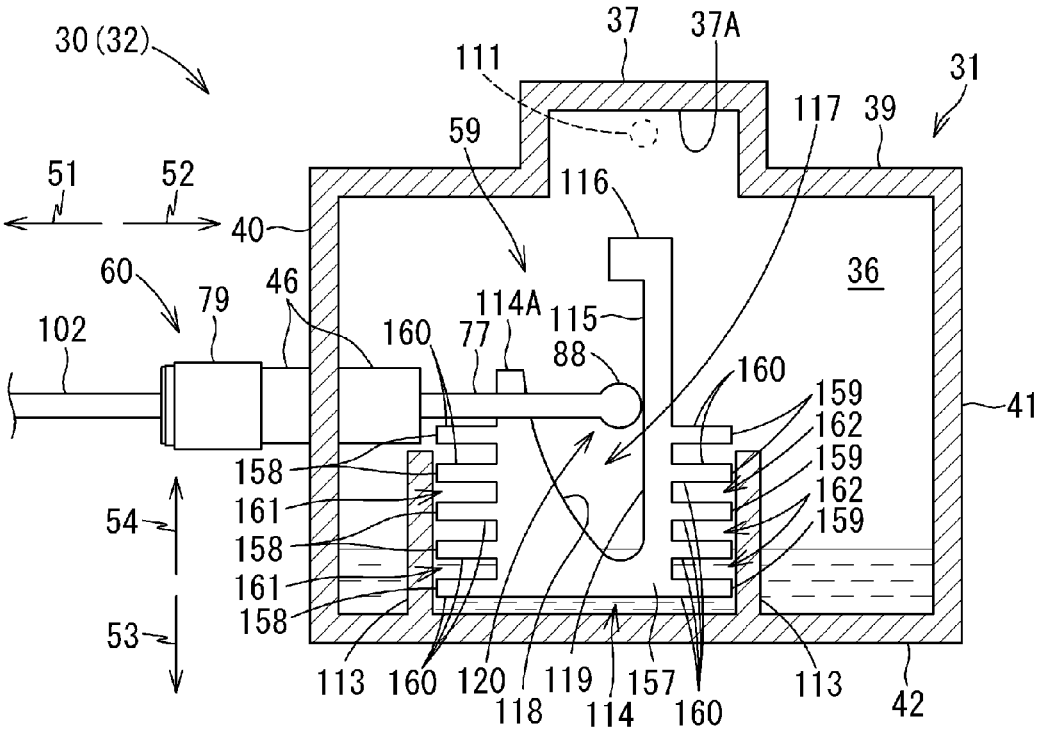
FIG. 14 is a schematic vertical cross-sectional view depicting the ink tank in the first variation of the illustrative embodiment according to one or more aspects of the disclosure, wherein an amount of ink remaining in an ink chamber is less than the amount of ink remaining in the ink chamber of FIG. 13B.

Ink stored in the ink chamber 36 decreases due to consumption of ink by ink ejection from the nozzles 29 of the recording head 21 and thus the ink level becomes lower than a portion of the float 114. In a state where the ink level is lower than the portion of the float 114, the float 114 moves downward with the ink level lowering. In accordance with the downward movement of the float 114, the detector 59 moves in the downward direction 53 from the released position toward the restricted position (refer to FIG. 14), whereby the detected portion 116 is not located between the light emitting portion and the light receiving portion of the sensor 103. Thus, light outputted from the light emitting portion is allowed to reach the light receiving portion. In response to receipt of the light, the sensor 103 outputs a high-level signal to the controller 130. Upon receipt of the high-level signal from the sensor 103, the controller 130 determines that the amount of ink remaining in the ink chamber 36 becomes a predetermined amount.

[Second Variation]

In a second variation, another example configuration in which a detector 59 is movable up and down will be described. Common parts have the same reference numerals as those of the above-described illustrative embodiment or the first variation, and the detailed description of the common parts will be omitted.

Figure 15A:
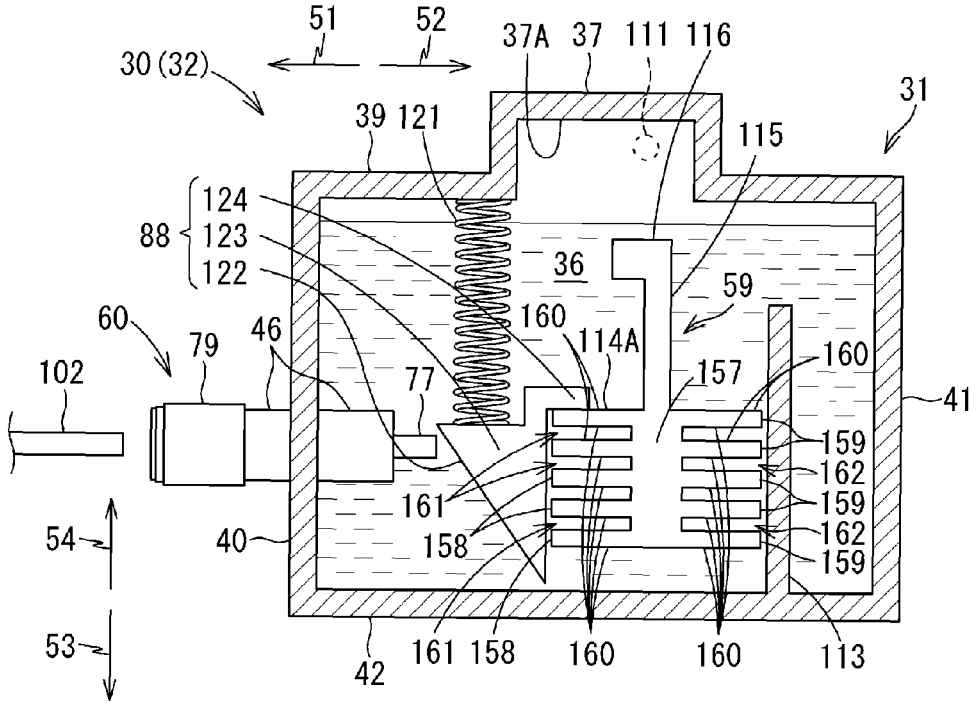
FIG. 15A is a schematic vertical cross-sectional view depicting an ink tank in a second variation of the illustrative embodiment according to one or more aspects of the disclosure, wherein a restriction member is located at a restrict position and a detector is located at a released position.
Figure 15B:
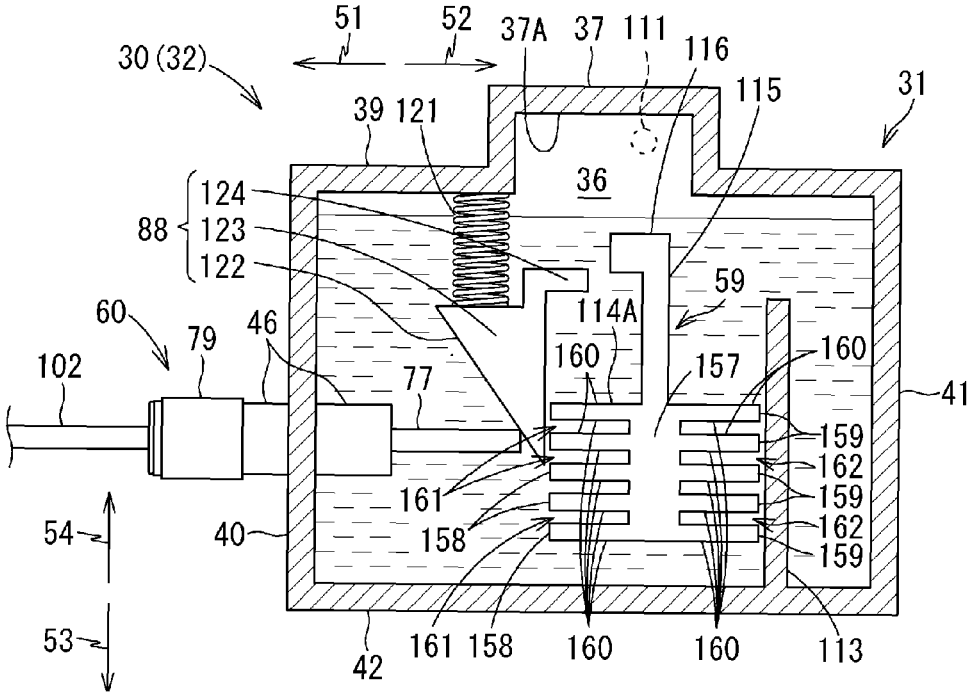
FIG. 15B is a schematic vertical cross-sectional view depicting the ink tank in the second variation of the illustrative embodiment according to one or more aspects of the disclosure, wherein the restriction member is located at a release position and the detector is located at the restricted position.

As depicted in FIGS. 15A and 15B, a detector 59 is disposed inside an ink chamber 36. The detector 59 is supported by a frame 31 so as to be movable up and down. The frame 31 of an ink tank 32 includes a guide member 113. The guide member 113 protrudes in the upward direction 54 from a lower wall 42 of the frame 31. The guide member 113 surrounds the detector 59 on three sides, for example, the right side, the left side, and the side that faces the direction toward which the ink cartridge 30 is removed (e.g., the side that faces a rear wall 41 of the frame 31). A restriction member 88 is disposed adjacent to the detector 59 in the insertion direction 51. With this configuration, while the detector 59 is movable up and down along the guide member 113, the detector 59 is permitted to move only within backlash or play in the insertion-removal direction 5152 and in the rightward-leftward direction 5556. That is, the guide member 113 allows the detector 59 to move straightly along the up-down direction 54, 53. With this configuration, the detector 59 is supported by the frame 31 so as to be movable up and down.

The detector 59 of the second variation has a similar configuration to the detector 59 of the first variation except that the detector 59 of the second variation does not have a cavity 117 in a float 114 thereof.

As depicted in FIGS. 15A and 15B, the restriction member 88 is disposed inside the ink chamber 36. The restriction member 88 is disposed between a valve 77 and the detector 59 in the insertion-removal direction 5152.

The restriction member 88 includes a body 123 and a projecting portion 124. The body 123 has an inclined surface 122 that is angled relative to the removal direction 52 (e.g. a direction from the front wall 40 toward the rear wall 41)

and extends downward in the removal direction 52. The projecting portion 124 protrudes from the body 123 in the removal direction 52.

A coil spring 121 (as another example of the urging member) is disposed between the restriction member 88 and an upper wall 39 of an ink tank 32 in the up-down direction 54, 53. The coil spring 121 has one end connected with the restriction member 88 and the other end connected with the upper wall 39. This configuration allows the restriction member 88 to move up and down as the coil spring 121 contracts and extends. In other variations, for example, a leaf spring may be used as the urging member, instead of the coil spring 121.

Figure 16A:
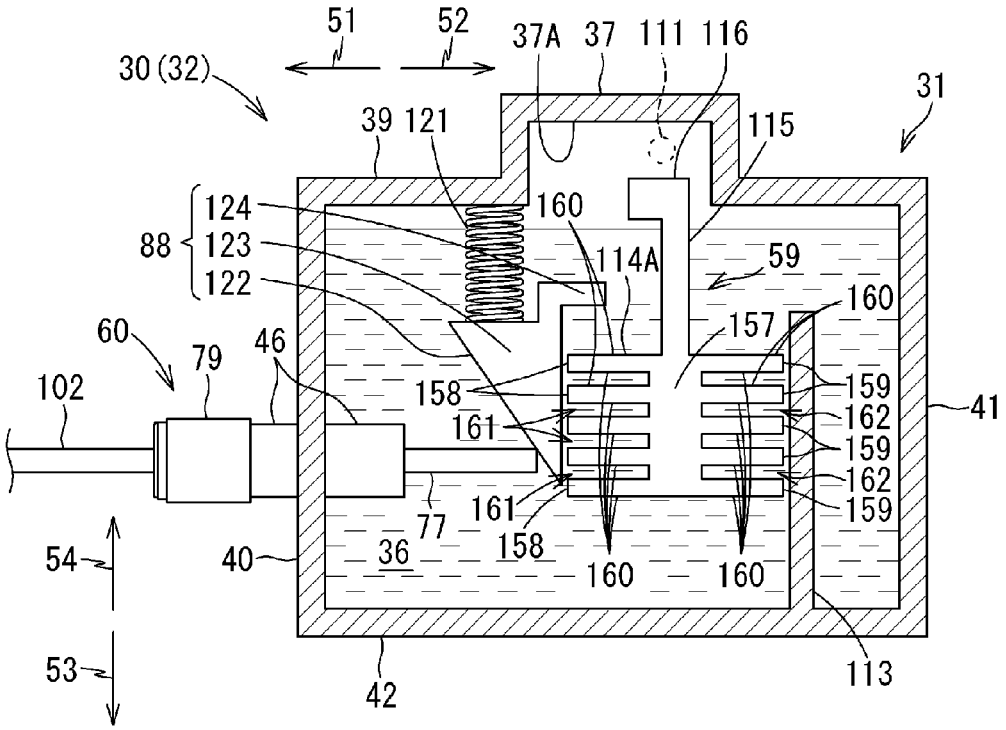
FIG. 16A is a schematic vertical cross-sectional view depicting the ink tank in the second variation of the illustrative embodiment according to one or more aspects of the disclosure, wherein the restriction member is located at the release position and the detector is located between the restricted position and a released position.
Figure 16B:
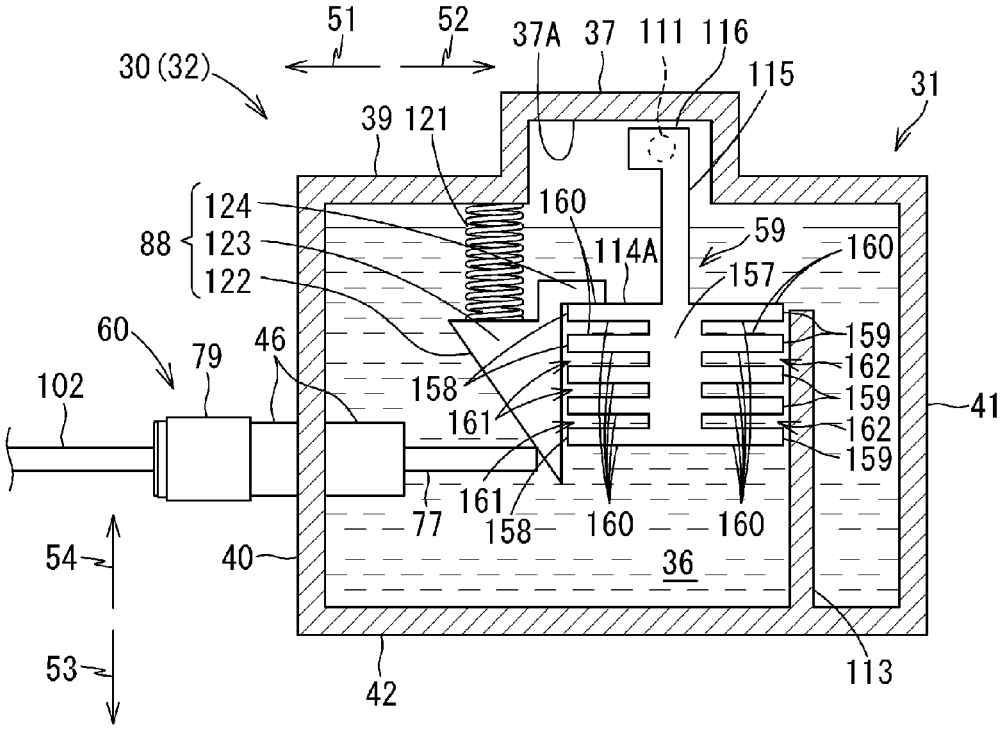
FIG. 16B is a schematic vertical cross-sectional view depicting the ink tank in the second variation of the illustrative embodiment according to one or more aspects of the disclosure, wherein the restriction member is located at the release position and the detector is located at the released position.

The restriction member 88 is movable between a restrict position (e.g., a position of the restriction member 88 depicted in FIG. 15A) and a release position (e.g., a position of the restriction member 88 depicted in FIG. 16B). The release position is higher than the restrict position. When the valve 77 is located at the first position, the restriction member 88 is located at the restrict position. When the valve 77 is located at the second position, the restriction member 88 is located at the release position. As the valve 77 moves from the first position to the second position, the restriction member 88 moves from the restrict position to the release position. As the valve 77 moves from the second position to the first position, the restriction member 88 moves from the release position to the restrict position.

When the restriction member 88 is located at the restrict position, the projecting portion 124 of the restriction member 88 is in contact with an upper surface 114A (e.g., a topmost fin 158 of the float 114) of the float 114 of the detector 59 from above. Thus, the detector 59 is restricted from moving in the upward direction 54. That is, the detector 59 is restricted from moving from the restricted position. In the second variation, for example, the movement of the detector 59 in the upward direction 54 from the restricted position is restricted while the detector 59 is permitted to move only within backlash or play at the restricted position. The restriction member 88 might not necessarily restrict the movement of the detector 59 in the downward direction 53 from the restricted position.

When the restriction member 88 is located at the release position, the restriction member 88 is located separate from the upper surface 114A of the float 114. Therefore, in this state, the detector 59 is permitted to move in the upward direction 54. That is, the detector 59 is permitted to move from the restricted position to the released position.

Hereinafter, a description will be provided on how the valve 77, the restriction member 88, and the detector 59 behave in a process of placing the ink cartridge 30 to the cartridge holder 110 in the second variation. In the description below, it is assumed that an amount of ink remaining in the ink chamber 36 is more than the amount of ink remaining in the ink chamber 36 in the near-empty state.

In a state where the ink cartridge 30 is not placed in the cartridge holder 110, the valve 77 of the ink cartridge 30 of the second variation is in the same or similar state to the valve 77 of the ink cartridge 30 of the illustrative embodiment.

When the valve 77 is located at the first position, the valve 77 is located separate from the restriction member 88. In this state, the restriction member 88 is located at the restrict position. When the restriction member 88 is located at the restrict position, the detector 59 is located at the restricted position. In this state, the restriction member 88 is in contact with the upper surface 114A of the float 114 of the detector 59 from above, thereby restricting the detector 59 from moving in the upward direction 54 from the restricted position.

When the detector 59 is located at the restricted position, the float 114 is located near the lower wall 42 of the frame 31. That is, the float 114 is submerged in ink stored in the ink chamber 36.

When the detector 59 is located at the restricted position, the detected portion 116 is not located on the optical axis 111 extending between the light emitting portion and the light receiving portion of the sensor 103. Therefore, light outputted from the light emitting portion is allowed to reach the light receiving portion. Thus, when the detector 59 is located at the restricted position, the sensor 103 outputs a high-level signal to the controller 130.

While the ink cartridge 30 is not placed at a particular position in the cartridge holder 110, a corresponding cartridge sensor 107 is free from pressure of the front end 58 of the cartridge cover 33 of the ink cartridge 30. Therefore, the cartridge sensor 107 outputs a low-level signal to the controller 130.

In this state, the cover of the cartridge holder 110 is opened and then the ink cartridge 30 is inserted into the cartridge holder 110. That is, the ink cartridge 30 is placed at the particular portion in the cartridge holder 110. In other words, the ink cartridge 30 becomes in the use position.

Similar to the illustrative embodiment, when the ink cartridge 30 reaches a vicinity of the inner back surface 151 of the cartridge holder 110 by its movement in the insertion direction 51, the cartridge sensor 107 outputs a high-level signal to the controller 130. Thus, counting for measuring a moving time of the detector 59 is started. In accordance with the movement of the ink cartridge 30 in the insertion direction 51, the valve 77 moves from the first position to the second position, whereby ink is permitted to flow from the ink chamber 36 to the outside of the ink cartridge 30. Further, the ink chamber 36 comes into communication with the outside air, whereby the inside pressure of the ink chamber 36 changes from a negative pressure to the atmospheric pressure.

As depicted in FIG. 15B, as the valve 77 moves in the removal direction 52 from the first position to the second position, the inclined surface 122 of the restriction member 88 is pressed by the valve 77. That is, the valve 77 moves from the first position to the second position while being in contact with the inclined surface 122 from below. Thus, the restriction member 88 moves in the upward direction 54 from the restrict position toward the release position against the urging force of the coil spring 121. In this state, the coil spring 121 urges the restriction member 88 downward in the vertical direction toward the restrict position. The restriction member 88 moves toward the release position to separate from the detector 59 located at the restricted position. Therefore, the detector 59 becomes free to move from the restricted position in the upward direction 54.

As the detector 59 becomes movable, the float 114, which has been kept submerged in ink, moves in the upward direction 54 by its buoyant force. That is, the detector 59 moves from the restricted position to the released position by the float 114 that moves upward in response to the movement of the restriction member 88 to the release position while the ink cartridge 30 is in the use position (e.g., while the ink cartridge 30 is completely placed in the cartridge holder 110).

The float 114 keeps moving in the upward direction 54 until the upper surface 114A of the float 114 comes into contact with the projecting portion 124 of the restriction member 88 located at the release position. FIG. 16A illustrates a state of the inside of the ink tank 32 after the float 114 starts moving in the upward direction 54 and before the detected portion 116 comes into contact with the projecting portion 124. At the time the upper surface 114A of the float 114 comes into contact with the projecting portion 124 of the restriction member 88 located at the release position from below, the detector 59 is located at the released position (refer to FIG. 16B).

When the detector 59 is located at the released position, the detected portion 116 is located between the light emitting portion and the light receiving portion of the sensor 103. That is, the detected portion 116 is located on the optical axis 111 extending between the light emitting portion and the light receiving portion of the sensor 103. Therefore, light outputted from the light emitting portion is not allowed to reach the light receiving portion. Thus, when the detector 59 is located at the released position, the sensor 103 outputs a low-level signal to the controller 130, whereby the counting for measuring the moving time of the detector 59 is ended. Through this process, the ink cartridge 30 is completely placed in the cartridge holder 110.

Hereinafter, a description will be provided on how the valve 77, the restriction member 88, and the detector 59 behave in a process of removing the ink cartridge 30 from the cartridge holder 110. In the description below, it is assumed that the amount of ink remaining in the ink chamber 36 is more than the amount of ink remaining in the ink chamber 36 in the near-empty state.

As depicted in FIG. 16B, in a state where the ink cartridge 30 is completely placed in the cartridge holder 110, the valve 77 is located at the second position by the pressing force of the corresponding ink needle 102. When the valve 77 is located at the second position, the restriction member 88 is located at the release position. When the restriction member 88 is located at the release position, the detector 59 is permitted to move. In this state, the detector 59 is located at the released position by the buoyant force of the float 114.

As the ink cartridge 30 moves in the removal direction 52 for removing the ink cartridge 30 from the cartridge holder 110, the valve 77 separates from the ink needle 102, whereby the valve 77 moves from the second position to the first position by the urging force of the coil spring 87 to separate from the restriction member 88. As the valve 77 separates from the restriction member 88, the restriction member 88 moves in the downward direction 53 from the release position to the restrict position by the urging force of the coil spring 121. While the restriction member 88 moves in the downward direction 53, the projecting portion 124 of the restriction member 88 presses the upper surface 114A of the float 114 of the detector 59 in the downward direction 53, whereby the detector 59 moves from the released position to the restricted position.

Hereinafter, a description will be provided on how the valve 77, the restriction member 88, and the detector 59 behave as the amount of ink remaining in the ink chamber 36 decreases due to consumption of ink in the recording head 21 after the ink cartridge 30 is completely placed in the cartridge holder 110.

Figure 17:
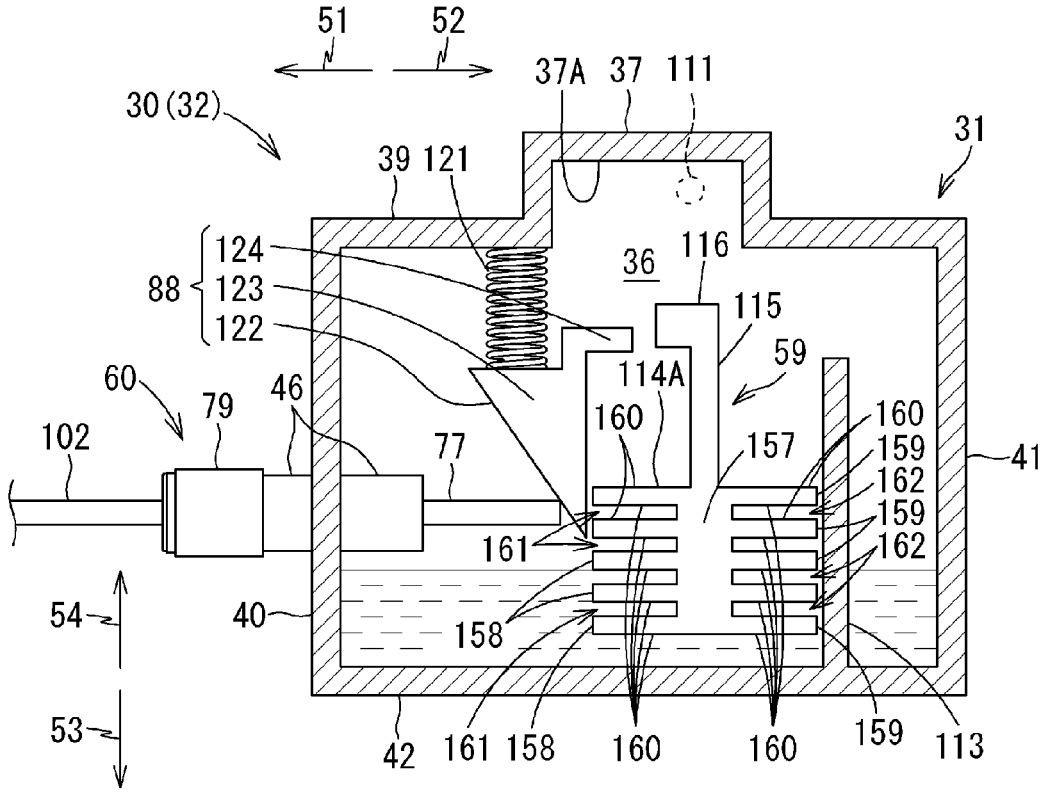
FIG. 17 is a schematic vertical cross-sectional view depicting the ink tank in the second variation of the illustrative embodiment according to one or more aspects of the disclosure, an amount of ink remaining in an ink chamber is less than the amount of ink remaining in the ink chamber of FIG. 16B.

Ink stored in the ink chamber 36 decreases due to consumption of ink by ink ejection from the nozzles 29 of the recording head 21 and thus the ink level becomes lower than a portion of the float 114. In a state where the ink level is lower than the portion of the float 114, the float 114 moves downward with the ink level lowering. In accordance with the downward movement of the float 114, the detector 59 moves in the downward direction 53 from the released position toward the restricted position (refer to FIG. 17), whereby the detected portion 116 is not located between the light emitting portion and the light receiving portion of the sensor 103. Thus, light outputted from the light emitting portion is allowed to reach the light receiving portion. In response to receipt of the light, the sensor 103 outputs a high-level signal to the controller 130. Upon receipt of the high-level signal from the sensor 103, the controller 130 determines that the amount of ink remaining in the ink chamber 36 becomes a predetermined amount.

[Third Variation]

In the first and second variations, the detector 59 is configured to move from the restricted position to the released position using buoyant force of the float 114. Nevertheless, in other variations, a detector 59 may be configured to move from the restricted position to the released position using a downward movement of a weight 125. An example of this configuration will be described below in a third variation. Common parts have the same reference numerals as those of the above-described illustrative embodiment, the first variation, or the second variation, and the detailed description of the common parts will be omitted.

Figure 18A:
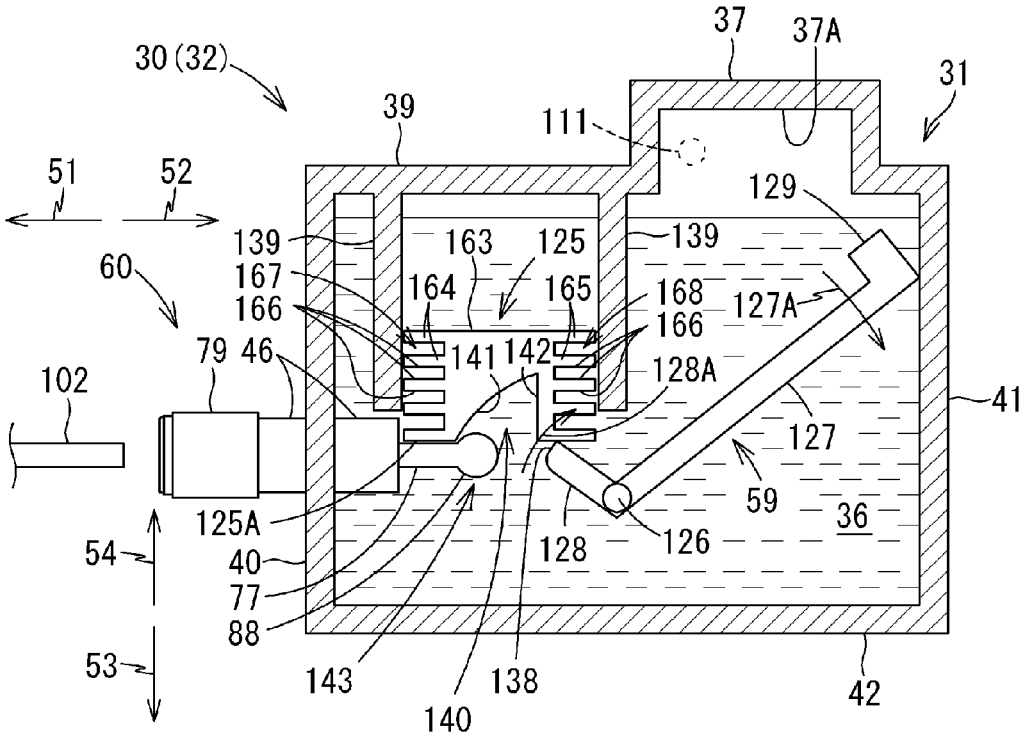
FIG. 18A is a schematic vertical cross-sectional view depicting an ink tank in a third variation of the illustrative embodiment according to one or more aspects of the disclosure, wherein a restriction member is located at a restrict position and a detector is located at a released position.
Figure 18B:
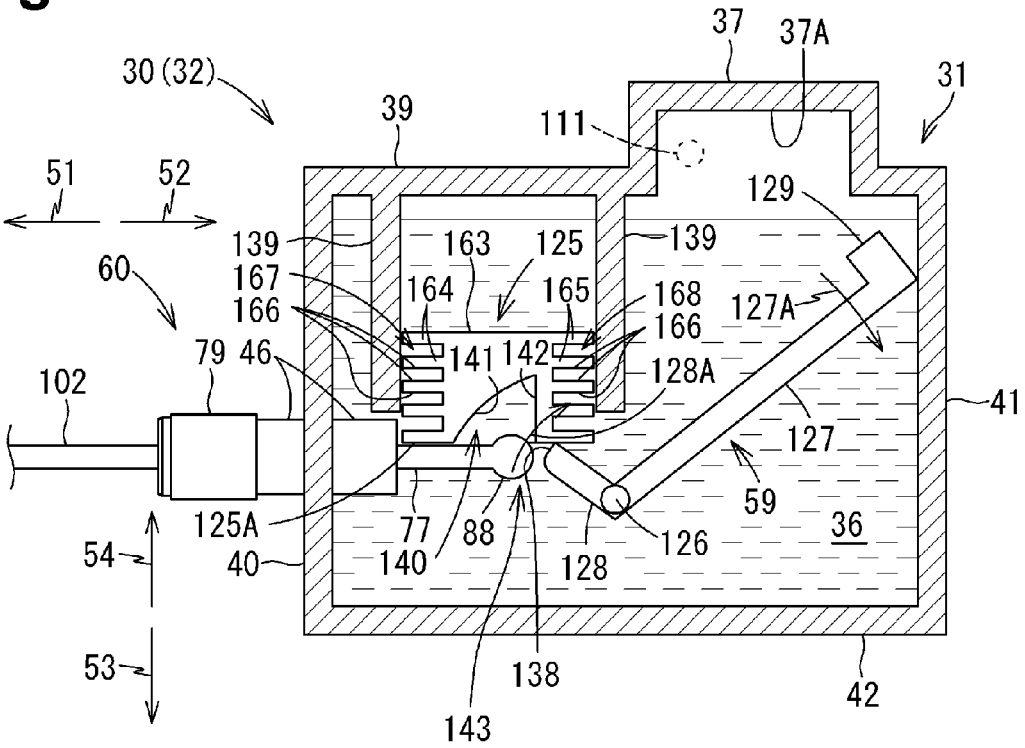
FIG. 18B is a schematic vertical cross-sectional view depicting the ink tank in the third variation of the illustrative embodiment according to one or more aspects of the disclosure, wherein the restriction member is located at a release position and the detector is located at the restricted position.

In the third variation, as depicted in FIGS. 18A and 18B, a detector 59 is disposed inside an ink chamber 36. The detector 59 is rotatably supported by a frame 31. The detector 59 includes an axial portion 126, a first arm 127, a second arm 128, a detected portion 129, and a restricted portion 138.

The first arm 127 extends from the axial portion 126 in one direction with respect to a diameter direction of the axial portion 126. The second arm 128 extends from the axial portion 126 in another direction with respect to the diameter direction so as to extend in a different direction from the direction that the first arm 127 extends.

The detected portion 129 is disposed at a distal end of the first arm 127 and is supported by the first arm 127. The detected portion 129 has a plate-like shape. The detected portion 129 may be made of material that blocks light outputted from the light emitting portion. The detected portion 129 is configured to block light outputted from the light emitting portion in a similar manner to the detection portion 62 of the illustrative embodiment.

The restricted portion 138 is disposed at a distal end of the second arm 128. The restricted portion 138 constitutes a portion of the second arm 128 and includes the distal end of the second arm 128. The restricted portion 138 is configured to contact and separate from the weight 125. In other variations, for example, the restricted portion 138 and the second arm 128 may be separate parts. In this case, the restricted portion 138 may be supported by the second arm 128.

The detector 59 is disposed inside the ink chamber 36 while the first arm 127 extends obliquely upward in the removal direction 52 and the second arm 128 extends obliquely upward in the insertion direction 51.

The detector 59 is movable (e.g., rotatable) between a released position (e.g., a position of the detector 59 depicted in FIG. 19B) and a released position (e.g., a position of the detector 59 depicted in FIG. 18A). The restricted position is a different position from the released position. When the detector 59 is located at the released position, the detected portion 129 is located between the light emitting portion and the light receiving portion of the sensor 103. That is, the detected portion 129 is located on the optical axis 111 extending between the light emitting portion and the light receiving portion of the sensor 103. Therefore, light outputted from the light emitting portion is blocked by the detected portion 129, thereby not reaching the light receiving portion. Thus, when the detector 59 is located at the released position, the detected portion 129 is detected by the sensor 103 from the outside of the ink cartridge 30. When the detector 59 is located at a position other than the released position, the detected portion 129 is not located between the light emitting portion and the light receiving portion of the sensor 103. Therefore, light outputted from the light emitting portion reaches the light receiving portion.

The detector 59 may be made of material having a higher specific gravity than ink stored in the ink chamber 36. The first arm 127 is longer in length than the second arm 128. With this configuration, when the detector 59 is located at the released position, the first arm 127 tends to move in a direction of an arrow 127A, e.g., in a direction that the first arm 127 moves closer to a lower wall 42 of the ink cartridge 30 through ink, while the second arm 128 tends to move in a direction of an arrow 128A, e.g., in a direction that the second arm 128 moves away from the lower wall 42 of the ink 30 through ink. While the second arm 128 moves in the direction of the arrow 127A, the second arm 128 comes in contact with a bottom surface 125A of the weight 125. At the time the second arm 128 comes into contact with the bottom surface 125A of the weight 125, the detector 59 is located at the restricted position.

The weight 125 may be made of material having a higher specific gravity than ink stored in the ink chamber 36. The weight 125 is supported by a restriction member 88 within the ink chamber 36.

The frame 31 of an ink tank 32 includes a guide member 139. The guide member 139 protrudes in the downward direction 53 from an upper wall 39 of the frame 31. The guide member 139 surrounds the weight 125 on four sides, for example, the right side, the left side, the side that faces the direction toward which the ink cartridge 30 is inserted (e.g., the side that faces a rear wall 40 of the frame 31), and the side that faces the direction toward which the ink cartridge 30 is removed (e.g., the side that faces a rear wall 41 of the frame 31). While the weight 125 is movable up and down along the guide member 139, the weight 125 is permitted to move only within backlash or play in the insertion-removal direction 5152 and in the rightward-leftward direction 5556. That is, the guide member 139 allows the weight 125 to move straightly along the up-down direction 54, 53.

The weight 125 is disposed above the second arm 128 in the vertical direction. Thus, the weight 125 is capable of contacting the second arm 128 from above.

Figure 19A:
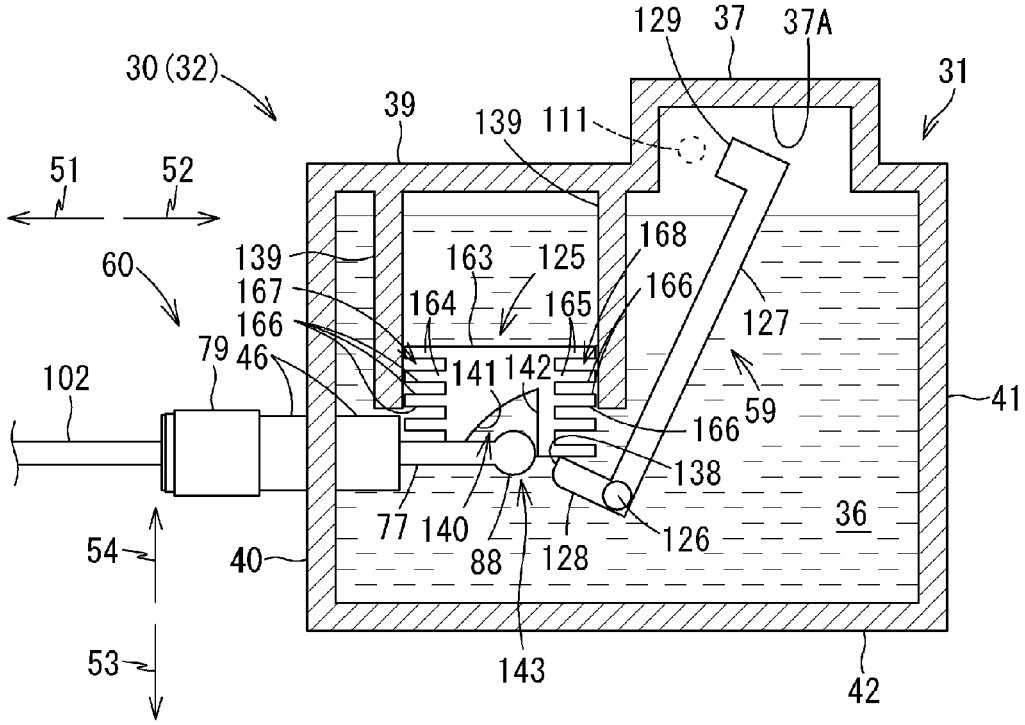
FIG. 19A is a schematic vertical cross-sectional view depicting the ink tank in the third variation of the illustrative embodiment according to one or more aspects of the disclosure, wherein the restriction member is located at the release position and the detector is located between the restricted position and a released position.
Figure 19B:
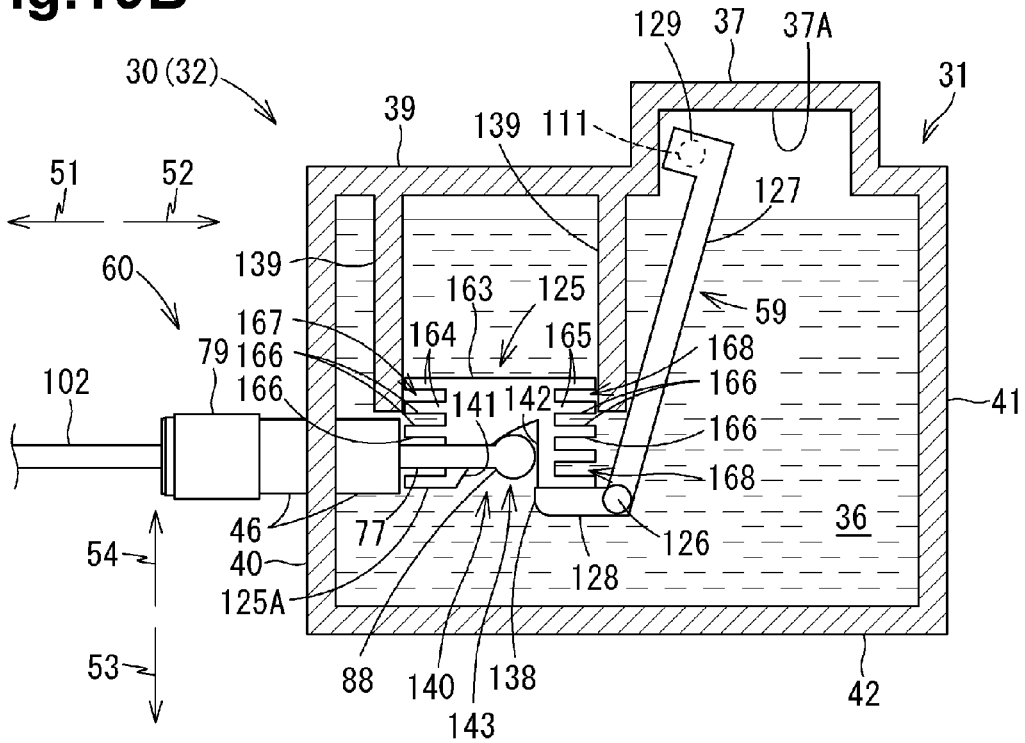
FIG. 19B is a schematic vertical cross-sectional view depicting the ink tank in the third variation of the illustrative embodiment according to one or more aspects of the disclosure, the restriction member is located at the release position and the detector is located at the released position.

The weight 125 is movable between a higher position (e.g., a position of the weight 125 depicted in FIG. 18A) and a lower position (e.g., a position of the weight 125 depicted in FIG. 19B). In the third variation, the weight 125 is disposed to the right or to the left of the valve 77 such that the valve 77 might not interfere with the movement of the weight 125 in the upward direction 54 and in the downward direction 53.

When the valve 77 is located at the first position, the weight 125 is located at the higher position. When the weight 125 is located at the higher position, the weight 125 retains the detector 59 at the restricted position by contacting the second arm 128. When the valve 77 is located at the second position, the weight 125 is located at the lower position. When the weight 125 is located at the lower position, the weight 125 retains the detector 59 at the released position by contacting the second arm 128 from above. As the valve 77 moves from the first position to the second position, the weight 125 moves from the higher position to the lower position. As the valve 77 moves from the second position to the first position, the weight 125 moves from the lower position to the higher position.

The weight 125 has a cavity 140 that opens downward. The cavity 140 extends from side to side (e.g., between a right end and a left end) of the weight 125. The cavity 140 is defined by a first surface 141 (as an example of an inclined surface) and a second surface 142. The first surface 141 is angled relative to the removal direction 52 (e.g. a direction from the front wall 40 toward the rear wall 41). The first surface 141 extends upward in the removal direction 52. The second surface 142 extends in the downward direction 53 contiguous from the first surface 141.

The weight 125 includes a body 163, a plurality of fins 164, and a plurality of fins 165. The body 163 has a substantially rectangular parallelepiped shape and has the cavity 140. The plurality of the fins 164 extends toward the front wall 40 from the body 163. The plurality of fins 165 extends toward the rear wall 41 from the body 163. Each of the fins 164 and 165 includes one end (e.g., a proximal end) connected with the body 163 and the other end that constitutes a distal end. In the third variation, the plurality of fins 164 includes five fins 164 and the plurality of fins 165 also includes five fins 165. Nevertheless, the number of both of the plurality of fins 164 and the plurality of fins 165 is not limited to the specific example. The weight 125 further has recesses 167 defined by the fins 164 and recesses 168 defined by the fins 165.

Each of the fins 164 extends in a direction intersecting the up-down direction 54, 53, which may be a moving direction of the weight 125. Each of the fins 165 extends in another direction intersecting the up-down direction 54, 53. In the third direction, each of the fins 164 extends in the insertion direction 51 and each of the fins 165 extends in the removal direction 52.

The fins 164 are spaced apart from each other in the up-down direction 54, 53. The fins 165 are spaced apart from each other in the up-down direction 54, 53. Each of the fins 164 and 165 has surfaces 166 (each of which is another example of the resist surface) on opposite sides thereof. The surfaces 166 of each of the fins 164 extends in a direction intersecting the up-down direction 54, 53 and are spaced from each other in the up-down direction 54, 53. The surfaces 166 of each of the fins 165 extend in a direction intersecting the up-down direction 54, 53 and are spaced from each other in the up-down direction 54, 53. That is, the weight 125 has a plurality of surfaces 166. Each of the surfaces 166 faces upward or downward in the up-down direction 54, 53. Therefore, the surfaces 166 cause resistance to movement of the weight 125 in the downward direction 53 and in the upward direction 54.

The fins 164 extend parallel to each other. The fins 165 extend parallel to each other. The surfaces 166 may be flat surfaces that extend parallel to each other. All of the fins 164 and 165 have the same length as each other in their extending direction. All of the fins 164 and 165 also have the same dimension in the right-left direction 5556 orthogonal to their extending direction. Therefore, areas (or sizes) of the surfaces 166 of the different fins 164 and 165 are equal to each other.

In other variations, for example, the fins 164 might not necessarily extend parallel to each other. The fins 165 might not also necessarily extend parallel to each other. The surfaces 166 might not also necessarily extend parallel to each other, nor might not be flat surfaces. The fins 164 and 165 may have respective different length in their extending direction. The fins 164 and 165 may have respective different length in the right-left direction 5556. The areas (or sizes) of all of the surfaces 166 may be different from each other.

The facing surfaces 166 of each adjacent two of the plurality of fins 164 define a recess 167 (as another example of the communication opening) therebetween. The facing surfaces 166 of each adjacent two of the plurality of fins 165 define a recess 168 (as another example of the communication opening) therebetween. Each of the recesses 167 and 168 is open in a plurality of directions relative to the ink chamber 36. Each of the recesses 167 and 168 is in communication with the ink chamber 36 through the open ends of each of the recesses 167 and 168. In the third variation, the recess 167 defined by the adjacent fins 164 is open at one end that faces the direction toward which the ink cartridge 30 is inserted, and at right and left ends that are opposite to each other. The recess 168 defined by the adjacent fins 165 is open at one end that faces the direction toward which the ink cartridge 30 is removed, and at right and left ends that are opposite to each other.

The body 157 also defines the other end of each of the recesses 167 that faces the direction toward which the ink cartridge 30 is removed, and the other end of each of the recesses 168 that faces the direction toward which the ink cartridge 30 is inserted. Thus, the other end of each of the recesses 167 that faces the direction toward which the ink cartridge 30 is removed is closed, and the other ends of each of the recesses 168 that faces the direction toward which the ink cartridge 30 is inserted is closed.

As depicted in FIGS. 18A and 18B, a restriction member 88 is disposed inside the ink chamber 36. The restriction member 88 is disposed at an end 143 of a rod 84 of the valve 77. The end 143 is opposite to an end including a plug 83 of the rod 84. Therefore, the restriction member 88 is configured to move together with the valve 77 selectively in the insertion direction 51 and in the removal direction 52. The valve 77 is disposed to the right of the weight 125. The restriction member 88 extends from the end 143 in the leftward direction 56. With this configuration, the restriction member 88 is located in the cavity 140 of the weight 125.

The restriction member 88 is movable between a restrict position (e.g., a position of the restriction member 88 depicted in FIG. 18A) and a release position (e.g., a position of the restriction member 88 depicted in FIGS. 18B, 19A, and 19B). The release position is closer to the rear wall 41 than the restrict position. When the valve 77 is located at the first position, the restriction member 88 is located at the restrict position. When the valve 77 is located at the second position, the restriction member 88 is located at the release position. As the valve 77 moves from the first position to the second position, the restriction member 88 moves from the restrict position to the release position. As the valve 77 moves from the second position to the first position, the restriction member 88 moves from the release position to the restrict position.

When the restriction member 88 is located at the restrict position, the restriction member 88 supports the weight 125 by contacting the first surface 141 of the weight 125 from below. Thus, the weight 125 is restricted from moving in the downward direction 53 from the higher position. In the third variation, for example, the movement of the weight 125 in the downward direction 53 from the higher position is restricted while the weight 125 is permitted to move only within backlash or play at the higher position. The restriction member 88 might not necessarily restrict the movement of the weight 125 from the higher position in the upward direction 54. The movement of the weight 125 is restricted by the restriction member 88, whereby the detector 59 does not move from the restricted position. That is, the restriction member 88 restricts the movement of the detector 59 from the restricted position indirectly. In other variations, for example, when the restriction member 88 is located at the restrict position, the restriction member 88 may support the weight 125 by contacting a bottom surface 125A of the weight 125 from below, instead of contacting the first surface 141 of the weight 125.

When the restriction member 88 is located at the release position, the restriction member 88 is located separate from the first surface 141 of the weight 125 located at the higher position. Therefore, in this state, the weight 125 is permitted to move in the downward direction 53 by force of gravity. That is, when the restriction member 88 is located at the release position, the restriction member 88 permits the weight 125 to move from the higher position to the lower position. The detector 59 rotates from the restricted position to the released position by pressure of the weight 125 that moves from the higher position to the lower position. In other words, when the restriction member 88 is located at the release position, the restriction member 88 permits the movement of the detector 59.

Hereinafter, a description will be provided on how the valve 77, the restriction member 88, the weight 125, and the detector 59 behave in a process of placing the ink cartridge 30 to the cartridge holder 110 in the third variation. In the description below, it is assumed that an amount of ink remaining in the ink chamber 36 is more than the amount of ink remaining in the ink chamber 36 in the near-empty state.

In a state where the ink cartridge 30 is not placed in the cartridge holder 110, the valve 77 of the ink cartridge 30 of the third variation is in the same or similar state to the valve 77 of the ink cartridge 30 of the illustrative embodiment.

When the valve 77 is located at the first position, the weight 125 is retained at the higher position by the support of the restriction member 88. When the weight 125 is located at the higher position, the detector 59 is located at the restricted position. In this state, the bottom surface 125A of the weight 125 is in contact with the restricted portion 138 of the second arm 128 of the detector 59.

When the detector 59 is located at the restricted position, the detected portion 129 is not located on the optical axis 111 extending between the light emitting portion and the light receiving portion of the sensor 103. Therefore, light outputted from the light emitting portion is allowed to reach the light receiving portion. Thus, when the detector 59 is located at the restricted position, the sensor 103 outputs a high-level signal to the controller 130.

While the ink cartridge 30 is not placed at a particular position in the cartridge holder 110, a corresponding cartridge sensor 107 is free from pressure of the front end 58 of the cartridge cover 33 of the ink cartridge 30. Therefore, the cartridge sensor 107 outputs a low-level signal to the controller 130.

In this state, the cover of the cartridge holder 110 is opened and then the ink cartridge 30 is inserted into the cartridge holder 110. That is, the ink cartridge 30 is placed at the particular portion in the cartridge holder 110. In other words, the ink cartridge 30 becomes in the use position.

Similar to the illustrative embodiment, when the ink cartridge 30 reaches a vicinity of the inner back surface 151 of the cartridge holder 110 by its movement in the insertion direction 51, the cartridge sensor 107 outputs a high-level signal to the controller 130. Thus, counting for measuring a moving time of the detector 59 is started. As the valve 77 receives an external force by pressing of the ink needle 102, the valve 77 moves from the first position to the second position, whereby ink is permitted to flow from the ink chamber 36 to the outside of the ink cartridge 30. Further, the ink chamber 36 comes in communication with the outside air, whereby the inside pressure of the ink chamber 36 changes from a negative pressure to the atmospheric pressure.

As depicted in FIG. 18B, as the valve 77 moves in the removal direction 52 from the first position to the second position, the restriction member 88 moves from the restrict position to the release position to separate from the first surface 141 of the weight 125 located at the higher position. Therefore, the weight 125 moves in the downward direction 53 toward the lower position from the higher position by force of gravity.

While the weight 125 moves from the higher position to the lower position, the weight 125 presses the detected portion 129 of the detector 59 downward. Thus, the detector 59 rotates toward the released position from the restricted position.

The weight 125 keeps moving in the downward direction 53 until the first surface 141 of the recess 143 comes into contact with the restriction member 88. FIG. 19A illustrates a state of the inside of the ink tank 32 after the weight 125 starts moving in the downward direction 53 and before the first surface 141 of the recess 143 comes into contact with the restriction member 88. At the time the first surface 141 of the recess 143 comes into contact with the restriction member 88, the detector 59 is located at the released position (refer to FIG. 19B).

When the detector 59 is located at the released position, the detected portion 116 is located between the light emitting portion and the light receiving portion of the sensor 103. That is, the detected portion 116 is located on the optical axis 111 extending between the light emitting portion and the light receiving portion of the sensor 103. Therefore, light outputted from the light emitting portion is not allowed to reach the light receiving portion. Thus, when the detector 59 is located at the released position, the sensor 103 outputs a low-level signal to the controller 130, whereby the counting for measuring the moving time of the detector 59 is ended. Through this process, the ink cartridge 30 is completely placed in the cartridge holder 110.

Hereinafter, a description will be provided on how the valve 77, the restriction member 88, the weight 125, and the detector 59 behave in a process of removing the ink cartridge 30 from the cartridge holder 110. In the description below, it is assumed that the amount of ink remaining in the ink chamber 36 is more than the amount of ink remaining in the ink chamber 36 in the near-empty state.

As depicted in FIG. 19B, in a state where the ink cartridge 30 is completely placed in the cartridge holder 110, the valve 77 is located at the second position by a pressing force of a corresponding ink needle 102. When the valve 77 is located at the second position, the restriction member 88 is located at the release position. When the restriction member 88 is located at the release position, the weight 125 is submerged in ink and located at the lower position by force of gravity. When the weight 125 is located at the lower position, the detector 59 is located at the released position.

As the ink cartridge 30 moves in the removal direction 52 for removing the ink cartridge 30 from the cartridge holder 110, the valve 77 separates from the ink needle 102, whereby the valve 77 moves from the second position to the first position by an urging force of a coil spring 87. As the valve 77 moves from the second position to the first position, the restriction member 88 moves from the release position to the restrict position together with the valve 77. The restriction member 88 moves from the release position to the restrict position while being in contact with the first surface 141 of the weight 125 from below. Thus, the weight 125 is pressed in the upward direction 54 by the restriction member 88, thereby moving from the lower position to the higher position. As the weight 125 separates from the detector 59 by its movement toward the higher position, the detector 59 rotates from the released position to the restricted position. Accordingly, the restriction member 88 allows the detector 59 to rotate toward the restricted position while the restriction member 88 moves from the release position to the restrict position.

[Fourth Variation]

In a fourth variation, another example configuration in which a detector 59 is movable from the restricted position to the released position using a downward movement of a weight 125 will be described. Common parts have the same reference numerals as those of the above-described illustrative embodiment or the third variation, and the detailed description of the common parts will be omitted.

Figure 20A:
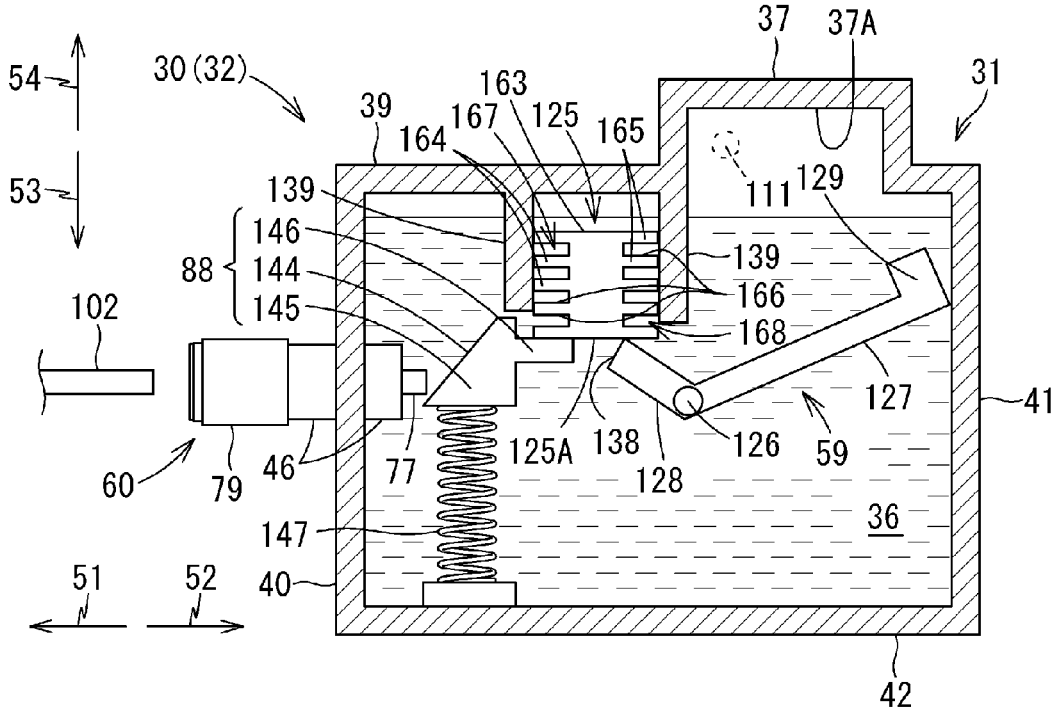
FIG. 20A is a schematic vertical cross-sectional view depicting an ink tank in a fourth variation of the illustrative embodiment according to one or more aspects of the disclosure, wherein a restriction member is located at a restrict position and a detector is located at a released position.
Figure 20B:
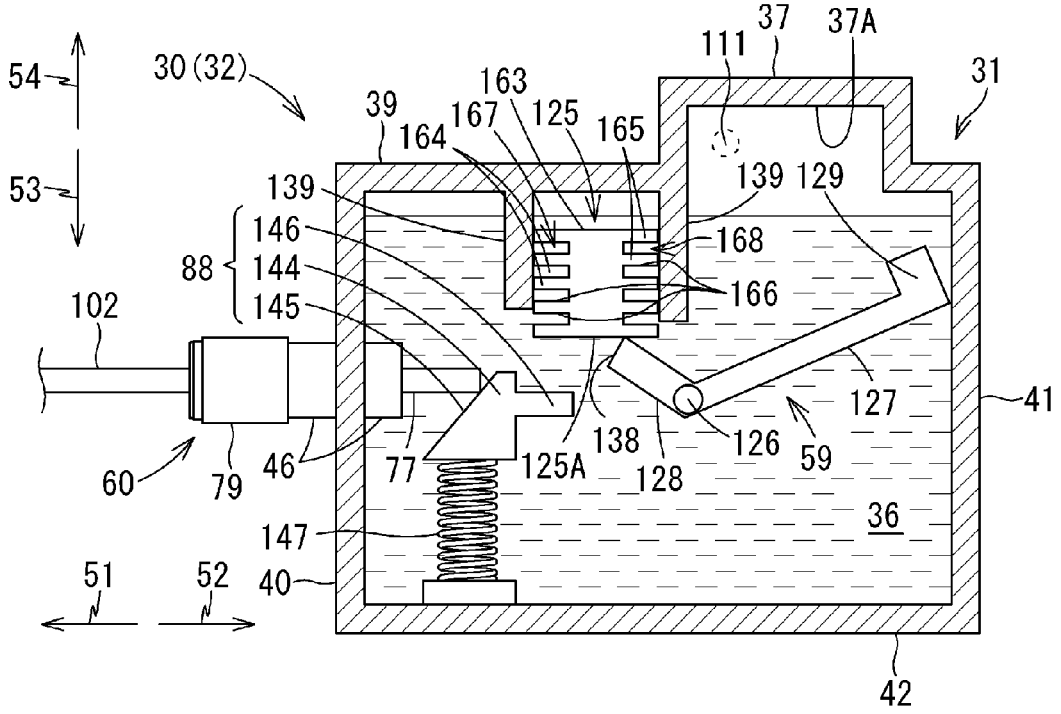
FIG. 20B is a schematic vertical cross-sectional view depicting the ink tank in the fourth variation of the illustrative embodiment according to one or more aspects of the disclosure, wherein the restriction member is located at a release position and the detector is located at the restricted position.

As depicted in FIGS. 20A and 20B, a detector 59 is disposed inside an ink chamber 36. The detector 59 is rotatably supported by a frame 31. The detector 59 of the fourth variation has a similar configuration to the detector 59 of the third variation, and therefore, a detailed description for the detector 59 of the fourth variation will be omitted.

A weight 125 may be made of material having a higher specific gravity than ink stored in the ink chamber 36. The weight 125 is supported by a restriction member 88 within the ink chamber 36. The weight 125 of the fourth variation has a similar configuration to the weight 125 of the third variation except that the weight 125 of the fourth variation does not have a cavity 140. Therefore, a detailed description for the weight 125 of the fourth variation will be omitted. The frame 31 of an ink tank 32 includes a guide member 139 that allows the weight 125 to move straightly in the vertical direction. The guide member 139 of the fourth variation also has a similar configuration to the guide member 139 of the third variation. Therefore, a detailed description for the guide member 139 of the fourth variation will be omitted.

As depicted in FIGS. 20A and 20B, the restriction member 88 is disposed inside the ink chamber 36. The restriction member 88 is disposed between a valve 77 and the detector 59 in the insertion-removal direction 5152.

The restriction member 88 includes a body 145 and a projecting portion 146. The body 145 has an inclined surface 144 that is angled relative to the removal direction 52 (e.g. a direction from the front wall 40 toward the rear wall 41) and extends upward in the removal direction 52. The projecting portion 146 protrudes from the body 145 in the removal direction 52.

A coil spring 147 (as another example of the urging member) is disposed between the restriction member 88 and a lower wall 42 of an ink tank 32 in the up-down direction 54, 53. The coil spring 147 has one end connected with the restriction member 88 and the other end connected with the lower wall 42. This configuration allows the restriction member 88 to move up and down as the coil spring 147 contracts and extends. In other variations, for example, a leaf spring may be used as the urging member, instead of the coil spring 147.

Figure 21A:
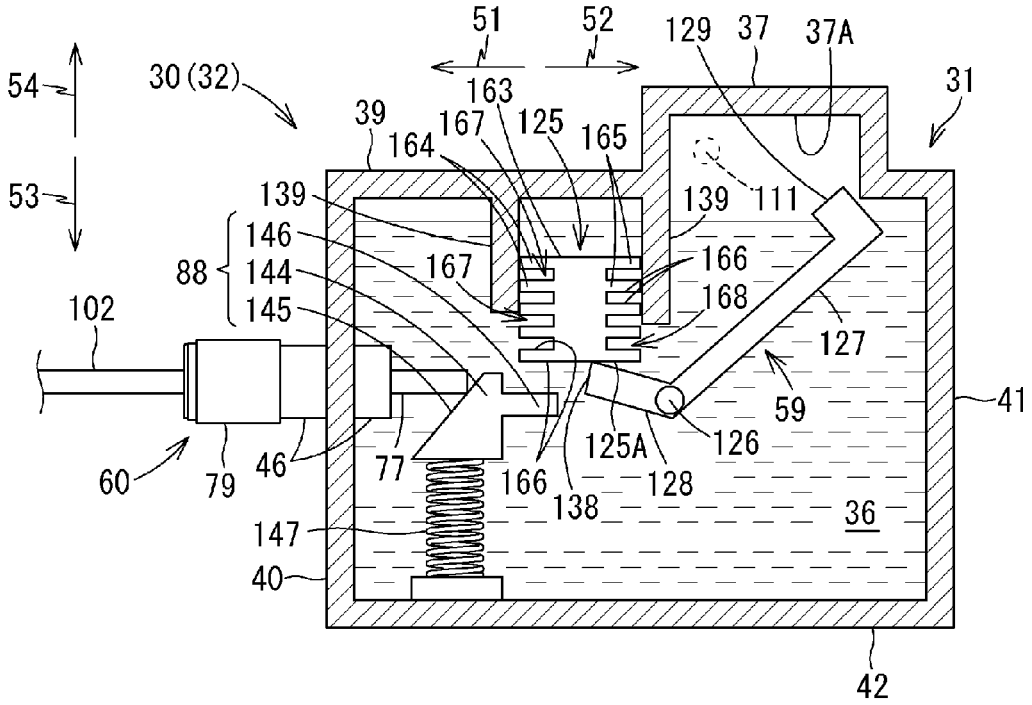
FIG. 21A is a schematic vertical cross-sectional view depicting the ink tank in the fourth variation of the illustrative embodiment according to one or more aspects of the disclosure, wherein the restriction member is located at the release position and the detector is located between the restricted position and a released position.
Figure 21B:
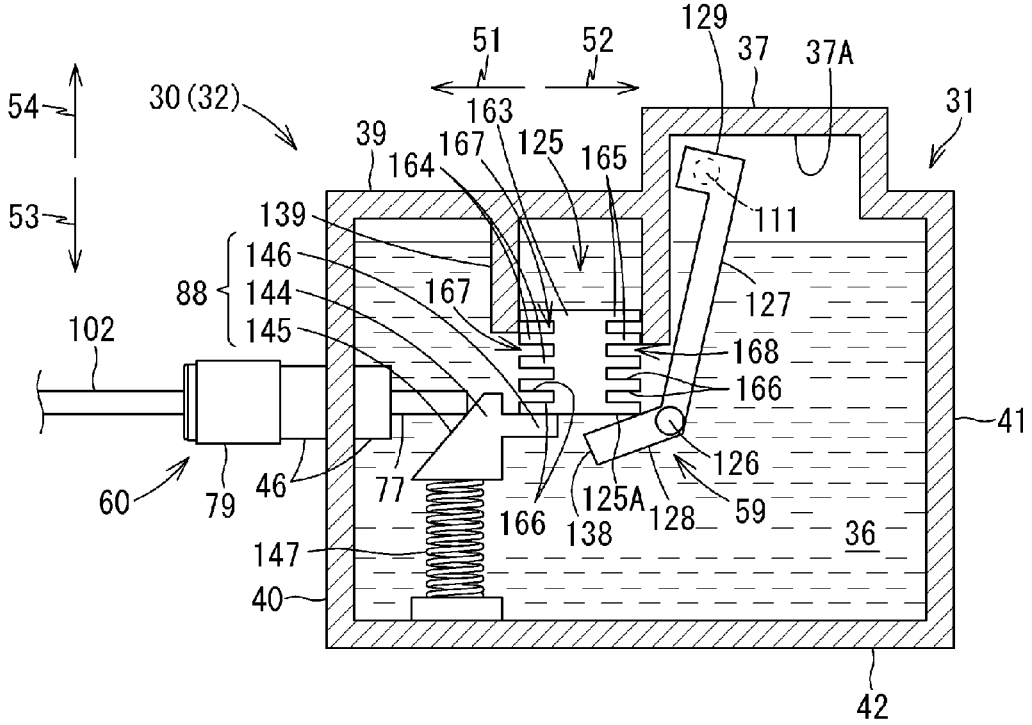
FIG. 21B is a schematic vertical cross-sectional view depicting the ink tank in the fourth variation of the illustrative embodiment according to one or more aspects of the disclosure, wherein the restriction member is located at the release position and the detector is located at the released position.
Figure 22A:
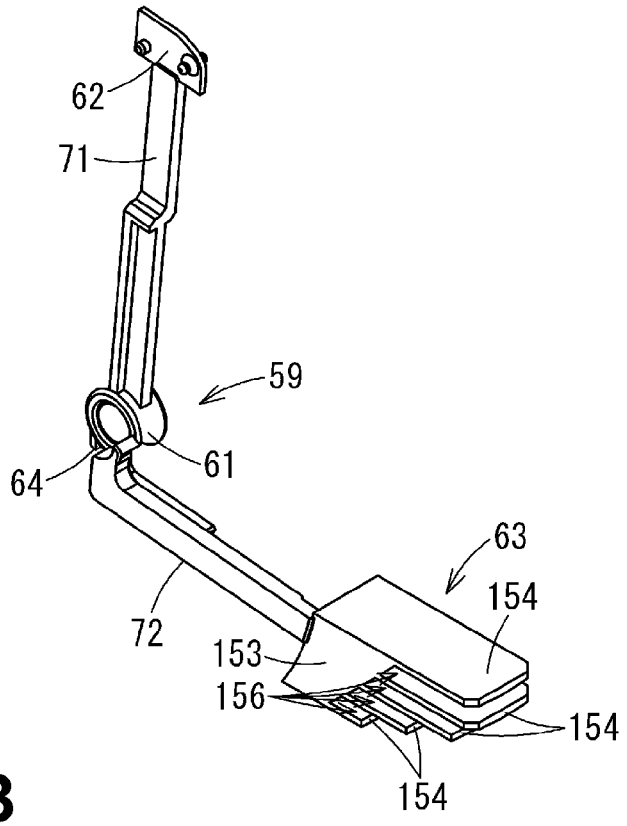
FIG. 22A is a perspective view depicting the detector including a float in the illustrative embodiment according to one or more aspects of the disclosure.
Figure 22B:
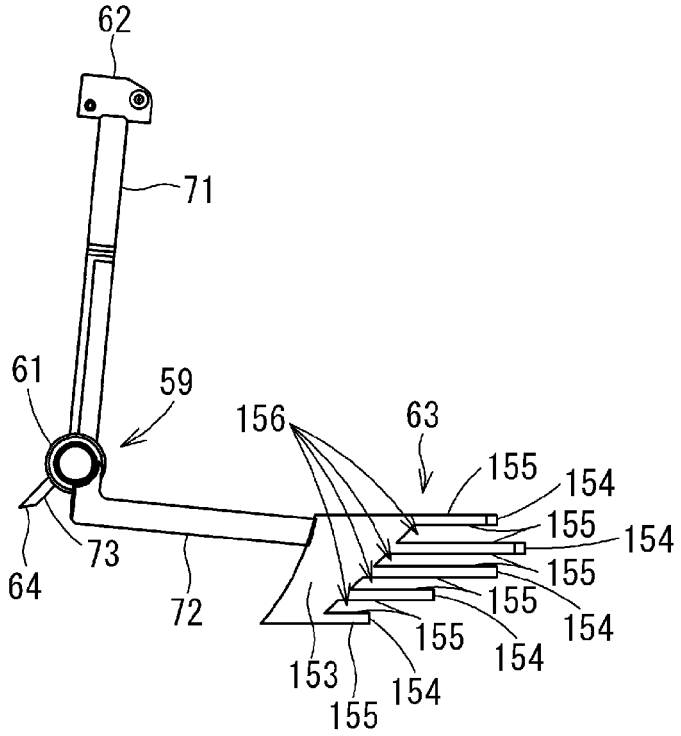
FIG. 22B is a side view depicting the detector including the float in the illustrative embodiment according to one or more aspects of the disclosure.

The restriction member 88 is movable between a restrict position (e.g., a position of the restriction member 88 depicted in FIG. 20A) and a release position (e.g., a position of the restriction member 88 depicted in FIG. 21B). The release position is lower than the restrict position. When the valve 77 is located at the first position, the restriction member 88 is located at the restrict position. When the valve 77 is located at the second position, the restriction member 88 is located at the release position. As the valve 77 moves from the first position to the second position, the restriction member 88 moves from the restrict position to the release position. As the valve 77 moves from the second position to the first position, the restriction member 88 moves from the release position to the restrict position.

When the restriction member 88 is located at the restrict position, the restriction member 88 supports the weight 125 by contacting a bottom surface 125A (more specifically, a lowermost fin 164 of the weight 125) of the weight 125 from below. Thus, the weight 125 is restricted from moving in the downward direction 53 from the higher position. In the fourth variation, for example, the movement of the weight 125 in the downward direction 53 from the higher position is restricted while the weight 125 is permitted to move only within backlash or play at the higher position. The restriction member 88 might not necessarily restrict the movement of the weight 125 in the upward direction 54 from the higher position. The movement of the weight 125 is restricted, whereby the detector 59 does not move from the restricted position. That is, the restriction member 88 restricts the movement of the detector 59 from the restricted position indirectly.

When the restriction member 88 is located at the release position, the restriction member 88 is located separate from the bottom surface 125A of the weight 125 located at the higher position. Therefore, in this state, the weight 125 is permitted to move in the downward direction 53 by force of gravity. That is, when the restriction member 88 is located at the release position, the restriction member 88 permits the weight 125 to move from the higher position to the lower position. As the weight 125 moves from the higher position to the lower position, the detector 59 rotates from the restricted position to the released position by downward pressing of the weight 125. That is, when the restriction member 88 is located at the release position, the restriction member 88 permits the movement of the detector 59.

Hereinafter, a description will be provided on how the valve 77, the restriction member 88, the weight 125, and the detector 59 behave in a process of placing the ink cartridge 30 to the cartridge holder 110 in the fourth variation. In the description below, it is assumed that an amount of ink remaining in the ink chamber 36 is more than the amount of ink remaining in the ink chamber 36 in the near-empty state.

In a state where the ink cartridge 30 is not placed in the cartridge holder 110, the valve 77 of the ink cartridge 30 of the fourth variation is in the same or similar state to the valve 77 of the ink cartridge 30 of the illustrative embodiment.

When the valve 77 is located at the first position, the weight 125 is retained at the higher position by the support of the restriction member 88. When the weight 125 is located at the higher position, the detector 59 is located at the restricted position. In this state, the bottom surface 125A of the weight 125 is in contact with the restricted portion 138 of the second arm 128 of the detector 59.

When the detector 59 is located at the restricted position, the detected portion 129 is not located on the optical axis 111 extending between the light emitting portion and the light receiving portion of the sensor 103. Therefore, light outputted from the light emitting portion is allowed to reach the light receiving portion. Thus, when the detector 59 is located at the restricted position, the sensor 103 outputs a high-level signal to the controller 130.

While the ink cartridge 30 is not placed at a particular position in the cartridge holder 110, a corresponding cartridge sensor 107 is free from pressure of the front end 58 of the cartridge cover 33 of the ink cartridge 30. Therefore, the cartridge sensor 107 outputs a low-level signal to the controller 130.

In this state, the cover of the cartridge holder 110 is opened and then the ink cartridge 30 is inserted into the cartridge holder 110. That is, the ink cartridge 30 is placed at the particular portion in the cartridge holder 110. In other words, the ink cartridge 30 becomes in the use position.

Similar to the illustrative embodiment, when the ink cartridge 30 reaches a vicinity of the inner back surface 151 of the cartridge holder 110 by its movement in the insertion direction 51, the cartridge sensor 107 outputs a high-level signal to the controller 130. Thus, counting for measuring a moving time of the detector 59 is started. As the valve 77 receives an external force by pressing of the ink needle 102, the valve 77 moves from the first position to the second position, whereby ink is permitted to flow from the ink chamber 36 to the outside of the ink cartridge 30. Further, the ink chamber 36 comes in communication with the outside air, whereby the inside pressure of the ink chamber 36 changes from a negative pressure to the atmospheric pressure.

As depicted in FIG. 20B, as the valve 77 moves in the removal direction 52 from the first position to the second position, the inclined surface 144 of the restriction member 88 is pressed by the valve 77. That is, the valve 77 moves from the first position to the second position while being in contact with the inclined surface 144 from above. Thus, the restriction member 88 moves in the downward direction 53 from the restrict position toward the release position against an urging force of a coil spring 147. In this state, the coil spring 147 urges the restriction member 88 upward in the vertical direction toward the restrict position. The restriction member 88 moves toward the release position to separate from the weight 125 located at the higher position. Therefore, the weight 125 moves in the downward direction 53 from the higher position to the lower position by force of gravity.

While the weight 125 moves from the higher position to the lower position, the weight 125 presses the detected portion 129 of the detector 59 downward. Thus, the detector 59 rotates toward the released position from the restricted position.

The weight 125 keeps moving in the downward direction 53 until the bottom surface 125A of the weight 125 comes into contact with a projecting portion 146 of the restriction member 88. FIG. 21A illustrates a state of the inside of the ink tank 32 after the weight 125 starts moving in the downward direction 53 and before the bottom surface 125A comes into contact with the restriction member 88. At the time the bottom surface 125A comes into contact with the restriction member 88, the detector 59 is located at the released position (refer to FIG. 21B).

When the detector 59 is located at the released position, the detected portion 116 is located between the light emitting portion and the light receiving portion of the sensor 103. That is, the detected portion 116 is located on the optical axis 111 extending between the light emitting portion and the light receiving portion of the sensor 103. Therefore, light outputted from the light emitting portion is not allowed to reach the light receiving portion. Thus, when the detector 59 is located at the released position, the sensor 103 outputs a low-level signal to the controller 130, whereby the counting for measuring the moving time of the detector 59 is ended.

Through this process, the ink cartridge 30 is completely placed in the cartridge holder 110.

Hereinafter, a description will be provided on how the valve 77, the restriction member 88, the weight 125, and the detector 59 behave in a process of removing the ink cartridge 30 from the cartridge holder 110. In the description below, it is assumed that the amount of ink remaining in the ink chamber 36 is more than the amount of ink remaining in the ink chamber 36 in the near-empty state.

As depicted in FIG. 21B, in a state where the ink cartridge 30 is completely placed in the cartridge holder 110, the valve 77 is located at the second position by a pressing force of a corresponding ink needle 102. When the valve 77 is located at the second position, the restriction member 88 is located at the release position. When the restriction member 88 is located at the release position, the weight 125 is submerged in ink and located at the lower position by force of gravity. When the weight 125 is located at the lower position, the detector 59 is located at the released position.

As the ink cartridge 30 moves in the removal direction 52 for removing the ink cartridge 30 from the cartridge holder 110, the valve 77 separates from the ink needle 102, whereby the valve 77 moves from the second position to the first position by an urging force of a coil spring 87. As the valve 77 moves from the second position to the first position, the restriction member 88 moves in the upward direction 54 from the release position to the restrict position by the urging force of the coil spring 121. While the restriction member 88 moves in the upward direction 54, the projecting portion 146 of the restriction member 88 presses the bottom surface 125A of the weight 125 in the upward direction 54. Thus, the weight 125 moves from the lower position to the higher position. As the weight 125 separates from the detector 59 by its movement toward the higher position, the detector 59 rotates from the released position to the restricted position. Accordingly, the restriction member 88 allows the detector 59 to rotate toward the restricted position while the restriction member 88 moves from the release position to the restrict position.

[Other Variations]

Figure 23:
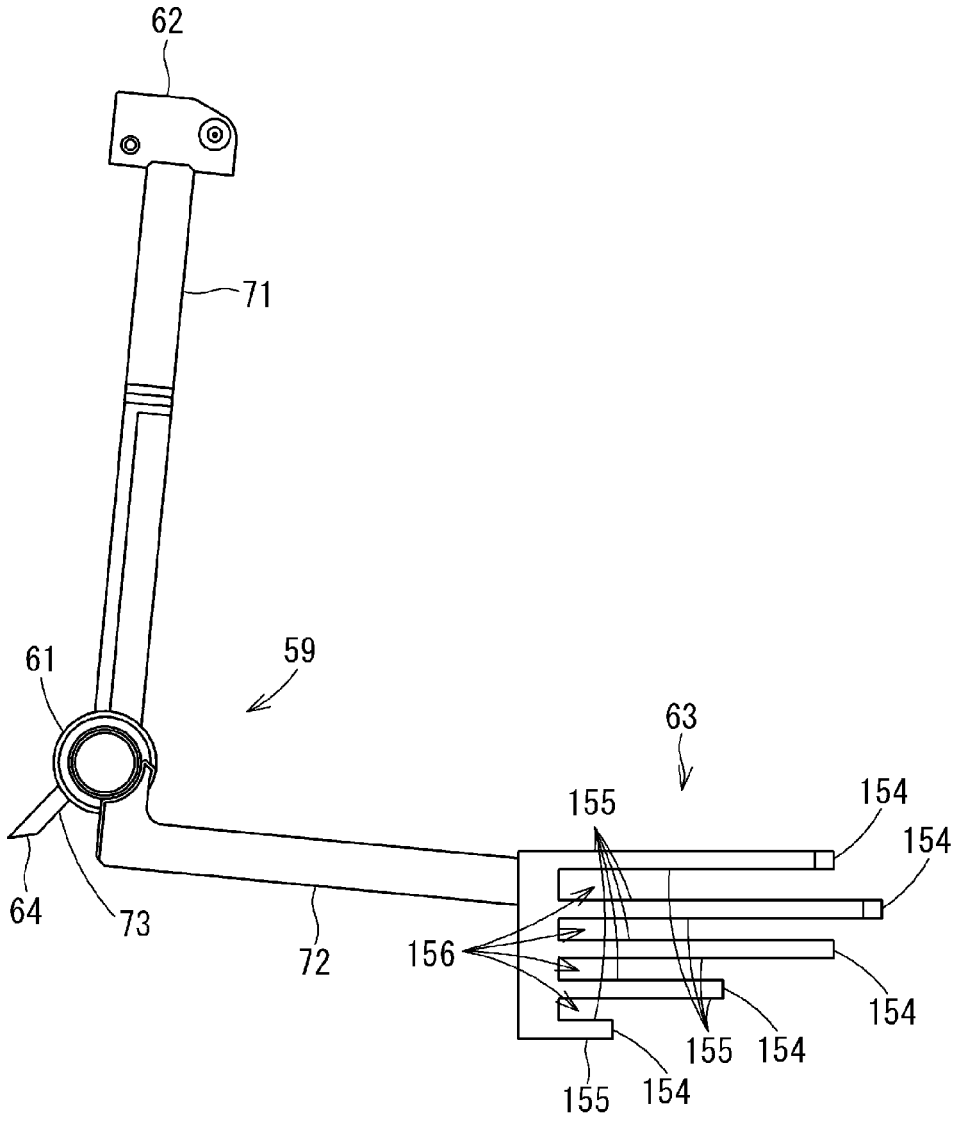
FIG. 23 is a side view depicting a detector including a float which itself is a plurality of fins in another variation of the illustrative embodiment according to one or more aspects of the disclosure.

In the illustrative embodiment, the float 63 includes the body 153 and the plurality of fins 154. Nevertheless, the float 63 might not necessarily include the body 153. In other variations, for example, as depicted in FIG. 23, a float 63 itself may be a plurality of fins 154.

Figure 24:
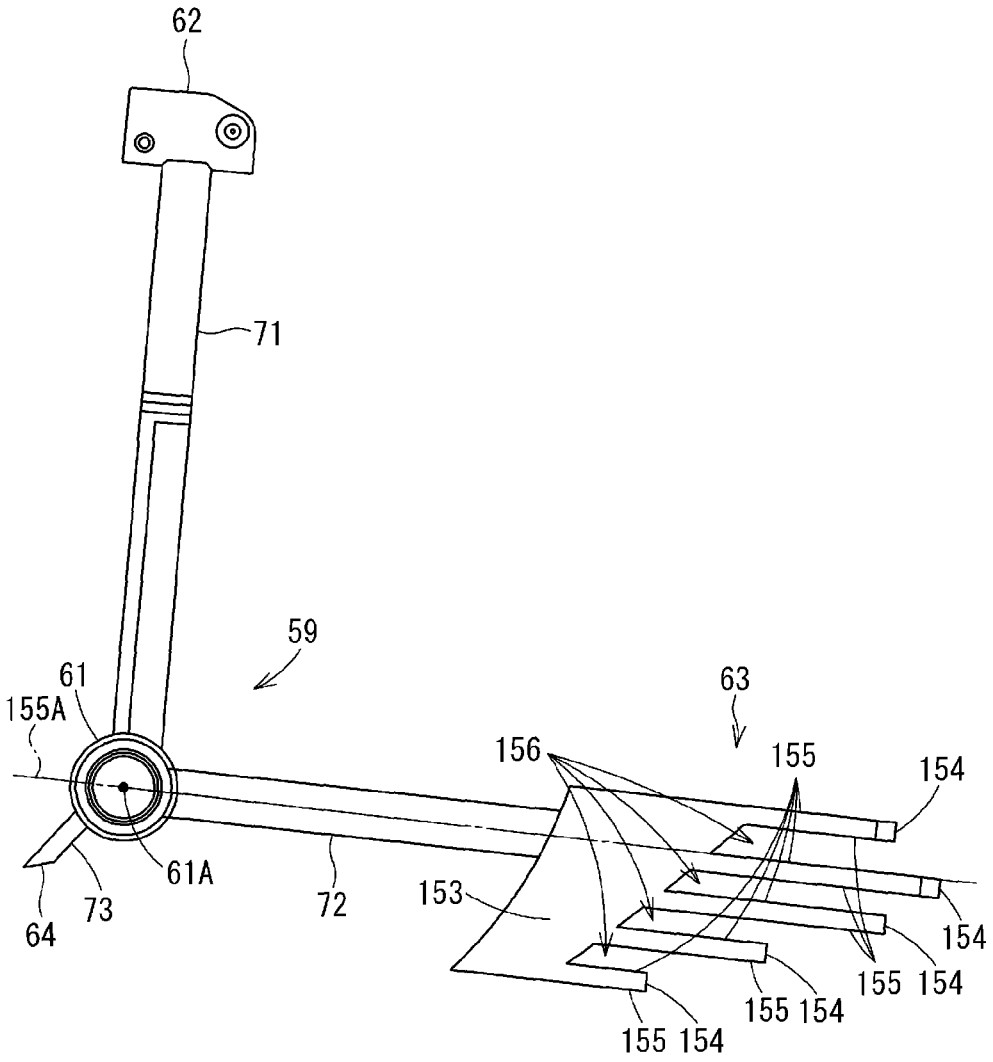
FIG. 24 is a side view depicting a detector whose axis is in an imaginary plane in still another variation of the illustrative embodiment according to one or more aspects of the disclosure.

In other variations, for example, as depicted in FIG. 24, a detector 59 may have a rotation axis 61A on an extension of a surface 155 of a longest fin 154 extending from a body 153 of a float 63. In one example, the rotation axis 61A of the detector 59 may be in an imaginary plane 155A including a surface 155 having the largest area among a plurality of surfaces 155.

According to the example depicted in FIG. 24, many fins 154 may be provided in a small space, e.g., an ink chamber 36. The fin 154 that is capable of generating resistance to rotation of the detector 59 most efficiently may have the largest area (or size) among the plurality of fins 154, thereby improving accuracy of the ink viscosity estimation.

Figure 25A:
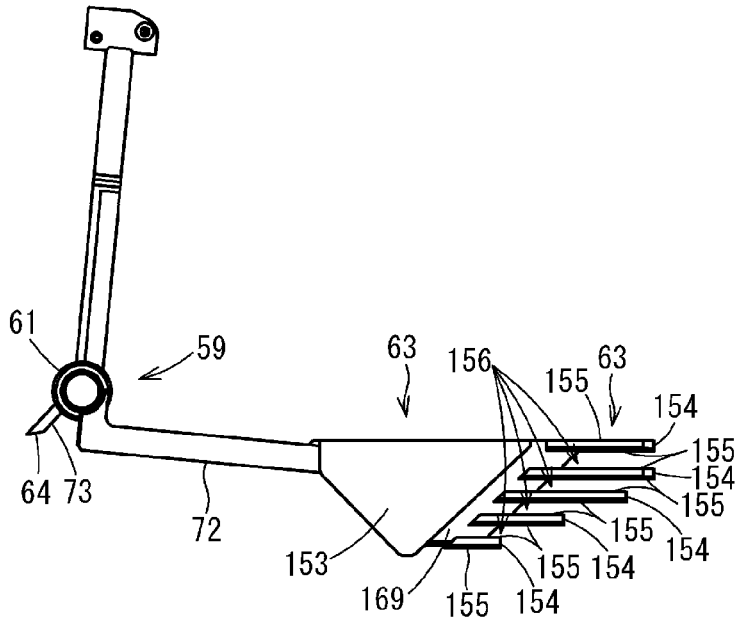
FIG. 25A is a side view depicting a detector including a connector in yet another variation of the illustrative embodiment according to one or more aspects of the disclosure.
Figure 25B:
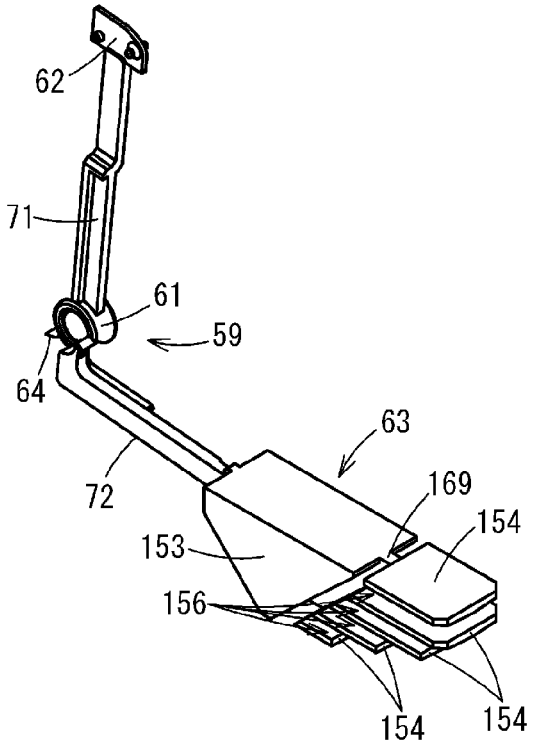
FIG. 25B is an upper perspective view depicting the detector including the connector in the yet other variation of the illustrative embodiment according to one or more aspects of the disclosure.

In the illustrative embodiment, the float 63 includes the body 153 and the fins 154 that are directly connected with each other. Nevertheless, in other variations, for example, as depicted in FIGS. 25A and 25B, a float 63 may include a connector 169 that may connect between a body 153 and a plurality of fins 154. In one example, the plurality of fins 154 may be connected with the body 153 of the float 63 via the connector 169 that may extend from the body 153 of the float 63. The connector 169 may have one end connected with the body 153 and the other end connected with the plurality of fins 154.

The connector 169 may have a dimension in the right-left direction 5556 smaller than a dimension of the body 153 in the right-left direction 5556 and a dimension of the plurality of fins 154 in the right-left direction 5556. The right-left direction 5556 may be parallel to an axis of a detector 59. That is, the connector 169 may have a width narrower than a width of the plurality of fins 154 in a direction parallel to the axis of the detector 59.

In the illustrative embodiment, each of the recesses 156 defined by each adjacent two of the plurality of fins 154 is open at the one end that faces the direction toward which the ink cartridge 30 is removed, and at the right and left ends when the ink cartridge 30 is in the use position and the detector 59 is located at the restricted position. Nevertheless, the directions that each of the recesses 156 is open are not limited to the example three directions of the illustrative embodiment. In other variations, for example, similar to the float 63 including the connector 169 of one of the other variations, a float 63 may have a plurality of recesses 156, each of which defined by each adjacent two of a plurality of fins 154 may be open also at an end that may face the direction toward which an ink cartridge 30 may be inserted (e.g., the direction at which the connector 169 may be disposed), in addition to the above-described three directions. In other variations, for example, each of the recesses 156 may be open at at least an upper end or a lower end.

In a case where each recess 156 is open at its upper end, air bubbles staying in each recess 156 may be easily released therefrom. Therefore, this configuration may prevent or reduce a change in a moving speed of a detector 59 that may be caused by adhesion of air bubbles to the float 63.

In the illustrative embodiment, each of the recesses 156 is open at the right and left opposite ends. Nevertheless, in other variations, for example, each recess 156 may be open at upper and lower opposite ends or at other opposite ends, one of which faces the direction toward which an ink cartridge 30 may be inserted and the other of which faces the direction toward which the ink cartridge 30 may be removed.

In the illustrative embodiment, each of the surfaces 155 of the fins 154 functions as a resist surface that causes resistance to the rotation of the detector 59. Nevertheless, in other variation, for example, another surface may function as the resist surface.

Figure 26A:
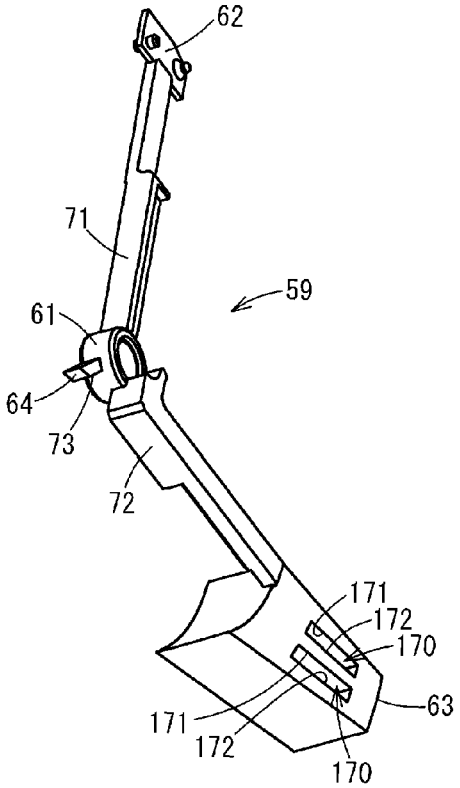
FIG. 26A is a perspective view depicting a detector including a float having through holes in a further variation of the illustrative embodiment according to one or more aspects of the disclosure.

In one example, as depicted in FIG. 26A, a float 63 may have at least one through hole 170 (in the example of FIG. 26A, the float 63 has two through holes 170) which may be defined by a plurality of surfaces. Of the surfaces defining the through hole 170, each of surfaces 171 and 172 that may face either one of the directions toward which a detector 59 may rotate may function as the resist surface.

Figure 26B:
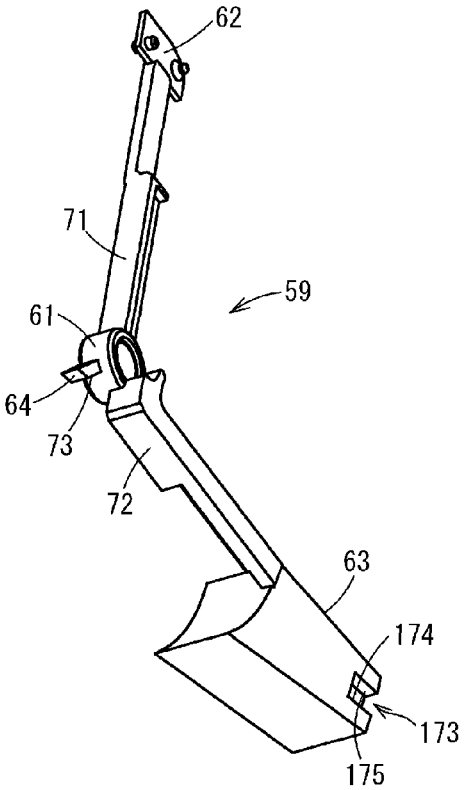
FIG. 26B is a perspective view depicting a detector including a float having a recess in a still further variation of the illustrative embodiment according to one or more aspects of the disclosure.

In other variations, for example, as depicted in FIG. 26B, a float 63 may have at least one recess 173 (in the example of FIG. 26B, the float 63 has a single recess 173) defined by a plurality of surfaces. Of the surfaces defining the recess 173, each of surfaces 174 and 175 that may face either one of the directions toward which a detector 59 may rotate may function as the resist surface.

In the illustrative embodiment, the detection portion 62 is always located within the ink chamber 36 irrespective of the position of the detector 59. Nevertheless, in other variations, for example, a detection portion 62 may have another configuration as long as the detector 59 is configured to block light outputted from the light emitting portion of the sensor 103 to the light receiving portion of the sensor 103 when the detector 59 is located at the released position. In one example, a detection portion 62 may be configured to be located outside the ink chamber 36 when the detector 59 is located at the restricted position. The detection portion 62 may be further configured to enter the inside of the ink chamber 36 while a detector 59 moves from the restricted position to the released position. In still other variations, a detection portion 62 may be located outside of the ink chamber 36 at all times irrespective of the position of a detector 59.

In the illustrative embodiment, the measurement of the moving time of the detector 59 is started when the ink cartridge 30 is completely placed at a particular portion in the cartridge holder 110 (e.g., when the cartridge sensor 107 outputs a high-level signal). Through use of the existing sensor (e.g., the cartridge sensor 107), the processing for estimating the ink viscosity may be implemented without changing the configuration of the ink supply unit 100 significantly. Nevertheless, in other variations, for example, the measurement of the moving time of the detector 59 may be started at any arbitrary timing that the controller 130 may detect.

Figure 27A:
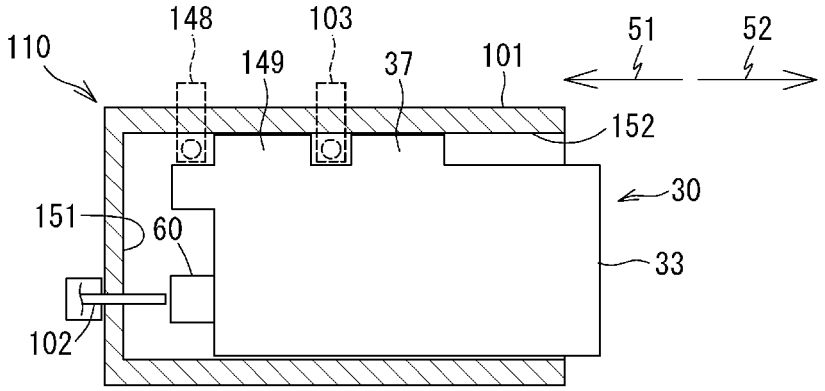
FIGS. 27A and 27B are vertical cross-sectional views each depicting a cartridge holder including a plurality of sensors, and an ink cartridge including a plurality of raised portions in yet further variation of the illustrative embodiment according to one or more aspects of the disclosure.
Figure 27B:
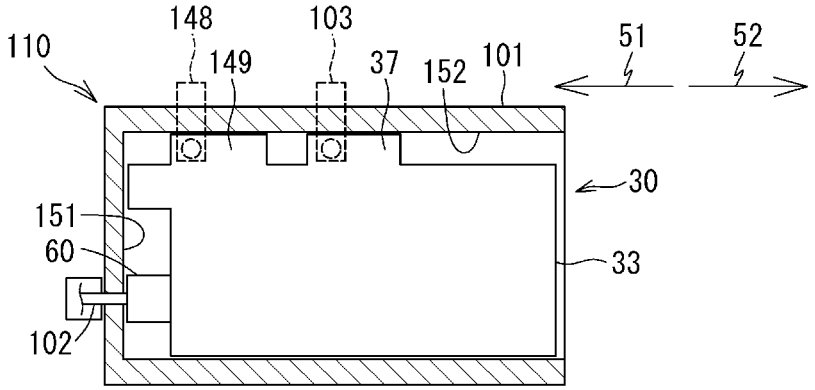

In one example, as depicted in FIGS. 27A and 27B, a cartridge holder 110 may further include another sensor 148 in addition to a sensor 103. The sensor 148 may be disposed at an inner top surface 152 of a casing 101 of the cartridge holder 110. The sensor 148 may be disposed closer to the inner back surface 151 than the sensor 103. An ink cartridge 30 may further include another raised portion 149 at an cartridge cover 30 in addition to a light-transparent raised portion 37. The raised portion 149 may be made of material capable of blocking light. The raised portion 149 may be configured to block light outputted from a light emitting portion in the same or similar manner to the detection portion 62 of the illustrative embodiment. The raised portion 149 may be spaced from the raised portion 37 in the insertion direction 51. The controller 130 may start counting for measuring a moving time of a detector 59 when the sensor 148 is covered by the light-blocking raised portion 149 (e.g., when an ink cartridge 30 reaches a position of FIG. 27B from a position of FIG. 27A). The controller 130 may end the counting for measuring the moving time of the detector 59 when the sensor 103 is covered by a detection portion 62. In this case, four sensors 148 may be provided for four ink cartridges 30 similar to the illustrative embodiment.

Figure 28A:
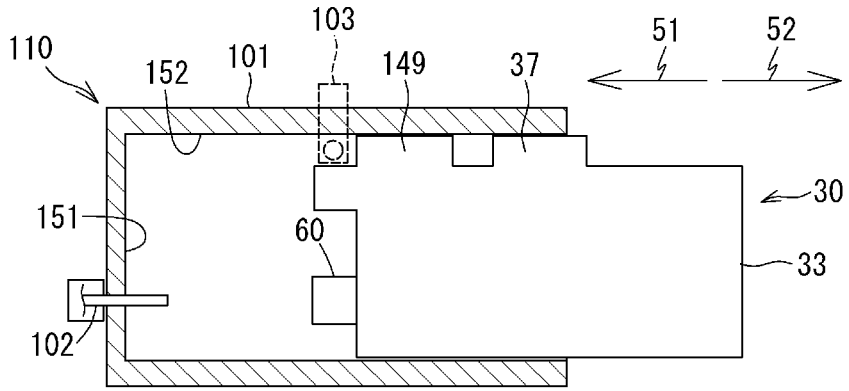
FIGS. 28A, 28B, and 28C are vertical cross-sectional views each depicting a cartridge holder including a sensor and an ink cartridge including a plurality of raised portions in other variation of the illustrative embodiment according to one or more aspects of the disclosure.
Figure 28B:
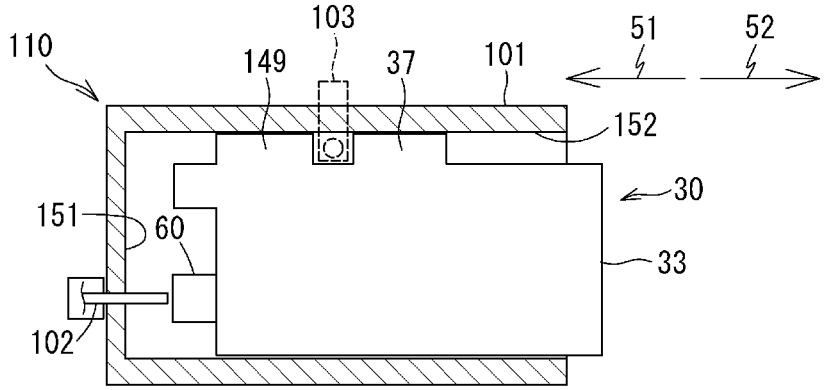
Figure 28C:
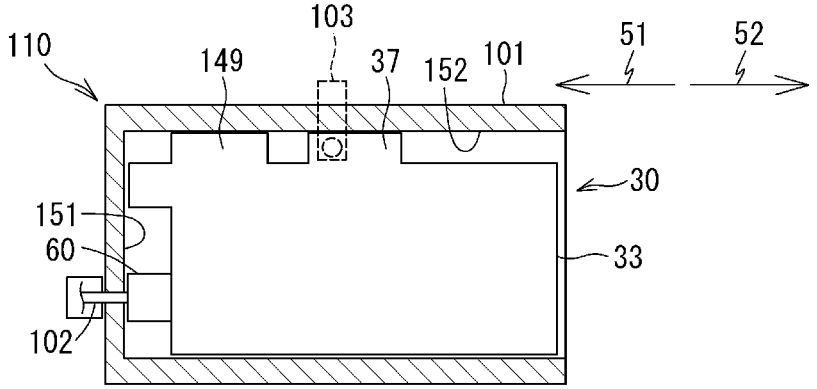

In another example, as depicted in FIGS. 28A, 28B, and 28C, an ink cartridge 30 may further include another raised portion 149 at a cartridge cover 33 in addition to a light-transparent raised portion 37. The raised portion 149 may be made of material capable of blocking light. The raised portion 149 may be configured to block light outputted from a light emitting portion in the same or similar manner to the detection portion 62 of the illustrative embodiment. The raised portion 149 may be spaced from the raised portion 37 in the insertion direction 51. The controller 130 may start counting for measuring a moving time of a detector 59 when the sensor 103 is revealed after the sensor 103 is covered by the light-blocking raised portion 149 (e.g., when an ink cartridge 30 reaches a position of FIG. 28B from a position of FIG. 28A). The controller 31 may end the counting for measuring the moving time of the detector 59 when the sensor 103 is covered by a detection portion 62. At the time of ending the counting for measuring the moving time of the detector 59, the ink cartridge 30 is located at a position of FIG. 28C. In this case, four sensors 148 may be provided for four ink cartridges 30 similar to the illustrative embodiment.

In the illustrative embodiment, when the controller 130 determines that the moving time is out of the threshold range (e.g., NO in step S18), the operation of the recording head 21 is restricted, e.g., the routine skips step S36. Therefore, this control may reduce or prevent an occurrence of a problem in the recording head 21 due to ejection of ink whose viscosity has been greatly changed. Nevertheless, the processing of step S36 might not necessarily be skipped. In one example, the controller 130 may execute the processing of notifying an abnormality of the ink viscosity (e.g., step S37) and it may be left up to a user to determine whether to proceed to operate the recording head 21. In this case, the control routine of the controller 130 may be different from the control routine of FIGS. 9, 10, and 11 of the illustrative embodiment. However, a detailed description for this example will be omitted.

In another example, when the controller 130 determines that the abnormal flag is "ON" (e.g., YES in step S32), the controller 130 may control the head control board 21A to control the level of a drive voltage to be applied to the piezoelectric elements 29A for the nozzles 29 in the image recording of step S36 without skipping the processing of steps S35 and S36.

More specifically, the controller 130 may change a control signal to be outputted to the head control board 21A to control the level of a drive voltage to be applied to the piezoelectric elements 29A such that the amount of ink to be ejected from each nozzle 29 is substantially the same in both of a case in which the moving time is included within the threshold range and a case in which the moving time is out of the threshold range. For example, when the moving time is below the lower limit of the threshold range (e.g., when the ink viscosity is too low), the controller 130 may control the level of the drive voltage to be applied to the piezoelectric elements 29A to be lower than the level of the drive voltage to be applied when the moving time is included within the threshold range. When the moving time exceeds the upper limit of the threshold range (e.g., when the ink viscosity is too high), the controller 130 may control the level of the drive voltage to be applied to the piezoelectric elements 29A to be higher than the level of the drive voltage to be applied when the moving time is included within the threshold range.

According to the above configuration, in a case where various types of ink cartridges 30 each storing ink having viscosity different from one another are placed simultaneously in the cartridge holder 110, a drive voltage having an appropriate level may be applied to each of the piezoelectric elements 29A in accordance of the ink type. In the illustrative embodiment, the plurality of piezoelectric elements 29A is used as an example of an actuator. Nevertheless, in other variations, for example, a thermal actuator may be used. In this case, the thermal actuator may be configured to generate air bubbles in ink by heat and cause the nozzles 29 to eject ink therefrom.

The viscosity of ink stored in an ink cartridge 30 may change under the influence of the temperature surrounding the ink cartridge 30. More specifically, the ink viscosity tends to become lower with higher temperature and become higher with lower temperature. In the illustrative embodiment, the controller 130 controls the head control board 21A to control the level of drive voltage to be applied to the piezoelectric elements 29A in accordance with the temperature. More specifically, when the ambient temperature is relatively high, the controller 130 outputs a particular control signal to the head control board 21A such that a relatively low drive voltage is applied to the piezoelectric elements 29A. When the ambient temperature is relatively low, the controller 130 outputs another control signal to the head control board 21A such that a relatively high drive voltage is applied to the piezoelectric elements 29A. There is an optimal threshold of ink viscosity corresponding to drive voltage to be applied to the piezoelectric elements 29A. Therefore, it may be preferable that the threshold range of ink viscosity may be determined in accordance with the temperature. In the illustrative embodiment, an appropriate threshold range is determined in accordance with the temperature. The manner of determining an appropriate threshold range is not limited to the specific example. In one example, a threshold range appropriate for the temperature may be selected from a plurality of threshold ranges prestored in the ROM 132. In another example, an upper limit or a lower limit of the threshold range may be calculated using a function using the temperature as an input parameter. In other variations, a drive voltage to be applied to the piezoelectric element 29A might not be controlled in accordance with the temperature. In this case, the processing of step S17 in which the threshold range is determined based on a signal outputted from the temperature sensor 106 may be omitted, and a fixed threshold range may be used.

In the illustrative embodiment, the controller 130 measures the moving time of the detector 59 by counting. More specifically, the controller 130 starts counting in response to output of a high-level signal from the cartridge sensor 107 and ends the count of the measurement in response to output of a low-level signal from the sensor 103. Then, the controller 130 determines the time elapsed from the start of the count to the end of the count as the moving time of the detector 59. Nevertheless, in other variations, for example, a controller 130 may determine by taking a difference between the time at which the cartridge sensor 107 outputs a high-level signal and the time at which the sensor 103 outputs a low-level signal as the moving time of the detector 59.

In the illustrative embodiment, the controller 130 stores the abnormal flag in the EEPROM 134. Nevertheless, in other variations, for example, a controller 130 may store the abnormal flag in a memory of an integrated circuit mounted on an ink cartridge 30. In the illustrative embodiment, the controller 130 includes both the CPU 131 and the ASIC 135. Nevertheless, in other variations, a controller 130 may include an ASIC 135 only. All processing of FIGS. 9, 10, and 11 may be executed by a CPU 131 that reads appropriate programs from the ROM 132. In still other variations, a controller 130 may include hardware only, for example, an ASIC 135 or a field-programmable gate array ("FPGA") but not include a CPU 131. In yet other variations, a controller 130 may include a plurality of CPUs 131 and/or a plurality of ASICs 135.

In the illustrative embodiment, ink is used as an example of liquid. Nevertheless, in other variations, a pretreatment liquid to be ejected onto a recording sheet prior to ink ejection at the time of printing may be used as an example of the liquid, instead of ink.

What is claimed is:

1. A liquid cartridge comprising:

a liquid chamber;

a liquid outlet configured to supply the liquid from an interior of the chamber to an exterior of the liquid chamber;

a body positioned in the chamber being movable between a first position wherein movement of the body is restricted, and a second position wherein the body is movable along a movement path between the first and second positions, the body having a plurality of sides;

a detector positioned in the chamber movable in response to movement of the body between the first and second positions;

a plurality openings defined in the body and extending into the body through at least two sides of the body;

a plurality of resist surfaces formed by the plurality of openings, the resist surfaces being configured to resist movement of the body between the first and second positions.

2. The liquid cartridge of claim 1, wherein the plurality of sides of the body include:

an upper side;

a lower side spaced apart from the lower side;

a front side extending between the upper side and the lower side, the outlet extending through the front side; and a rear side spaced apart from the front side extending between the upper side and the lower side, wherein the liquid chamber liquid is positioned between the front and rear sides and the upper and lower sides.

3. The liquid cartridge of claim 2, wherein the body is a float having a lower specific gravity than ink stored in the ink chamber, and wherein the first position is lower than the second position.

4. The liquid cartridge according to claim 3, a first arm extending between an axis and the detector, wherein the first arm is rotatable around the axis, a second arm extending between the axis and the float, wherein the second arm is rotatable around the axis.

5. The liquid cartridge of claim 2, wherein the body is a weight having a higher specific gravity than ink stored in the ink chamber, and wherein the first position is higher than the second position.

6. The liquid cartridge of claim 2, wherein the body includes:

a first side surface;

a second side surface spaced apart from the first side surface;

a rear surface extending between the first and second side surfaces, the rear surface facing the rear side;

a front surface extending between the first and second side surfaces, the front surface facing the front side;

wherein at least one of the first side surface, the second side surface and the rear surface define the plurality of openings.

7. The liquid cartridge of claim 6, wherein the plurality of openings extend through the first side surface, the second side surface and the rear surface.

8. The liquid cartridge of claim 6, wherein the first side surface and the second side surface each define at least one of the plurality of openings.

9. The liquid cartridge of claim 6, wherein plurality of openings extend through the body from the first side surface to the second side surface.

10. The liquid cartridge of claim 6, wherein the rear surface defines the plurality of openings.

11. The liquid cartridge of claim 6, wherein the plurality of openings extend through the first side surface, the second side surface and the front surface.

12. The liquid cartridge of claim 6, wherein the plurality of openings extend through the first side surface, the second side surface, the rear surface, and the front surface.

13. The liquid cartridge according to claim 6, wherein the body includes a rear portion disposed at the rear surface, wherein the rear portion of the body defines a plurality of fins spaced apart from one another, each of fins extending in a direction that intersects the movement path of the body, each of the fins having the resist surfaces;

wherein the body includes a front portion disposed at the front surface, and wherein the body further comprises a connector that connects the front portion of the body with the plurality of fins.

14. The liquid cartridge according to claim 13, wherein a width of the connector is smaller than a width of the fins.

15. The liquid cartridge according to claim 2, wherein the body defines a plurality of fins spaced apart from one another, each of fins extending in a direction that intersects the movement path of the body, each of the fins having the resist surfaces.

16. The liquid cartridge according to claim 1, wherein the resist surfaces are flat surfaces extending parallel to each other.

17. The liquid cartridge according to claim 1, an valve being movable between a first position in which the liquid outlet is closed, and a second position in which the liquid outlet is open;

the detector being movable from a first position and a second position in response to movement of the valve from the closed to the open position;

the detector being movable from a first position and a second position in response to movement of the actuator from the closed to the open position; and the detector being movable from the second position to the first position in response to movement of the valve from the open to the closed position.

18. The liquid cartridge according to claim 1 further comprising at least one guide extending parallel to the movement path, wherein the guide contacts the body.

19. The liquid cartridge according to claim 1, wherein the body defines a cavity that includes an inclined surface, wherein the valve includes a restriction member configured to contact the inclined surface.

20. The liquid cartridge according to claim 1, wherein the body is biased in the first position.

21. A liquid cartridge comprising:

a liquid chamber;

a liquid outlet configured to supply the liquid from an interior of the chamber to an exterior of the liquid chamber;

a detector;

means for moving the detector between a first position and a second position.

22. The liquid cartridge according to claim 21, wherein the means for moving the detector includes means for resisting movement of the means for moving the body between the first and second positions.

23. The liquid cartridge according to claim 21, wherein the means for moving the detector includes means for resisting movement of the means for moving the body within fluid contained in the liquid chamber.

* * * * *